US006681150B1

(12) United States Patent
Haga et al.

(10) Patent No.: US 6,681,150 B1
(45) Date of Patent: Jan. 20, 2004

(54) INSECT ROBOT

(75) Inventors: Yoshinori Haga, Mibu-machi (JP); Keiichi Kazami, Kasukabe (JP); Yuji Sawajiri, Mibu-machi (JP); Shinichi Suda, Mibu-machi (JP); Masayosi Sato, Mooka (JP)

(73) Assignee: Bandai Co., Ltd., Tokyo (JP)

( * ) Notice: Subject to any disclaimer, the term of this patent is extended or adjusted under 35 U.S.C. 154(b) by 0 days.

(21) Appl. No.: 10/111,089

(22) PCT Filed: Sep. 26, 2000

(86) PCT No.: PCT/JP00/06613

§ 371 (c)(1),
(2), (4) Date: Jul. 8, 2002

(87) PCT Pub. No.: WO01/38050

PCT Pub. Date: May 31, 2001

(30) Foreign Application Priority Data

Nov. 20, 1999 (JP) ..... 11-370764

(51) Int. Cl.[7] ..... G06F 19/00

(52) U.S. Cl. ..... 700/245; 700/255; 700/260; 446/330; 446/353; 446/356; 446/368; 446/376; 446/377; 446/390; 180/8.6; 244/72

(58) Field of Search ..... 700/245, 255, 700/260; 446/356, 368, 376, 377, 353, 330, 390; 180/8.6; 244/72

(56) References Cited

U.S. PATENT DOCUMENTS

| | | | | |
|---|---|---|---|---|
| 3,331,463 A | * | 7/1967 | Kramer | 180/8.6 |
| 4,629,440 A | * | 12/1986 | McKittrick et al. | 446/356 |
| 4,666,419 A | * | 5/1987 | Droller et al. | 446/330 |
| 5,423,708 A | * | 6/1995 | Allen | 446/356 |
| 6,012,962 A | * | 1/2000 | Arriola | 446/376 |
| 6,206,324 B1 | * | 3/2001 | Smith | 244/72 |
| 6,238,264 B1 | * | 5/2001 | Kazami et al. | 446/356 |

FOREIGN PATENT DOCUMENTS

| | | |
|---|---|---|
| JP | A 1-183704 | 7/1989 |
| JP | 04-329990 | 11/1992 |
| JP | A 5-33786 | 2/1993 |
| JP | A 8-57159 | 3/1996 |
| JP | A 9-7553 | 1/1997 |
| JP | 09-185412 | 7/1997 |
| JP | 09-215870 | 8/1997 |
| JP | 09-322273 | 12/1997 |
| JP | A 10-289006 | 10/1998 |
| JP | A 11-143849 | 5/1999 |
| JP | 02000271350 A * | 10/2000 |

OTHER PUBLICATIONS

Sarita et al., Insectile and vermtform exploratory robots, 1999, Internet, pp. 1–22.*

CSM International, Insect Robots Zone, Photoant, 2001, INternet, p. 1, (http:/scmstore.com/english/robotic/biorobots/photoant).*

(List continued on next page.)

*Primary Examiner*—William A. Cuchlinski, Jr.
*Assistant Examiner*—McDieunel Marc
(74) *Attorney, Agent, or Firm*—Oliff & Berridge, PLC

(57) ABSTRACT

External state detection device detects an environmental state indicating whether there is an obstacle, external light, or a pheromone signal. On the basis of the detection result, sensor identification unit determining device determines an identifying unit that matches the environmental state. In response to determination of the sensor identifying unit, action units defining actions such as "move forward" or "move backward" related to the sensor identifying unit in an instruction unit are sequentially selected. Action unit execution device executes the action defined by the selected action unit for a preassigned execution time by rotating left and right leg driving wheels in a driving mode including a combination of "forward rotation", reverse rotation", and "stop". Thus, there is provided an insect robot for simulating behavior in a vivid and realistic manner.

17 Claims, 72 Drawing Sheets

OTHER PUBLICATIONS

Uluc et al., RHex: A simple and highly mobile Hexapid robot, 2001, Internet, pp. 616–631.*
Deng, et al., Hovering flight control of a Micromechanical flying insect, 2001, IEEE, pp. 235–3900.*
Lewis et al., Genetic algorithms for gait synthesis in a hexapod robot, 1994, Internet, pp. 1–15.*
Conard et al., Circuit cellar—A PC–based ontroller for the stiquito robot, 1999, Internet, pp. 1–4.*
Shimoyama et al., "Bunseki to Togo ni yoru Konchu no Kodo Hatsugen Mechanism no Kenkyu", Nippon Robbot Gakkaishi, vol. 18, No. 15, 1998, pp. 36–40.

Sayama et al., "Recurrent Network womochiita Konchu Kodo no Simulation", Nippon Kikai Gakkai Robotics Mechatronics Kouenkai, Kouen Ronbun, vol. A, 1995, pp. 580–583.

* cited by examiner

MOTOR DRIVER
THE MOTOR DRIVER EMPLOYED HAS
FUNCTIONS DESCRIBED BELOW
(SANYO LB1638M)

| INPUT TERMINAL | FORWARD ROTATION | REVERSE ROTATION | STOP | BRAKE |
|---|---|---|---|---|
| IN1 | HI | LOW | LOW | HI |
| IN2 | LOW | HI | LOW | HI |

Fig. 3

COWARD TYPE

| ACTION PROGRAM UNIT | INPUT PARAMETER | | | | | OUTPUT PARAMETER | | |
|---|---|---|---|---|---|---|---|---|
| | LEFT EYE IF SOMETHING IS PRESENT : 1 | RIGHT EYE IF SOMETHING IS PRESENT : 1 | RECEPTION PHEROMONE SIGNAL | LIGHT IF DARK : 1 | CURRENT ACTION | ACTION NAME | DURATION (x 100msec) | ROTATION SPEED OF MOTOR |
| | VARIABLE NAME : left_eye | VARIABLE NAME : right_eye | VARIABLE NAME : pheromone | VARIABLE NAME : dark | VARIABLE NAME : now_action | VARIABLE NAME : action | VARIABLE NAME : act_time | VARIABLE NAME : duty |
| A | - | - | - | - | - | forward movement | 10 | 60% |
| B | 1 | - | - | - | - | right turn | 25 | 60% |
| C | - | 1 | - | - | - | left turn | 25 | 60% |
| D | 1 | 1 | - | - | - | backward movement | 30 | 60% |
| E | 1 | 1 | - | - | stop | struggle | 60 | 100% |
| F | 1 | 1 | weak type | - | - | threat | 60 | 100% |
| G | 1 | 1 | same type | - | - | greeting | 60 | 60% |
| H | - | - | strong type | - | - | escape | 30 | 100% |
| I | - | - | - | 1 | - | stop | 20 | 0% |

Fig. 7

RECKLESS TYPE

| ACTION PROGRAM UNIT | INPUT PARAMETER | | | | | OUTPUT PARAMETER | | |
|---|---|---|---|---|---|---|---|---|
| | LEFT EYE IF SOMETHING IS PRESENT : 1 | RIGHT EYE IF SOMETHING IS PRESENT : 1 | RECEPTION PHEROMONE SIGNAL | LIGHT IF DARK : 1 | CURRENT ACTION | ACTION NAME | DURATION (x 100msec) | ROTATION SPEED OF MOTOR |
| | VARIABLE NAME : left_eye | VARIABLE NAME : right_eye | VARIABLE NAME : pheromone | VARIABLE NAME : dark | VARIABLE NAME : now_action | VARIABLE NAME : action | VARIABLE NAME : act_time | VARIABLE NAME : duty |
| A | - | - | - | - | - | forward movement | 10 | 60% |
| B | 1 | - | - | - | - | left turn | 25 | 60% |
| C | - | 1 | - | - | - | right turn | 25 | 60% |
| D | 1 | 1 | - | - | - | forward movement | 10 | 100% |
| E | | | same type | | | forward movement | 30 | 100% |
| F | | | weak type | | | forward movement | 30 | 100% |
| G | - | - | strong type | - | - | forward movement | 30 | 100% |
| H | - | - | - | 1 | - | stop | 20 | 0% |

Fig. 9

| ACTION | | | | | |
|---|---|---|---|---|---|
| ACTION NAME (action) | DATA TRANSMITTED TO MOTOR DRIVER | DURATION (x 100msec) (act_time) | DUTY RATIO (duty) | DIRECTION IN WHICH LEGS MOVE | MOTION OF INSECT ROBOT | MOTION OF LEGS |
| FORWARD MOVEMENT | L: IN1 1 0, IN2 1 0; 60%; 10X100ms<br>R: IN1 1 0, IN2 1 0; 60%; 10X100ms | 10 | 60% | DRIVE LEFT AND RIGHT LEGS IN FORWARD DIRECTION SO THAT LEFT AND RIGHT LEGS MOVE FORWARD ALTERNATELY | | STATE 1 CCC CCC<br>STATE 2 CCC CCC<br>GEARS ARE DRIVEN IN DIRECTIONS DENOTED BY ARROWS SO THAT STATES 1 AND 2 ALTERNATELY APPEAR THEREBY ACHIEVING FORWORD MOVEMENT. (GEAR HOLE LOCATIONS ARE DIFFERENT IN PHASE BY 180° IN FRONT, MIDDLE, AND REAR LEGS, RESPECTIVELY) |

Fig. 10Ai

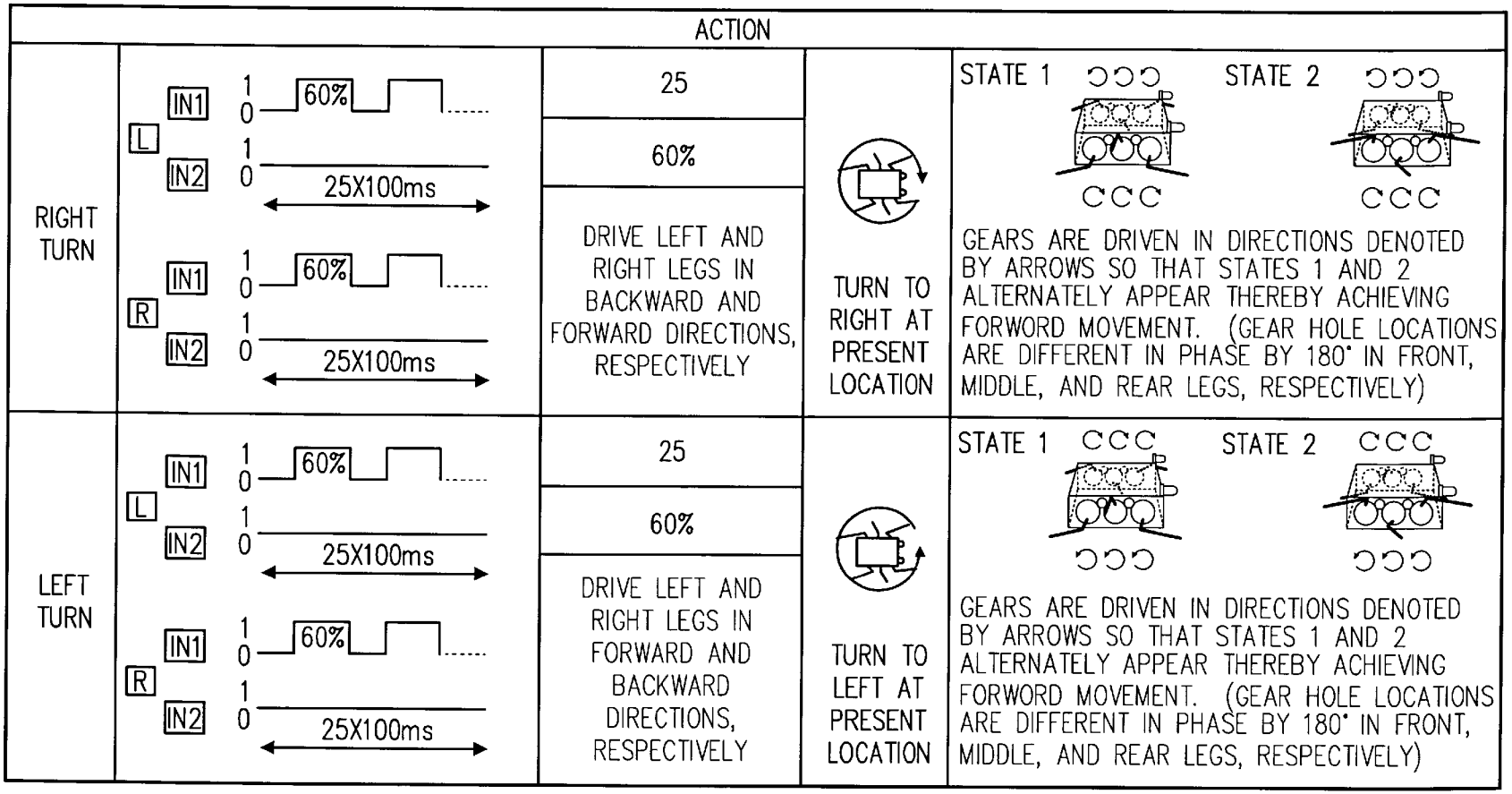
Fig. 10Aii

| ACTION | | | | | |
|---|---|---|---|---|---|
| ACTION NAME (action) | DATA TRANSMITTED TO MOTOR DRIVER | DURATION (x 100msec) (act_time) | DUTY RATIO (duty) | DIRECTION IN WHICH LEGS MOVE | MOTION OF INSECT ROBOT | MOTION OF LEGS |
| BACKWARD MOVEMENT | L IN1 1 0 IN2 1 0 60% 30X100ms R IN1 1 0 IN2 1 0 60% 30X100ms | 30 | 60% | DRIVE LEFT AND RIGHT LEGS IN BACKWARD DIRECTION SO THAT LEFT AND RIGHT LEGS MOVE BACKWARD ALTERNATELY | | STATE 1 STATE 2 GEARS ARE DRIVEN IN DIRECTIONS DENOTED BY ARROWS SO THAT STATES 1 AND 2 ALTERNATELY APPEAR THEREBY ACHIEVING FORWORD MOVEMENT. (GEAR HOLE LOCATIONS ARE DIFFERENT IN PHASE BY 180° IN FRONT, MIDDLE, AND REAR LEGS, RESPECTIVELY) |

Fig. 10Bi

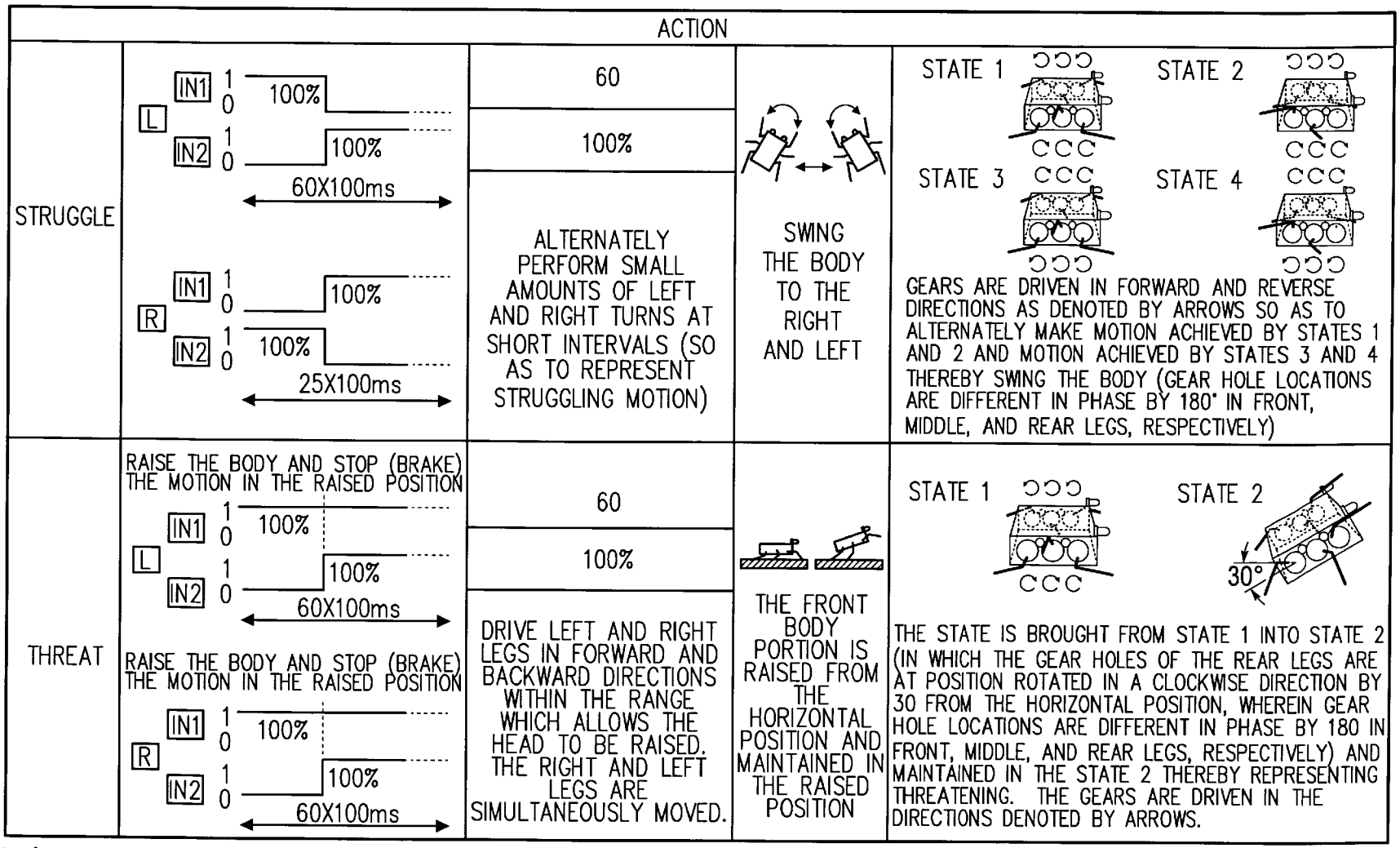
Fig. 10Bii

| ACTION | | | | |
|---|---|---|---|---|
| ACTION NAME (action) | DATA TRANSMITTED TO MOTOR DRIVER | DURATION (x 100msec) (act_time) | MOTION OF INSECT ROBOT | MOTION OF LEGS |
| | | DUTY RATIO (duty) | | |
| | | DIRECTION IN WHICH LEGS MOVE | | |
| GREETING | RAISE THE REAR BODY PART AND STOP (BRAKE) THE MOTION IN THE RAISED POSITION<br>L: IN1 1/0 100%; IN2 1/0 100%; 60X100ms<br>RAISE THE REAR BODY PART AND STOP (BRAKE) THE MOTION IN THE RAISED POSITION<br>R: IN1 1/0 100%; IN2 1/0 100%; 60X100ms | 60 | THE FRONT BODY PORTION IS LOWERED FROM THE HORIZONTAL POSITION AND MAINTAINED IN THE LOWERED POSITION | STATE 1 STATE 2<br>30°<br>THE STATE IS BROUGHT FROM STATE 1 INTO STATE 2 (IN WHICH THE GEAR HOLES OF THE FRONT LEGS ARE AT POSITION ROTATED IN A COUNTERCLOCKWISE DIRECTION BY 30°FROM THE HORIZONTAL POSITION, WHEREIN GEAR HOLE LOCATIONS ARE DIFFERENT IN PHASE BY 180°IN FRONT, MIDDLE, AND REAR LEGS, RESPECTIVELY) AND MAINTAINED IN THE STATE 2 THEREBY REPRESENTING THREATENING. THE GEARS ARE DRIVEN IN THE DIRECTIONS DENOTED BY ARROWS. |
| | | 100% | | |
| | | DRIVE LEFT AND RIGHT LEGS IN FORWARD AND BACKWARD DIRECTIONS WITHIN THE RANGE WHICH ALLOWS THE REAR BODY PART TO BE RAISED. THE RIGHT AND LEFT LEGS ARE SIMULTANEOUSLY MOVED. | | |

Fig. 10Ci

| ACTION | | | | |
|---|---|---|---|---|
| ESCAPE | L: IN1 1/0; IN2 1/0; 100%; 30X100ms<br>R: IN1 1/0; IN2 1/0; 100%; 30X100ms | 30<br>100%<br>LEFT AND RIGHT LEGS ARE DRIVEN IN THE BACKWARD DIRECTION WITH THE SAME TIMING SO THAT THE LEFT AND RIGHT LEGS ALTERNATELY MOVE. | QUICKLY MOVE IN THE BACKWARD DIRECTION | SIMILAR TO THE MOTION FOR THE BACKWARD MOVEMENT. THE DUTY RATIO IS SELECTED SO THAT A LARGE ENOUGH ROTATION SPEED IS ACHIEVED. |
| STOP | L: IN1 1/0 0%; IN2 1/0 0%; 20X100ms<br>R: IN1 1/0 0%; IN2 1/0 0%; 20X100ms | 20<br>0%<br>BOTH LEGS ARE STOPPED | | |

Fig. 10Cii

| ADDRESS | | |
|---|---|---|
| 0 | ADDRESS OF PANEL 1 | → 5 |
| 1 | ADDRESS OF PANEL 2 | → 14 |
| 2 | ADDRESS OF PANEL 3 | → 20 |
| 3 | ADDRESS OF PANEL 4 | → 23 |
| 4 | SETTING OF VARIOUS PARAMETERS (TYPE, SENSOR SENSITIVITY, ETC.) | |
| 5 | SENSOR IDENTIFYING UNIT (NOTHING IS PRESENT) | PANEL 1 |
| 6 | ACTION UNIT (MOVE FORWARD ONE STEP, ALLOWED) | PANEL 1 |
| 7 | SENSOR IDENTIFYING UNIT (COLLISION WITH AN OBSTACLE ON THE RIGHT) | PANEL 1 |
| 8 | ACTION UNIT (MOVE BACKWARD THREE STEPS, INHIBITED) | PANEL 1 |
| 9 | ACTION UNIT (TURN TO LEFT THREE STEPS, INHIBITED) | PANEL 1 |
| 10 | SENSOR IDENTIFYING UNIT (COLLISION WITH AN OBSTCLE ON THE LEFT) | PANEL 1 |
| 11 | ACTION UNIT (STOP ONE SEC, INHIBITED) | PANEL 1 |
| 12 | ACTION UNIT (TURN TO RIGHT THREE STEPS, INHIBITED) | PANEL 1 |
| 13 | END COMMAND | |
| 14 | SENSOR IDENTIFYING UNIT | PANEL 2 |
| 15 | ACTION UNIT | PANEL 2 |
| 16 | SENSOR IDENTIFYING UNIT | PANEL 2 |
| 17 | ACTION UNIT | PANEL 2 |
| 18 | ACTION UNIT | PANEL 2 |
| 19 | END COMMAND | |
| 20 | SENSOR IDENTIFYING UNIT | PANEL 3 |
| 21 | ACTION UNIT | PANEL 3 |
| 22 | END COMMAND | |
| 23 | SENSOR IDENTIFYING UNIT | PANEL 4 |
| 24 | ACTION UNIT | PANEL 4 |
| 25 | END COMMAND | |

LOW ↑ PRIORITY ↓ HIGH

Fig. 16

| TYPE OF SENSOR IDENTIFYING UNIT | SENSOR IDENTIFYING UNIT NUMBER | CONDITION OF INPUT PARAMETER FROM SENSOR |
|---|---|---|
| NOTHING IS PRESENT | 0 | WHEN THERE IS NO RESPONSE FROM A SENSOR IDENTIFYING UNIT OTHER THAN "NOTHING IS PRESENT", SELECTED BY A USER |
| SOMETHING IS PRESENT IN FRONT | 1 | front_eye = 1 |
| SOMETHING IS PRESENT ON THE RIGHT SIDE | 2 | right_eye = 1 |
| SOMETHING IS PRESENT ON THE LEFT SIDE | 3 | left_eye = 1 |
| COLLIDED WITH AN OBSTACLE PRESENT IN FRONT | 4 | front_touch = 1 |
| COLLIDED WITH AN OBSTACLE PRESENT ON THE RIGHT SIDE | 5 | right_touch = 1 |
| COLLIDED WITH AN OBSTACLE PRESENT ON THE LEFT SIDE | 6 | left_touch = 1 |
| REGIN IN FRONT IS BRIGHT | 7 | bright = 1 |
| REGION IN FRONT IS DARK | 8 | dark = 1 |
| CANNOT MOVE | 9 | do_not_work = 1 |
| A TYPE IS PRESENT | 10 | pheromone1 = 1 |
| B TYPE IS PRESENT | 11 | pheromone2 = 1 |
| C TYPE IS PRESENT | 12 | pheromone3 = 1 |
| COMMUNICATION PHEROMONE 1 IS RECEIVED | 13 | pheromone4 = 1 |
| COMMUNICATION PHEROMONE 2 IS RECEIVED | 14 | pheromone5 = 1 |
| SPACE PHEROMONE 1 IS RECEIVED | 15 | pheromone6 = 1 |
| 10 SECONDS HAVE ELAPSED | 16 | trigger_time_10 = 1 |
| 20 SECONDS HAVE ELAPSED | 17 | trigger_time_20 = 1 |
| 30 SECONDS HAVE ELAPSED | 18 | trigger_time_30 = 1 |
| 60 SECONDS HAVE ELAPSED | 19 | trigger_time_60 = 1 |

Fig. 18

| TYPE OF ACTION UNIT | TYPE OF ACTION (ACTION NUMBER) | OPERAND | DURATION, NUMBER OF STEPS, OR NUMBER OF TIMES | ALLOWANCE OR INHIBITION OF INTERRUPT |
|---|---|---|---|---|
| STOP | 0 | 0 | TIME | ALLOWED OR INHIBITED |
| MOVE FORWARD | 1 | 0 | NUMBER OF STEPS | ALLOWED OR INHIBITED |
| MOVE FORWARD QUICKLY | 1 | 1 | NUMBER OF STEPS | ALLOWED OR INHIBITED |
| MOVE BACKWARD | 2 | 0 | NUMBER OF STEPS | ALLOWED OR INHIBITED |
| MOVE BACKWARD QUICKLY | 2 | 1 | NUMBER OF STEPS | ALLOWED OR INHIBITED |
| TURN TO RIGHT | 3 | 0 | NUMBER OF STEPS | ALLOWED OR INHIBITED |
| TURN TO RIGHT QUICKLY | 3 | 1 | NUMBER OF STEPS | ALLOWED OR INHIBITED |
| TURN TO LEFT | 4 | 0 | NUMBER OF STEPS | ALLOWED OR INHIBITED |
| TURN TO LEFT QUICKLY | 4 | 1 | NUMBER OF STEPS | ALLOWED OR INHIBITED |
| CURVE TO RIGHT | 5 | 0 | NUMBER OF STEPS | ALLOWED OR INHIBITED |
| CURVE TO RIGHT QUICKLY | 5 | 1 | NUMBER OF STEPS | ALLOWED OR INHIBITED |
| CURVE TO LEFT | 6 | 0 | NUMBER OF STEPS | ALLOWED OR INHIBITED |
| CURVE TO LEFT QUICKLY | 6 | 1 | NUMBER OF STEPS | ALLOWED OR INHIBITED |
| CURVE TO RIGHT BACKWARD | 7 | 0 | NUMBER OF STEPS | ALLOWED OR INHIBITED |
| CURVE TO RIGHT BACKWARD QUICKLY | 7 | 1 | NUMBER OF STEPS | ALLOWED OR INHIBITED |
| CURVE TO LEFT BACKWARD | 8 | 0 | NUMBER OF STEPS | ALLOWED OR INHIBITED |
| CURVE TO LEFT BACKWARD QUICKLY | 8 | 1 | NUMBER OF STEPS | ALLOWED OR INHIBITED |
| TURN TO RIGHT OR LEFT | 9 | 0 | NUMBER OF STEPS | ALLOWED OR INHIBITED |
| TURN TO RIGHT OR LEFT QUICKLY | 9 | 1 | NUMBER OF STEPS | ALLOWED OR INHIBITED |
| STRUGGLE | 10 | 1 | TIME | ALLOWED OR INHIBITED |
| THREATEN | 11 | 1 | NUMBER OF TIMES | ALLOWED OR INHIBITED |
| GREET | 12 | 0 | NUMBER OF TIMES | ALLOWED OR INHIBITED |
| SQUEAK 1 | 13 | 0 | NUMBER OF TIMES | ALLOWED OR INHIBITED |
| SQUEAK 2 | 13 | 1 | NUMBER OF TIMES | ALLOWED OR INHIBITED |
| SQUEAK 3 | 13 | 2 | NUMBER OF TIMES | ALLOWED OR INHIBITED |
| SQUEAK 4 | 13 | 3 | NUMBER OF TIMES | ALLOWED OR INHIBITED |
| TRANSMIT COMMUNICATION PHEROMONE 1 | 14 | 0 | NUMBER OF TIMES | ALLOWED OR INHIBITED |
| TRANSMIT COMMUNICATION PHEROMONE 2 | 14 | 1 | NUMBER OF TIMES | ALLOWED OR INHIBITED |
| TO PANEL 1 | 15 | 0 | NOTHING | ALLOWED OR INHIBITED |
| TO PANEL 2 | 15 | 1 | NOTHING | ALLOWED OR INHIBITED |
| TO PANEL 3 | 15 | 2 | NOTHING | ALLOWED OR INHIBITED |
| TO PANEL 4 | 15 | 3 | NOTHING | ALLOWED OR INHIBITED |

Fig. 19

| ACTION NAME | | DATA TRANSMITTED TO MOTOR DRIVER | DUTY RATIO OF THE DATA | MOTION OF INSECT ROBOT | MOTION OF LEGS |
|---|---|---|---|---|---|
| STOP | TYPE OF ACTION: 0 | L: IN1 1/0 0%; IN2 1/0 0%<br>R: IN1 1/0 0%; IN2 1/0 0% | 0% | STOP THE LEGS ON BOTH SIDES | STOP |
| | OPERAND: 0 | | | | |
| FORWARD MOVEMENT | TYPE OF ACTION: 1 | L: IN1 1/0 60%; IN2 1/0<br>R: IN1 1/0 60%; IN2 1/0 | 60% | DRIVE LEFT AND RIGHT LEGS IN FORWARD DIRECTION SO THAT LEFT AND RIGHT LEGS MOVE ALTERNATELY | REFER TO "TYPE OF ACTION: 1, FORWARD MOVEMENT" |
| | OPERAND: 0 | | | | |
| QUICK FORWARD MOVEMENT | TYPE OF ACTION: 1 | L: IN1 1/0 100%; IN2 1/0<br>R: IN1 1/0 100%; IN2 1/0 | 100% | DRIVE LEFT AND RIGHT LEGS IN FORWARD DIRECTION SO THAT LEFT AND RIGHT LEGS MOVE ALTERNATELY | REFER TO "TYPE OF ACTION: 1, FORWARD MOVEMENT" |
| | OPERAND: 1 | | | | |

Fig. 31Ai

| ACTION NAME | | DATA TRANSMITTED TO MOTOR DRIVER | DUTY RATIO OF THE DATA | MOTION OF INSECT ROBOT | MOTION OF LEGS |
|---|---|---|---|---|---|
| BACKWARD MOVEMENT | TYPE OF ACTION: 2 | L: IN1 1/0 ——; IN2 1/0 60% ... R: IN1 1/0 ——; IN2 1/0 60% ... | 60% | DRIVE LEFT AND RIGHT LEGS IN BACKWARD DIRECTION SO THAT LEFT AND RIGHT LEGS MOVE ALTERNATELY | REFER TO "TYPE OF ACTION: 2, BACKWARD MOVEMENT" |
| | OPERAND: 0 | | | | |
| QUICK BACKWARD MOVEMENT | TYPE OF ACTION: 2 | L: IN1 1/0 ——; IN2 1/0 100% R: IN1 1/0 ——; IN2 1/0 100% | 100% | DRIVE LEFT AND RIGHT LEGS IN BACKWARD DIRECTION SO THAT LEFT AND RIGHT LEGS MOVE ALTERNATELY | REFER TO "TYPE OF ACTION: 2, BACKWARD MOVEMENT" |
| | OPERAND: 1 | | | | |

Fig. 31Aii

| ACTION NAME | | DATA TRANSMITTED TO MOTOR DRIVER | DUTY RATIO OF THE DATA | MOTION OF INSECT ROBOT | MOTION OF LEGS |
|---|---|---|---|---|---|
| TURN TO RIGHT | TYPE OF ACTION: 3 | L: IN1 1/0 ——; IN2 1/0 60% ... R: IN1 1/0 60% ...; IN2 1/0 —— | 60% | TURN TO RIGHT AT THE PRESENT LOCATION DRIVE LEFT AND RIGHT LEGS BACKWARD AND FORWARD, RESPECTIVELY, SO THAT LEFT AND RIGHT LEGS MOVE ALTERNATELY | REFER TO "TYPE OF ACTION: 3, TURN TO RIGHT" |
| | OPERAND: 0 | | | | |
| QUICK TURN TO RIGHT | TYPE OF ACTION: 3 | L: IN1 1/0 ——; IN2 1/0 100% R: IN1 1/0 100%; IN2 1/0 —— | 100% | TURN TO RIGHT AT THE PRESENT LOCATION DRIVE LEFT AND RIGHT LEGS BACKWARD AND FORWARD, RESPECTIVELY, SO THAT LEFT AND RIGHT LEGS MOVE ALTERNATELY | REFER TO "TYPE OF ACTION: 3, TURN TO RIGHT" |
| | OPERAND: 1 | | | | |

Fig. 31Bi

| ACTION NAME | | DATA TRANSMITTED TO MOTOR DRIVER | DUTY RATIO OF THE DATA | MOTION OF INSECT ROBOT | MOTION OF LEGS |
|---|---|---|---|---|---|
| TURN TO LEFT | TYPE OF ACTION: 4 | L: IN1 1/0 60%; IN2 1/0 — R: IN1 1/0 —; IN2 1/0 60% | 60% | TURN TO LEFT AT THE PRESENT LOCATION DRIVE LEFT AND RIGHT LEGS FORWARD AND BACKWARD, RESPECTIVELY, SO THAT LEFT AND RIGHT LEGS MOVE ALTERNATELY | REFER TO "TYPE OF ACTION: 4, TURN TO LEFT" |
| | OPERAND: 0 | | | | |
| QUICK TURN TO LEFT | TYPE OF ACTION: 2 | L: IN1 1/0 100%; IN2 1/0 — R: IN1 1/0 —; IN2 1/0 100% | 100% | TURN TO LEFT AT THE PRESENT LOCATION DRIVE LEFT AND RIGHT LEGS FORWARD AND BACKWARD, RESPECTIVELY, SO THAT LEFT AND RIGHT LEGS MOVE ALTERNATELY | REFER TO "TYPE OF ACTION: 4, TURN TO LEFT" |
| | OPERAND: 0 | | | | |

Fig. 31Bii

| ACTION NAME | | DATA TRANSMITTED TO MOTOR DRIVER | DUTY RATIO OF THE DATA | MOTION OF INSECT ROBOT | MOTION OF LEGS |
|---|---|---|---|---|---|
| CURVE TO RIGHT | TYPE OF ACTION: 5 | L: IN1 1/0 0%; IN2 1/0 0%<br>R: IN1 1/0; IN2 1/0 60% ... | 60% | 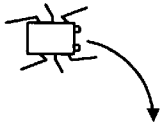 <br>TURN TO RIGHT WHILE MOVING FORWARD DRIVE LEFT LEGS FORWARD WHILE KEEPING RIGHT LEGS AT REST | REFER TO "TYPE OF ACTION: 5, CURVE TO RIGHT" |
| | OPERAND: 0 | | | | |
| QUICK CURVE TO RIGHT | TYPE OF ACTION: 5 | L: IN1 1/0 100%; IN2 1/0<br>R: IN1 1/0 0%; IN2 1/0 0% | 100% | 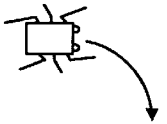 <br>TURN TO RIGHT WHILE MOVING FORWARD DRIVE LEFT LEGS FORWARD WHILE KEEPING RIGHT LEGS AT REST | REFER TO "TYPE OF ACTION: 5, CURVE TO RIGHT" |
| | OPERAND: 1 | | | | |

Fig. 31Biii

| ACTION NAME | | DATA TRANSMITTED TO MOTOR DRIVER | DUTY RATIO OF THE DATA | MOTION OF INSECT ROBOT | MOTION OF LEGS |
|---|---|---|---|---|---|
| CURVE TO LEFT | TYPE OF ACTION: 6 | L: IN1 1/0 0%; IN2 1/0 0%<br>R: IN1 1/0 60%; IN2 1/0 | 60% | TURN TO LEFT WHILE MOVING FORWARD DRIVE RIGHT LEGS FORWARD WHILE KEEPING LEFT LEGS AT REST | REFER TO "TYPE OF ACTION: 6, CURVE TO LEFT" |
| | OPERAND: 0 | | | | |
| QUICK CURVE TO LEFT | TYPE OF ACTION: 6 | L: IN1 1/0 0%; IN2 1/0 0%<br>R: IN1 1/0 100%; IN2 1/0 | 100% | TURN TO LEFT WHILE MOVING FORWARD DRIVE RIGHT LEGS FORWARD WHILE KEEPING LEFT LEGS AT REST | REFER TO "TYPE OF ACTION: 6, CURVE TO LEFT" |
| | OPERAND: 1 | | | | |

Fig. 31Ci

| ACTION NAME | | DATA TRANSMITTED TO MOTOR DRIVER | DUTY RATIO OF THE DATA | MOTION OF INSECT ROBOT | MOTION OF LEGS |
|---|---|---|---|---|---|
| CURVE TO RIGHT BACKWARD | TYPE OF ACTION: 7<br>OPERAND: 0 | L: IN1 1/0; IN2 1/0 60%<br>R: IN1 1/0 0%; IN2 1/0 0% | 60% | TURN TO RIGHT WHILE MOVING BACKWARD DRIVE LEFT LEGS BACKWARD WHILE KEEPING RIGHT LEGS AT REST | REFER TO "TYPE OF ACTION: 7, CURVE TO RIGHT BACKWARD" |
| QUICK CURVE TO RIGHT BACKWARD | TYPE OF ACTION: 7<br>OPERAND: 1 | L: IN1 1/0; IN2 1/0 100%<br>R: IN1 1/0 0%; IN2 1/0 0% | 100% | TURN TO RIGHT WHILE MOVING BACKWARD DRIVE LEFT LEGS BACKWARD WHILE KEEPING RIGHT LEGS AT REST | REFER TO "TYPE OF ACTION: 7, CURVE TO RIGHT BACKWARD" |

Fig. 31Cii

| ACTION NAME | | DATA TRANSMITTED TO MOTOR DRIVER | DUTY RATIO OF THE DATA | MOTION OF INSECT ROBOT | MOTION OF LEGS |
|---|---|---|---|---|---|
| CURVE TO RIGHT BACKWARD | TYPE OF ACTION: 8 | L: IN1 1/0 0%; IN2 1/0 0%<br>R: IN1 1/0; IN2 1/0 60% | 60% | TURN TO LEFT WHILE MOVING BACKWARD DRIVE RIGHT LEGS BACKWARD WHILE KEEPING LEFT LEGS AT REST | REFER TO "TYPE OF ACTION: 8, CURVE TO LEFT BACKWARD" |
| | OPERAND: 0 | | | | |
| QUICK CURVE TO RIGHT BACKWARD | TYPE OF ACTION: 8 | L: IN1 1/0; IN2 1/0 100%<br>R: IN1 1/0 0%; IN2 1/0 0% | 100% | TURN TO LEFT WHILE MOVING BACKWARD DRIVE RIGHT LEGS BACKWARD WHILE KEEPING LEFT LEGS AT REST | REFER TO "TYPE OF ACTION: 8, CURVE TO LEFT BACKWARD" |
| | OPERAND: 1 | | | | |

Fig. 31Di

| ACTION NAME | | DATA TRANSMITTED TO MOTOR DRIVER | DUTY RATIO OF THE DATA | MOTION OF INSECT ROBOT | MOTION OF LEGS |
|---|---|---|---|---|---|
| TURN TO RIGHT OR LEFT | TYPE OF ACTION: 9<br>OPERAND: 0 | REFER TO DESCRIPTIONS IN "ACTION OF TURN TO RIGHT" AND "ACTION OF TURN TO LEFT" FOR TURN TO RIGHT AND LEFT, RESPECTIVELY | 60% | 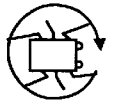 or 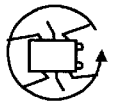 <br>TURN TO RIGHT OR LEFT AT THE PRESENT LOCATION<br>REFER TO DESCRIPTIONS IN "ACTION OF TURN TO RIGHT" AND "ACTION OF TURN TO LEFT" FOR TURN TO RIGHT AND LEFT, RESPECTIVELY | FOR TURN TO RIGHT, REFER TO "TYPE OF ACTION: 3, TURN TO RIGHT"<br>FOR TURN TO LEFT, REFER TO "TYPE OF ACTION: 4, TURN TO LEFT" |
| QUICK TURN TO RIGHT OR LEFT | TYPE OF ACTION: 9<br>OPERAND: 1 | REFER TO DESCRIPTIONS IN "ACTION OF QUICK TURN TO RIGHT" AND "ACTION OF QUICK TURN TO LEFT" FOR TURN TO RIGHT AND LEFT, RESPECTIVELY | 100% | 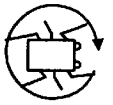 or 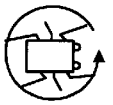 <br>TURN TO RIGHT OR LEFT AT THE PRESENT LOCATION<br>REFER TO DESCRIPTIONS IN "ACTION OF QUICK TURN TO RIGHT" AND "ACTION OF QUICK TURN TO LEFT" FOR TURN TO RIGHT AND LEFT, RESPECTIVELY | FOR TURN TO RIGHT, REFER TO "TYPE OF ACTION: 3, TURN TO RIGHT"<br>FOR TURN TO LEFT, REFER TO "TYPE OF ACTION: 4, TURN TO LEFT" |

Fig. 31Dii

| ACTION NAME | | DATA TRANSMITTED TO MOTOR DRIVER | DUTY RATIO OF THE DATA | MOTION OF INSECT ROBOT | MOTION OF LEGS |
|---|---|---|---|---|---|
| STRUGGLE | TYPE OF ACTION: 10 | L: IN1 1/0 100% ... | 100% | SWING THE BODY TO THE RIGHT AND LEFT ALTERNATELY PERFORM SMALL AMOUNTS OF LEFT AND RIGHT TURNS AT SHORT INTERVALS (SO AS TO REPRESENT STRUGGLING MOTION) | REFER TO "TYPE OF ACTION: 10, STRUGGLE" |
| | OPERAND: 1 | IN2 1/0 100% ... | | | |
| | | R: IN1 1/0 100% ... | | | |
| | | IN2 1/0 100% ... | | | |

Fig. 31Diii

| ACTION NAME | | DATA TRANSMITTED TO MOTOR DRIVER | | DUTY RATIO OF THE DATA | MOTION OF INSECT ROBOT | MOTION OF LEGS |
|---|---|---|---|---|---|---|
| THREAT | TYPE OF ACTION: 11 | L<br>RAISE THE BODY AND STOP (BRAKE) THE MOTION IN THE RAISED POSITION | R<br>RAISE THE BODY AND STOP (BRAKE) THE MOTION IN THE RAISED POSITION | 100% | 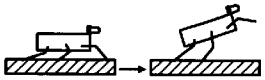 <br>MOVE THE FRONT PART OF THE BODY UPWARD FROM THE HORIZONTAL POSITION AND MAINTAIN IT IN THE RAISED POSITION<br>DRIVE LEFT AND RIGHT LEGS FORWARD AND BACKWARD WITHIN THE RANGE WHICH ALLOWS THE HEAD TO BE RAISED SUCH THAT THE RIGHT AND LEFT LEGS MOVE SIMULTANEOUSLY | REFER TO "TYPE OF ACTION: 11, THREAT" |
| | OPERAND: 0 | IN1 1/0 100%<br>IN2 1/0 100% | IN1 1/0 100%<br>IN2 1/0 100% | | | |
| GREETING | TYPE OF ACTION: 12 | L<br>RAISE THE BODY AND STOP (BRAKE) THE MOTION IN THE RAISED POSITION | R<br>RAISE THE BODY AND STOP (BRAKE) THE MOTION IN THE RAISED POSITION | 100% | 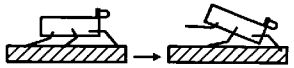 <br>MOVE THE FRONT PART OF THE BODY DOWNWARD FROM THE HORIZONTAL POSITION AND MAINTAIN IT IN THE LOWERED POSITION<br>DRIVE LEFT AND RIGHT LEGS FORWARD AND BACKWARD WITHIN THE RANGE WHICH ALLOWS THE REAR PART OF THE BODY TO BE RAISED SUCH THAT THE RIGHT AND LEFT LEGS MOVE SIMULTANEOUSLY | REFER TO "TYPE OF ACTION: 12, GREETING" |
| | OPERAND: 0 | IN1 1/0 100%<br>IN2 1/0 100% | IN1 1/0 100%<br>IN2 1/0 100% | | | |

Fig. 31Ei

| ACTION NAME | | | MOTION OF INSECT ROBOT | WAVEFORM OF DATA (SOUND DATA AND PHEROMONE PULSE) |
|---|---|---|---|---|
| SQUEAKING SOUND-1 | TYPE OF ACTION 13 | OPERAND 0 | KYUUUH<br>GENERATE A SQUEAKING SOUND-1 BY THE SPEAKER | |
| SQUEAKING SOUND-2 | TYPE OF ACTION 13 | OPERAND 1 | GYUUUH<br>GENERATE A SQUEAKING SOUND-2 BY THE SPEAKER | |
| SQUEAKING SOUND-3 | TYPE OF ACTION 13 | OPERAND 2 | KYUHKYUH<br>GENERATE A SQUEAKING SOUND-1 BY THE SPEAKER | |

Fig. 31Fi

| ACTION NAME | | MOTION OF INSECT ROBOT | WAVEFORM OF DATA (SOUND DATA AND PHEROMONE PULSE) |
|---|---|---|---|
| SQUEAKING SOUND-4 | TYPE OF ACTION 13 | GYULYUUH | |
| | OPERAND 3 | GENERATE A SQUEAKING SOUND-2 BY THE SPEAKER | |
| TRANSMISSION OF PHEROMONE OF THE INSECT ROBOT ITSELF | TYPE OF ACTION 14 | | pheromone 1 (TYPE A) |
| | OPERAND 0 | TRANSMIT PHEROMONE OF THE INSECT ROBOT ITSELF (TYPE A, B, OR C) | pheromone 2 (TYPE B) |
| | | | pheromone 3 (TYPE C) |

Fig. 31Fii

| ACTION NAME | | MOTION OF INSECT ROBOT | WAVEFORM OF DATA (SOUND DATA AND PHEROMONE PULSE) |
|---|---|---|---|
| TRANSMISSION OF PHEROMONE-1 | TYPE OF ACTION 14 | TRANSMIT PHEROMONE-1 | pheromone 4 (PHEROMONE-1) |
| | OPERAND 1 | | |
| TRANSMISSION OF PHEROMONE-2 | TYPE OF ACTION 14 | TRANSMIT PHEROMONE-2 | pheromone 5 (PHEROMONE-2) |
| | OPERAND 2 | | |

Fig. 31G

| ACTION NAME | | MOTION OF INSECT ROBOT |
|---|---|---|
| TO PANEL-1 | TYPE OF ACTION: 15 | INTERNAL PROCESS REWRITE panel_number to 1 |
| | OPERAND: 0 | |
| TO PANEL-2 | TYPE OF ACTION: 15 | INTERNAL PROCESS REWRITE panel_number to 2 |
| | OPERAND: 1 | |
| TO PANEL-3 | TYPE OF ACTION: 15 | INTERNAL PROCESS REWRITE panel_number to 3 |
| | OPERAND: 2 | |
| TO PANEL-4 | TYPE OF ACTION: 15 | INTERNAL PROCESS REWRITE panel_number to 4 |
| | OPERAND: 3 | |

Fig. 31H

MOTION OF LEGS (TYPE OF ACTION: 1, FORWARD MOVEMENT)

MOVE THE ROBOT FORWARD BY DRIVING THE GEARS IN THE DIRECTIONS DENOTED BY ARROWS SUCH THAT THE STATE IS CHANGED REPEATEDLY IN THE ORDER OF STATES 1 ⇒2 ⇒3 ⇒4, IN WHICH LEG POSITIONS ARE DIFFERENT IN PHASE BY 180° BETWEEN LEFT AND RIGHT LEGS (GEAR HOLE LOCATIONS ARE DIFFERENT IN PHASE BY 180° IN FRONT, MIDDLE, AND REAR LEGS, RESPECTIVELY)

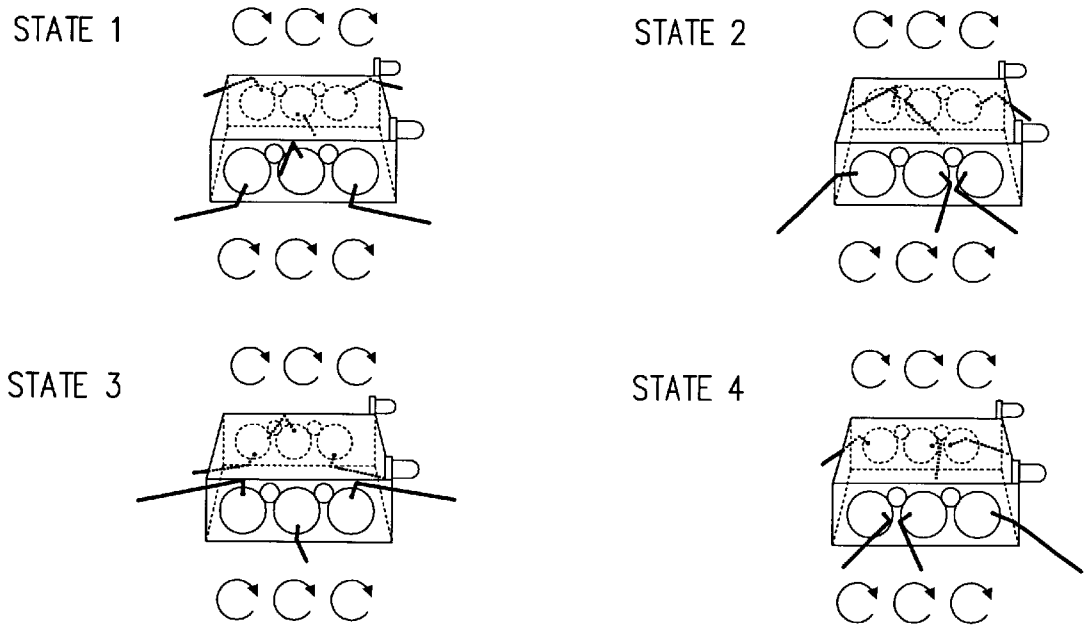

Fig. 31I

MOTION OF LEGS (TYPE OF ACTION: 2, BACKWARD MOVEMENT)

MOVE THE ROBOT BACKWARD BY DRIVING THE GEARS IN THE DIRECTIONS DENOTED BY ARROWS SUCH THAT THE STATE IS CHANGED REPEATEDLY IN THE ORDER OF STATES 1 ⇒2 ⇒3 ⇒4, IN WHICH LEG POSITIONS ARE DIFFERENT IN PHASE BY 180° BETWEEN LEFT AND RIGHT LEGS (GEAR HOLE LOCATIONS ARE DIFFERENT IN PHASE BY 180° BETWEEN FRONT, MIDDLE, AND REAR LEGS, RESPECTIVELY)

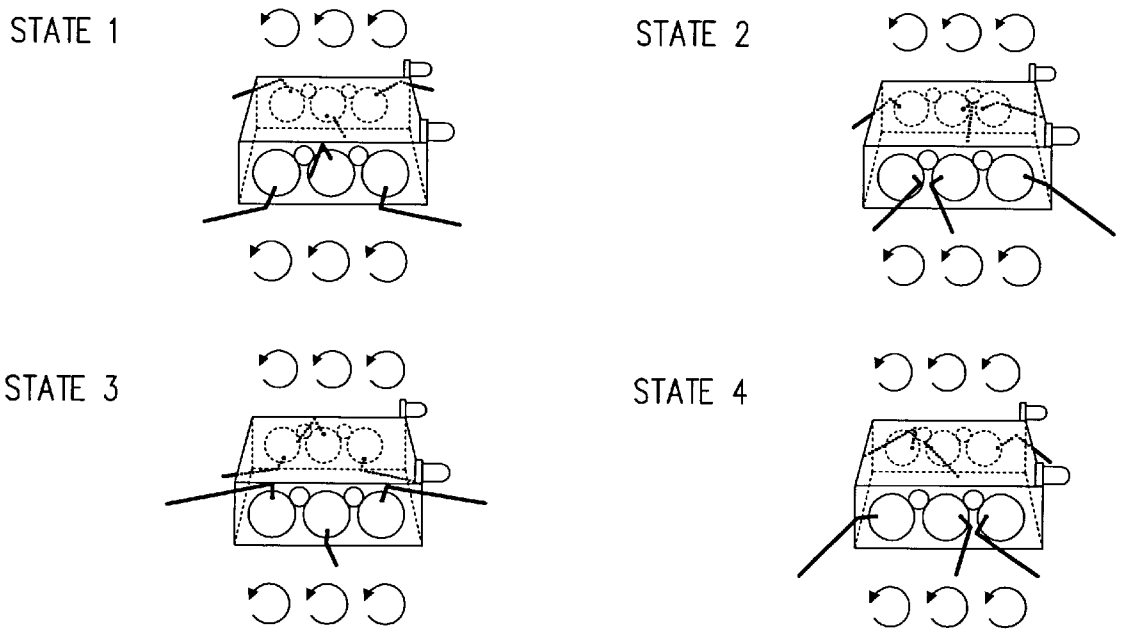

Fig. 31J

MOTION OF LEGS (TYPE OF ACTION: 4, TURN TO LEFT)

MOVE THE ROBOT SO AS TO TURN TO LEFT IN THE PRESENT LOCATION BY DRIVING THE GEARS IN THE DIRECTIONS DENOTED BY ARROWS SUCH THAT THE STATE IS CHANGED REPEATEDLY IN THE ORDER OF STATES 1 ⇒2 ⇒3 ⇒4, IN WHICH LEG POSITIONS ARE DIFFERENT IN PHASE BY 180° BETWEEN LEFT AND RIGHT LEGS (GEAR HOLE LOCATIONS ARE DIFFERENT IN PHASE BY 180° IN FRONT, MIDDLE, AND REAR LEGS, RESPECTIVELY)

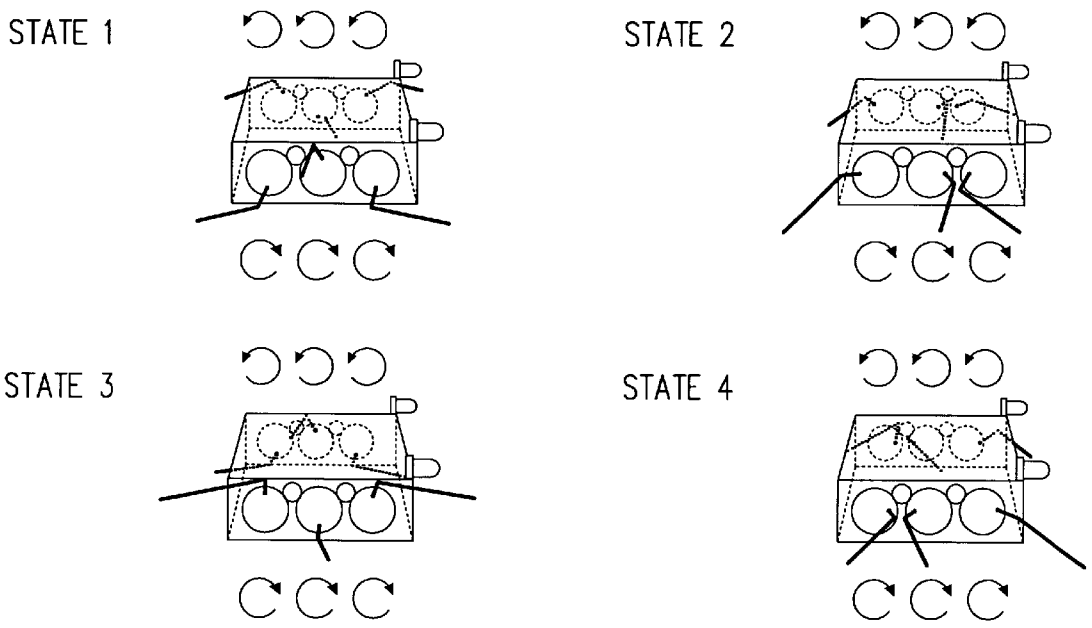

Fig. 31L

MOTION OF LEGS (TYPE OF ACTION: 5, CURVE TO RIGHT)

MOVE THE ROBOT SO AS TO CURVE TO RIGHT BY DRIVING ONLY THE LEFT LEGS IN THE DIRECTIONS DENOTED BY ARROWS WHILE KEEPING THE RIGHT LEGS AT REST SUCH THAT THE STATE IS CHANGED REPEATEDLY IN THE ORDER OF STATES 1 ⇒2 ⇒3 ⇒4, (IN WHICH LEG GEAR HOLE LOCATIONS ARE DIFFERENT IN PHASE BY 180° IN FRONT, MIDDLE, AND REAR LEGS, RESPECTIVELY)

MOTION OF LEGS (TYPE OF ACTION: 6, CURVE TO LEFT)

MOVE THE ROBOT SO AS TO CURVE TO LEFT BY DRIVING ONLY THE RIGHT LEGS IN THE DIRECTIONS DENOTED BY ARROWS WHILE KEEPING THE LEFT LEGS AT REST SUCH THAT THE STATE IS CHANGED REPEATEDLY IN THE ORDER OF STATES 1 ⇒2 ⇒3 ⇒4, (IN WHICH LEG GEAR HOLE LOCATIONS ARE DIFFERENT IN PHASE BY 180° IN FRONT, MIDDLE, AND REAR LEGS, RESPECTIVELY)

MOTION OF LEGS (TYPE OF ACTION: 7, CURVE TO RIGHT BACKWARD)

MOVE THE ROBOT SO AS TO CURVE TO RIGHT BACKWARD BY DRIVING ONLY THE LEFT LEGS IN THE DIRECTIONS DENOTED BY ARROWS WHILE KEEPING THE RIGHT LEGS AT REST SUCH THAT THE STATE IS CHANGED REPEATEDLY IN THE ORDER OF STATES 1 ⇒2 ⇒3 ⇒4, (IN WHICH LEG GEAR HOLE LOCATIONS ARE DIFFERENT IN PHASE BY 180° IN FRONT, MIDDLE, AND REAR LEGS, RESPECTIVELY)

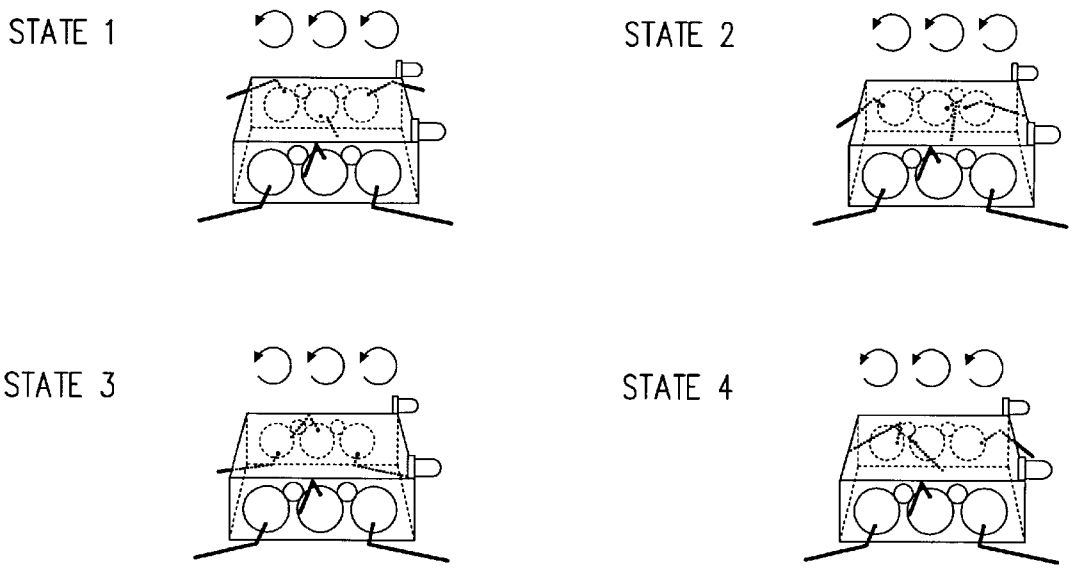

Fig. 31O

MOTION OF LEGS (TYPE OF ACTION: 8, CURVE TO LEFT BACKWARD)

MOVE THE ROBOT SO AS TO CURVE TO LEFT BACKWARD BY DRIVING ONLY THE RIGHT LEGS IN THE DIRECTIONS DENOTED BY ARROWS WHILE KEEPING THE LEFT LEGS AT REST SUCH THAT THE STATE IS CHANGED REPEATEDLY IN THE ORDER OF STATES 1 ⇒2 ⇒3 ⇒4, (IN WHICH LEG GEAR HOLE LOCATIONS ARE DIFFERENT IN PHASE BY 180° IN FRONT, MIDDLE, AND REAR LEGS, RESPECTIVELY)

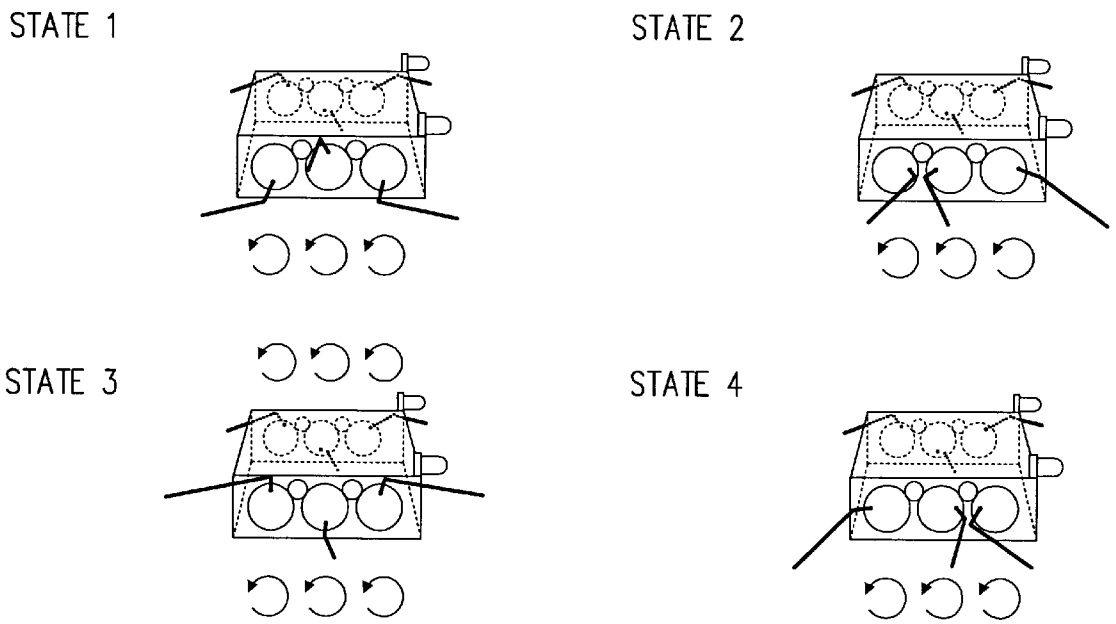

Fig. 31P

MOTION OF LEGS (TYPE OF ACTION: 10, STRUGGLE)

SWING THE BODY BY DRIVING THE GEARS FORWARD AND REVERSE DIRECTIONS AS DENOTED BY ARROWS SO AS TO REPEATEDLY PERFORM A FIRST SEQUENCE OF OPERATIONS AND A SECOND SEQUENCE OF OPERATIONS WHEREIN, IN THE FIRST SEQUENCE, THE STATE IS CHANGED REPEATEDLY IN THE ORDER OF STATES 1 ⇒2 ⇒3, WHILE IN THE SECOND SEQUENCE, THE STATE IS CHANGED IN THE ORDER OF 4 ⇒5 ⇒6 (IN WHICH LEG GEAR HOLE LOCATIONS ARE DIFFERENT IN PHASE BY 180° IN FRONT, MIDDLE, AND REAR LEGS, RESPECTIVELY)

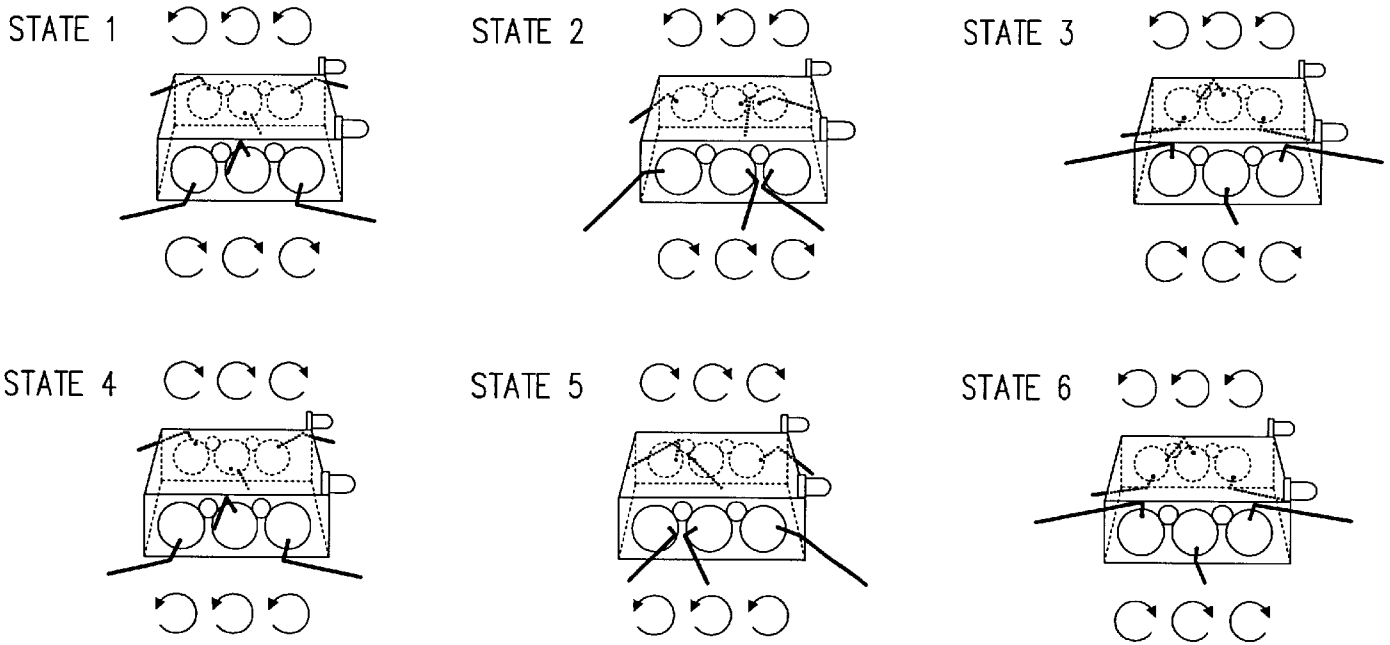

Fig. 31Q

MOTION OF LEGS (TYPE OF ACTION: 11, THREAT)

MOVE THE BODY IN STATE 1 INTO STATE 3 THROUGH STATE 2 BY DRIVING THE GEARS FORWARD AND REVERSE DIRECTIONS AS DENOTED BY ARROWS AND MAINTAIN THE STATE 3 (IN WHICH THE GEAR HOLES OF THE REAR LEGS ARE AT POSITION ROTATED IN A CLOCKWISE DIRECTION BY 30° FROM THE HORIZONTAL POSITION) THEREBY REPRESENTING THE THREATENING BEHAVIOR (WHEREIN LEG GEAR HOLE LOCATIONS ARE DIFFERENT IN PHASE BY 180° IN FRONT, MIDDLE, AND REAR LEGS, RESPECTIVELY)

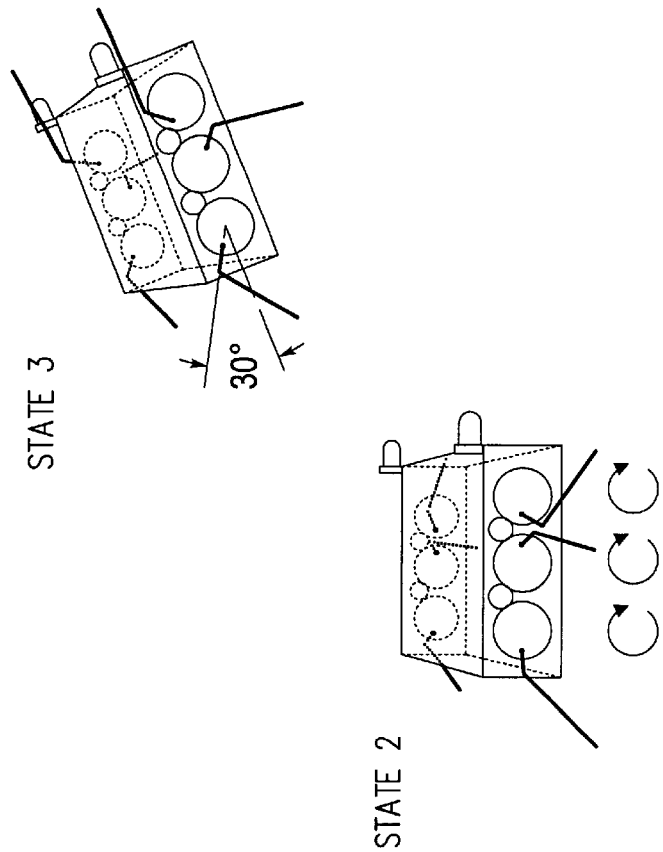

Fig. 31R

MOTION OF LEGS (TYPE OF ACTION: 12, GREETING)

MOVE THE BODY IN STATE 1 INTO STATE 3 THROUGH STATE 2 BY DRIVING THE GEARS FORWARD AND REVERSE DIRECTIONS AS DENOTED BY ARROWS AND MAINTAIN THE STATE 3 (IN WHICH THE GEAR HOLES OF THE REAR LEGS ARE AT POSITION ROTATED IN A CLOCKWISE DIRECTION BY 30° FROM THE HORIZONTAL POSITION) THEREBY REPRESENTING THE GREETING BEHAVIOR (WHEREIN LEG GEAR HOLE LOCATIONS ARE DIFFERENT IN PHASE BY 180° IN FRONT, MIDDLE, AND REAR LEGS, RESPECTIVELY)

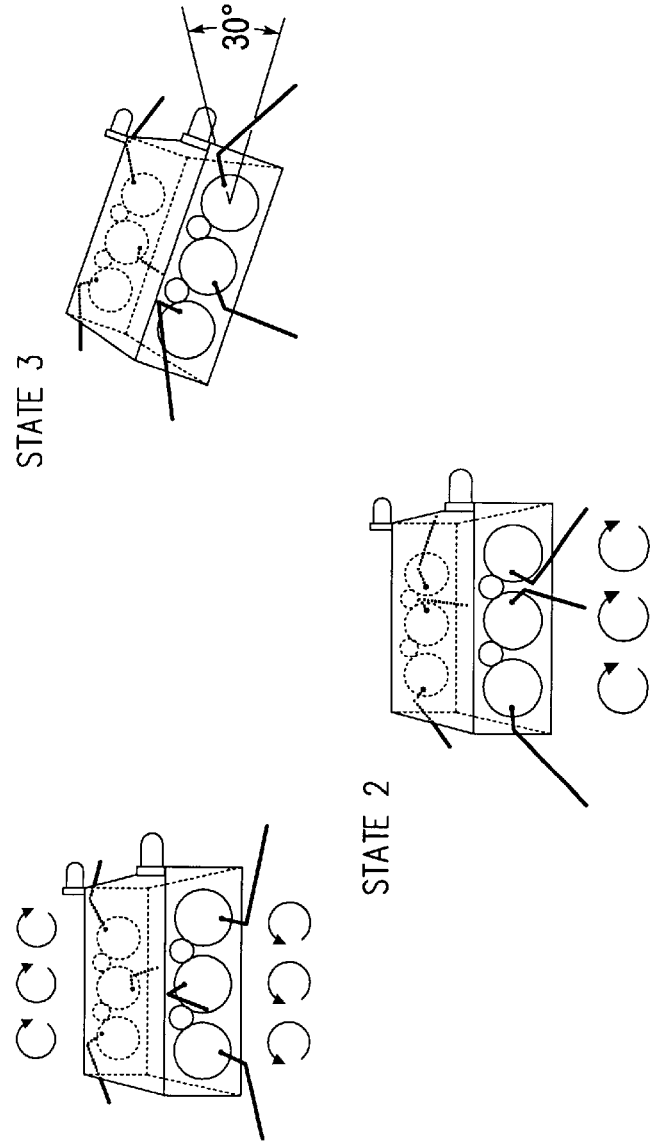

Fig. 31S

INSECT ROBOT

TECHNICAL FIELD

The present invention relates to an insect robot capable of autonomously performing an action, such as movement with six legs, in action space so as to simulate the behavior of an actual insect, and more particularly, to an insect robot improved so as to be able to move in a vivid and realistic fashion, as if it were an actually living insect, in response to an environmental state associated with lightness of the action space, an environmental state associated with an obstacle, or the like, and in response to a type of another insect robot close thereto.

BACKGROUND ART

Insect robots capable of autonomously moving with six legs in action space so as to simulate behavior of actual insects are used as popular toys. One of such insect robots is that which is disclosed in, for example, Japanese Unexamined Patent Application Publication No. 8-57159 and which is publicly known as "Six-Leg Kabterius" available from Bandai Co., Ltd.

Toy robots are also popular which start to behave or change behavior in response to an environmental state in action space. One of such toy robots is that which is disclosed in, for example, Japanese Unexamined Patent Application Publication No. 5-33786 and which is publicly known as "Flower Rock" available from Takara Co., Ltd.

Furthermore, toy robots are also publicly known which identify another robot in action space and change its behavior depending on the result of identification. One of such toy robots is that which is disclosed in, for example, Japanese Unexamined Patent Application Publication No. 9-7553 and which is publicly known as "Furby" available from Tomy Co., Ltd.

In the conventional toy robots, a microcomputer disposed in a robot performs a sequence of programs during which environmental state information of action space or identification information of another robot is detected by sensors and input into the microcomputer as the input information whereby a type of motion of the robot as a whole is switched into another type of motion thereof as a whole by means of processing the input information through the total performance of a sequence of programs, and thus, the number of types of switchable motion as a whole is very limited. Thus, the manner of switching over the action patterns is too simple to simulate behavior of an actual insect which performs various combinations of a large number of action patterns in response to an environmental state or in response to detection of another insect, and thus it is difficult to express vivid and realistic behavior of an insect. If it is tried to improve the manner of switching over the action patterns such that many types of action patterns become available, the result is an increase in the complexity of a sequence of computer programs. Thus, it is an object of the present invention according to claims 1 to 8 to solve such a problem.

Furthermore, in the conventional technique, in response to information representing an environmental state detected by various types of sensors or in response to detection of another robot, the motion of the robot as a whole is sequentially switched over in accordance with a substantially fixed algorithm prepared for the specific robot, and thus the character of the insect robot defined by the correspondence between the behavior of the insect robot and the environmental state or the identification information of the insect robot is, at least at the level of the individual insect robots, prefixed in accordance with a predetermined algorithm. Thus, it is difficult to change the character of the insect robot from time to time so as to reflect the will of a user. This makes the insect robot less attractive as a hobby toy because of the lack of a sense of game. Thus, it is another object of the present invention according to claims 9 to 16 to solve such a problem.

DISCLOSURE OF INVENTION

The problem of the conventional toy robots, resulting from the simple behavior pattern depending on the environmental state or detection of another insect robot is solved by, in aspects of the invention according to claims 1 to 5, selecting one action unit from a plurality of action units depending on the environmental state; in aspects of the invention according to claims 6 to 7, selecting one inter-robot action unit from a plurality of inter-robot action units in accordance with identification information associated with another insect robot; in an aspect of the invention according to claim 8, selecting a "coward"-type action unit or a "reckless"-type action unit in accordance with the selection priority assigned to the action units or the inter-robot action units, thereby, without recourse to sophisticated and large-scale computer programs, achieving various combinations of a large number of behavior patterns depending on the environmental state and/or in response to detection of another insect robot, and thus providing an insect robot capable of behaving in a vivid and realistic manner.

Furthermore, the problem of the conventional insect robots in terms of being not attractive enough as a hobby toy caused by the lack of a sense of game due to the fixed character of the insect robot is solved by, in aspects of the present invention according to claims 9 to 12, arbitrarily setting, by a user, an instruction unit arrangement including combinations of one sensor identifying unit and one or more action units so as to sequentially select correspondences between the action unit and the sensor identifying unit depending on the external state; in an aspect of the present invention according to claim 13, determining a sensor identifying unit in accordance with an other's pheromone signal of another insect robot, a notification pheromone signal, or a space pheromone signal; in an aspect of the present invention according to claim 14, arbitrarily selecting, by the user, a special command "switch to another panel" provided in an action unit thereby switching the execution from an instruction unit of the present panel to an instruction unit of another panel; in an aspect of the present invention according to claim 15, arbitrarily setting, by the user, a "sensor identifying unit "trigger after elapse of a particular period of time" such that the sensor identifying unit is determined in response to a trigger signal generated at specified "particular intervals"; in the aspect of the invention according to claim 16, transferring an instruction unit set by the user using the instruction unit setting means on a mobile computer to the instruction unit storage means in the insect robot; thereby making it possible to change the character of the insect robot from time to time in accordance with the will of the user, and thus the insect robot becomes very attractive As a hobby toy.

In the aspects of the present invention according to claims 1 to 5, as shown in a claim-correspondence diagram of FIG. 32A, an environmental state detection means A detects an obstacle in the action space and outputs an obstacle state signal as the environmental state signal and also detects lightness in the action space and outputs a lightness state signal as the environmental state signal; a plurality of action unit means B respectively define one of "forward movement", "backward movement", "right turn", "left turn", and "stop" as a type of actions of the insect robot and also define the duration and the execution speed of the defined action; an action unit selection means C selects one of the plurality of action unit means B in accordance with the selection priority preassigned to the respective action unit means B; an action unit execution means D drives motors serving as actuators 13 and 14, respectively, in each of driving modes, "forward rotation", "reverse rotation", and "stop", preassigned to each type of actions "forward movement", "backward movement", "right turn", "left turn", and "stop" with a duty ratio corresponding to the execution speed of an action being executed for the duration of the action; and leg means 8 and 9 are moved by actuators 13 and 14 driven by the action unit execution means D so that the insect robot performs the action for the duration of the action.

In the aspects of the present invention according to claims 6 and 7, as shown in a claim-correspondence diagram of FIG. 32A, a pheromone signal transmitting means E transmits, into the action space as a transmission pheromone signal, a pheromone signal representing identification information uniquely preassigned to the insect robot; a pheromone signal receiving means F receives a pheromone signal transmitted from a pheromone signal transmitting means E of another insect robot present in the action space as a reception pheromone signal, the pheromone signal representing identification information uniquely preassigned to said another insect robot; an inter-robot behavioral relationship identifying means G identifies an inter-robot behavioral relationship predefined between the insect robot itself and said another insect robot, on the basis of the identification information associated with another insect robot represented by the received pheromone signal and the identification information associated with the insect robot itself; a plurality of inter-robot action unit means H respectively define one of "forward movement", "threat", "greeting", and "escape" as a type of the inter-robot action of the insect robot itself and also define the duration and execution speed of the defined inter-robot action; an inter-robot action unit selection means I selects one inter-robot action unit means H from the plurality of inter-robot action unit means H in accordance with the inter-robot behavioral relationship identified by the inter-robot behavioral relationship identifying means G; an inter-robot action unit execution means J drives the actuators 13 and 14 so as to execute the inter-robot action defined by an inter-robot action unit H selected by the inter-robot action unit selection means I for the duration of the inter-robot action; and leg means 8 and 9 are moved by actuators 13 and 14 driven by the inter-robot action unit execution means J so that the insect robot performs the inter-robot action for the duration of the inter-robot action.

In the aspect of the present invention according to claim 8, as shown in a claim-correspondence diagram of FIG. 32A, the action unit selection means C set so as to serve as the "coward"-type action unit selection means selects one action unit means B or one inter-robot action unit means H from the plurality of action unit means B or the plurality of inter-robot action unit means H in accordance with the selection priorities predefined for the "coward" type with respect to the respective action unit means B and the respective inter-robot action unit means H, and the action unit selection means C set so as to serve as the "reckless"-type action unit selection means selects one action unit means B or one inter-robot action unit means H from the plurality of action unit means B or the plurality of inter-robot action unit means H in accordance with the selection priorities predefined for the "reckless" type with respect to the respective action unit means B and the respective inter-robot action unit means H.

In the aspects of the present invention according to claims 9 to 12, as shown in a claim-correspondence diagram of FIG. 32B, an external state detection means AA outputs, as an external state signal, an obstacle state signal generated in response to detection of an obstacle in the action space, a lightness state signal generated on the basis of detected lightness of the action space, a contact-with-obstacle state signal generated in response to detection of contact with an obstacle present in the action space, and a constraint state signal in response to detecting that the insect robot is in a constraint state in the action space; a sensor identification unit determining means K determines a sensor identifying unit in accordance with the external state signal; and an instruction unit setting means L sets one or more instruction units which are designed for connecting at least one or more sensor identifying units to one or more action units defining a type of each action and the duration. In particular, in the aspect of the invention according to claim 12, the instruction unit setting means L sets an instruction unit such that an action unit in the instruction unit presently set is designed for defining the permission/prohibition of interruption of a current action unit in the instruction unit to execute another action unit; an instruction unit storage means M stores one or more instruction units set by the instruction unit setting means L so that one or more instruction units are individually readable; an action unit sequentially selecting means N sequentially selects one or more action units connected to one sensor identifying unit, in reference to one instruction unit further including the sensor identifying unit determined by the sensor identification unit determining means K. In particular, in the aspect of the invention according to claim 11, a preferential action unit selection means o preferentially selecting an action unit in the midst of the execution of an action unit in an instruction unit, so that if an action unit in another instruction unit including another sensor identifying unit determined by the sensor identification unit determining means K has a higher preassigned selection priority than that of the action unit being currently executed, the action unit in said another instruction is preferentially selected instead of the action unit being currently executed. In the aspect of the invention according to claim 12, the preferential action unit selection means O preferentially selects an action unit so that, when the above conditions are satisfied, if and only if the interrupt of a current action unit to execute another action unit is permitted, an action unit in another instruction unit is preferentially selected instead of the current action unit; the action unit execution means D drives an actuator so that an action defined by an action unit selected by the action unit sequentially selecting means N is executed for a duration assigned to the action; and the leg means 8 and 9 are moved by the actuators 13 and 14 driven by the action unit execution means D so that the insect robot performs the above action for the duration assigned to the action.

In the aspect of the present invention according to claim 13, as shown in a claim-correspondence diagram of FIG. 32B, the pheromone signal transmitting means E transmits, as a transmission pheromone signal, a self pheromone signal representing self identification information uniquely preassigned to the insect robot itself in the action space or a notification pheromone signal representing notification information indicating a type of an action unit that can be set by the instruction unit setting means L; the pheromone signal receiving means F receives, as a reception pheromone signal, an other's pheromone signal representing the other's identification information uniquely preassigned to another insect robot, from the pheromone signal transmitting means E of said another insect robot present in the action space, a notification pheromone signal representing notification information indicating a type of a given action unit, or a space pheromone signal present in the action space; and the sensor identification unit determining means K determines sensor identifying units "presence of another insect robot of a particular type" and "pheromone signal reception" in accordance with the reception pheromone signal. In the aspect of the present invention according to claim 14, as shown in a claim-correspondence diagram of FIG. 32B, the instruction unit setting means L includes, as a type of an action in an instruction unit to be set, a special command "switch to another panel" to switch the execution from one or more instruction units constituting a panel to one or more instruction units constituting another panel; the instruction unit storage means M stores panels each including one or more instruction units in accordance with a panel designation signal such that any of the panels is individually readable; the action unit sequentially selecting means N selects the special command "switch to another panel" included in one or more action units connected to the one sensor identifying unit; and, when the special command "switch to another panel" is selected by the action unit sequentially selecting means N, panel designation signal generating means R generates a panel designation signal in accordance with the designation of another panel by the command.

In the aspect of the present invention according to claim 15, as shown in a claim-correspondence diagram of FIG. 32B, the instruction unit setting means L includes, as one type of action to be set in an instruction unit, a sensor identifying unit "trigger after elapse of a particular period of time" for outputting a trigger signal when a predetermined trigger period has elapsed; the instruction unit storage means M stores the instruction unit including the sensor identifying unit "trigger after elapse of a particular period of time" such that the instruction unit is individually and sequentially readable; a trigger signal generating means Q counts a lapse of a particular period of time defined by the sensor identifying unit "trigger after elapse of a particular period of time" read from the instruction unit storage means M and generates a trigger signal when the particular period of time has elapsed; and the sensor identification unit determining means K determines the sensor identifying unit "trigger after elapse of a particular period of time" in accordance with the trigger signal.

In the aspect of the present invention according to claim 16, as shown in a claim-correspondence diagram of FIG. 32B, the instruction unit setting means L is implemented on a mobile computer disposed separately from the insect robot; and the instruction unit storage means M stores one or more instruction units set by the instruction unit setting means L and transmitted via a instruction unit transmitting means P such that said one or more instruction units are individually and sequentially readable.

BRIEF DESCRIPTION OF THE DRAWINGS

FIGS. 1A to 32B are concerned with the present invention, and more particularly, FIG. 1A is an external plan view;

FIG. 2 is a block diagram of electric hardware;

FIG. 3 is a table representing logical values for various driving modes;

FIG. 4 is a flow chart of a main routine;

FIG. 5 is a diagram showing bit configurations of transmission pheromone signals;

FIG. 7 is a table showing correspondence between input parameters and output parameters for each action program unit;

FIG. 9 is a table showing correspondence between input parameters and output parameters for each action program unit;

FIGS. 10A, 10B, and 10C are diagrams showing correspondence between actions and motor control operations;

FIG. 11 is a flow chart of a pheromone signal reception process;

FIG. 12 is a diagram showing inter-robot behavioral relationships;

FIG. 13 is a flow chart of an input parameter setting process;

FIG. 14 is a diagram showing a screen of instruction unit setting means L;

FIG. 16 is a diagram illustrating a storage area of instruction unit storage means M;

FIG. 17 is a diagram illustrating panels;

FIG. 18 is a table showing a condition of input parameters corresponding to each type of sensor identifying unit;

FIG. 19 is a table showing configurations of action units;

FIG. 20 is a flow chart of a main routine;

FIG. 21 is a flow chart of a pheromone signal reception process;

FIG. 22 is a diagram showing bit configurations of transmission pheromone signals;

FIG. 26 is a flow chart of a process of counting the duration, the number of walking steps, and the number of times an action is performed;

FIG. 27 is a flow chart of a management routine;

FIG. 28 is a block diagram of electric hardware;

FIG. 29 is a diagram showing a manner of downloading;

FIG. 30 is a block diagram of a program transfer unit;

FIGS. 31A, 31B, 31C, 31D, 31E, 31F, 31G and 31H are diagrams showing correspondence between actions and motor control operations;

FIG. 31I is a diagram showing leg motions in the "forward movement" shown in FIG. 31A;

FIG. 31J is a diagram showing leg motions in the "backward movement" shown in FIG. 31A;

FIG. 31L is a diagram showing leg motions in the "left turn" shown in FIG. 31B;

FIG. 31O is a diagram showing leg motions in the "gradual right turn in the backward direction" shown in FIG. 31C;

FIG. 31P is a diagram showing leg motions in the "gradual left turn in the backward direction" shown in FIG. 31D;

FIG. 31Q is a diagram showing leg motions in the "struggle" shown in FIG. 31D;

FIG. 31R is a diagram showing leg motions in the "threat" shown in FIG. 31E;

FIG. 31S is a diagram showing leg motions in the "greeting" shown in FIG. 31E; and FIGS. 32A and 32B are block diagrams (claim-correspondence diagrams) showing functions of software.

BEST MODE FOR CARRYING OUT THE INVENTION

Figure 1A:
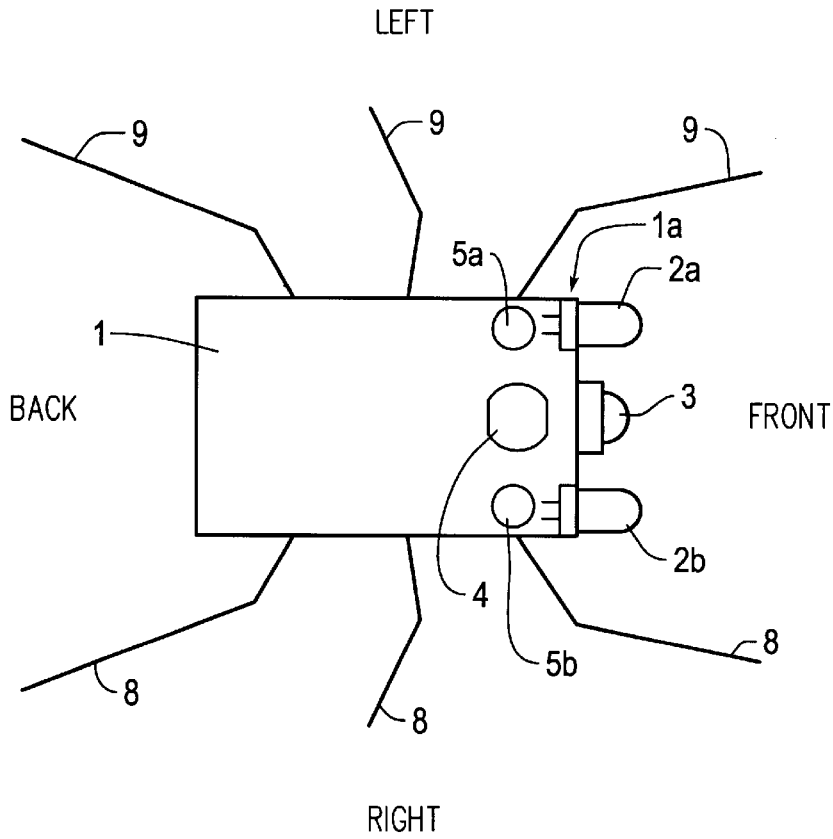
Figure 1B:
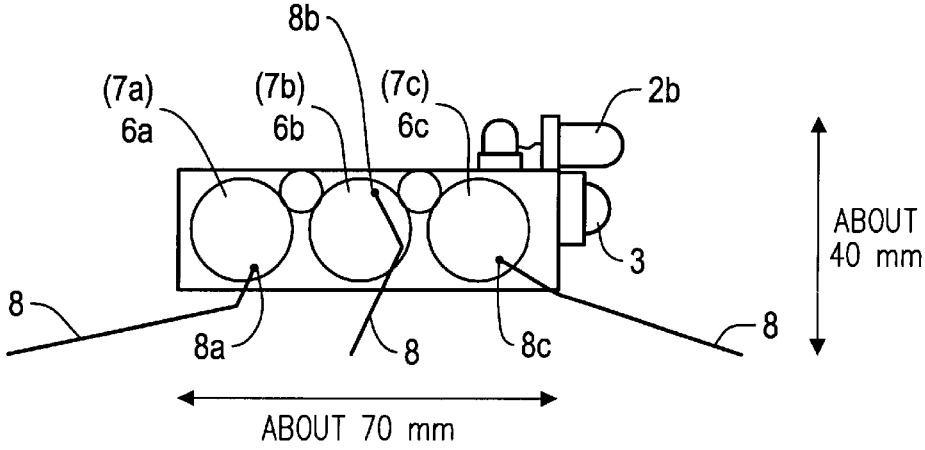
FIG. 1B is an external side view.

Referring to FIGS. 1 to 10, embodiments of the present invention according to claims 1 to 8 are described below. FIG. 1A is a plan view of an embodiment of a insect robot according to the present invention, and FIG. 1B is a side view thereof. On a head 1*a* located at an end, on the right side of FIG. 1, of an insect-like casing 1, there is disposed a pair of forward facing light emitting diodes 2*a* and 2*b* serving as a pheromone signal transmitting means E and also as a transmitting part of environmental state detection means A for detecting an obstacle. On the front side of the head 1*a*, there is disposed a forward facing phototransistor 3 serving as a pheromone signal receiving means F and also as a receiving part of the environmental state detection means A for detecting an obstacle. On the upper side of the head 1*a*, an upward facing photosensitive device 4 such as a cadmium sulfide cell serving as the environmental state detection means A for detecting lightness is disposed at the center. Furthermore, on the upper side of the head 1*a*, a pair of light emitting diodes 5*a* and 5*b* for decorative illuminations are disposed on the left and right sides of the photosensitive device 4. Six leg driving wheels 6*a*, 6*b*, 6*c*, 7*a*, 7*b*, and 7*c* are rotatably disposed on the insect-like casing 1, wherein three leg driving wheels are disposed on one side face of the both sides of insect-like casing 1 and the remaining three leg driving wheels are disposed on the opposite side face, and they are linked with each other so that they rotate at the same speed. The leg driving wheels are described in further detail below, taking a set of three leg driving wheels 6*a*, 6*b*, 6*c* on one side as an example. Three wire-like leg bones 8 are connected with the respective three leg driving wheels 6*a*, 6*b*, and 6*c* such that the base portions 8*a*, 8*b*, and 8*c* thereof are planted at different phase angles on the circumferences of the respective leg driving wheels 6*a*, 6*b*, and 6*c* and such that the leg bones 8 extend outward to the right (downward in FIG. 1A) with respect to the forward direction of the insect robot and each leg bone is bent in the middle thereof, thereby constructing a leg means 8 on one side. A leg means 9 on the opposite side is constructed in the exactly same manner with three wire-like leg bones 9. Although three leg bones on each side move together at the same speed, the leg means 8 on one side and the leg means 9 on the opposite side can move independently of each other. Furthermore, if the base portions 8*a*, 8*b*, 8*c*, 9*a*, 9*b*, and 9*c* of the respective leg bones 8 and 9 bent in the middle thereof are planted on the circumferences of the corresponding leg driving wheels such that the phase angles become different between each pair of a leg bone 8 on one side and a leg bone 9 on the opposite side, when the base portions of the respective leg bones are rotated with different phases in synchronization with the rotation of the leg driving wheels 6*a*, 6*b*, 6*c*, 7*a*, 7*b*, and 7*c* on the respective sides, the walking action of the actually living insect is well simulated by the movement of the leg means 8 and 9 as a whole.

Figure 2:
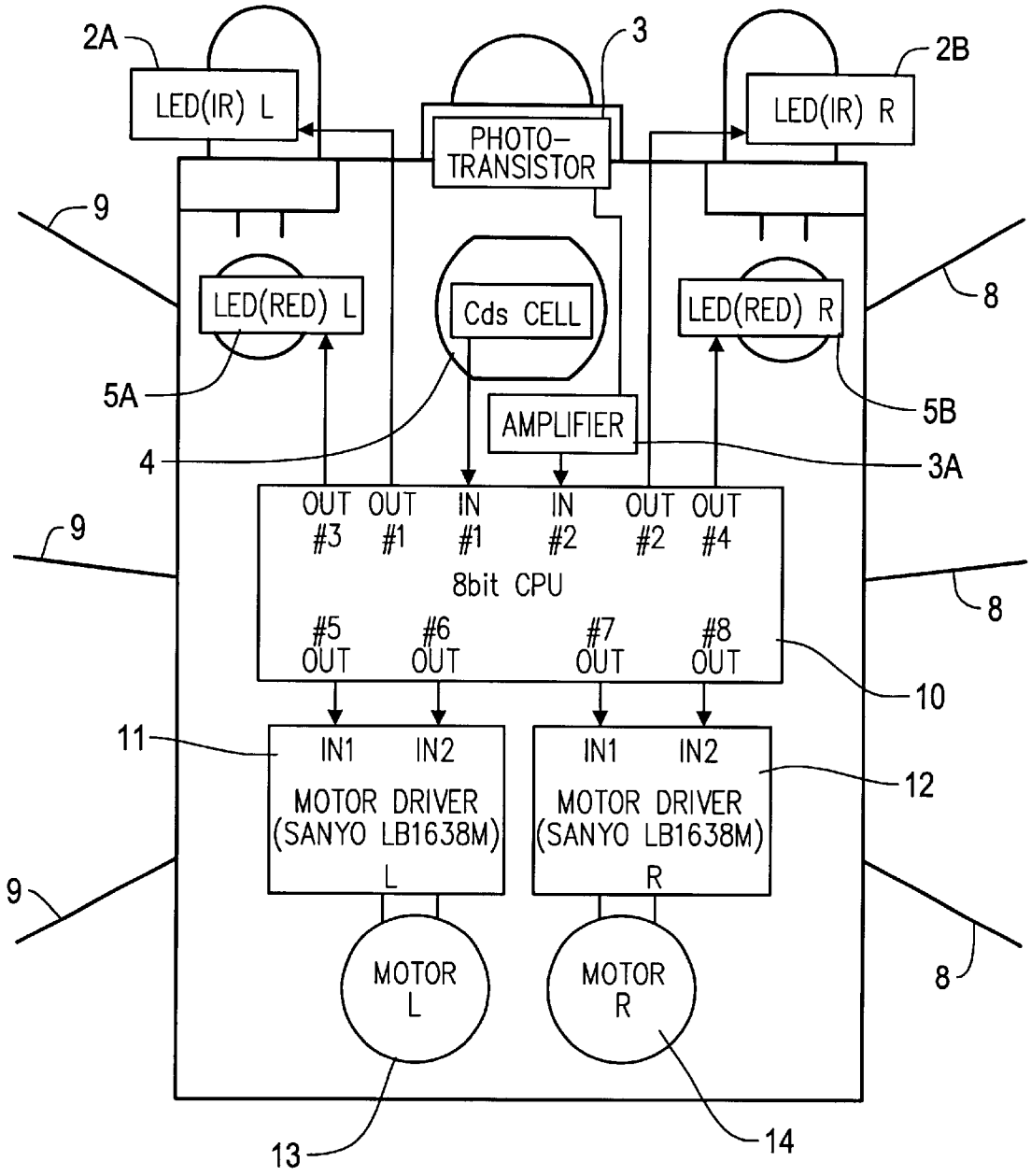

Referring to FIG. 2 showing the construction of electric hardware, an input port IN-#2 of a microcomputer 10 is connected to the phototransistor 3 via an driver amplifier 3*a* integrated with a detection circuit, and an input port IN-#1 is connected to the cadmium sulfide cell 4 embedded in the detection circuit. Furthermore, an output port OUT-#1 of the microcomputer 10 is connected to the left-side light emitting diode 2*a* embedded in a driver circuit, and an output port OUT-#2 is connected to the right-side light emitting diode 2*b* embedded in a driver circuit. Output ports OUT-#3 and OUT-#4 are respectively connected to left and right light emitting diodes 5*a* and 5*b* for decorative illuminations each embedded in its own driver circuit. Furthermore, a pair of output ports OUT-#5 and OUT-#6 are connected to a pair of input terminals IN1 and IN2 of a commercially available motor driver unit 11 (such as LB1638M available from Sanyo Electric Co., Ltd.) and a pair of output ports OUT-#7 and OUT-#8 are connected to a pair of input terminals IN1 and IN2 of another similar motor driver unit 12. Each of the motor driver units 11 and 12 is connected to a motor such that the supply of electric power to the motor is controlled by the driver unit. More specifically, a left-side motor 13 serving as an actuator for driving the left-side leg wheels 7*a*, 7*b*, and 7*c* is connected to the motor driver unit 11, and a right-side motor 14 serving as an actuator for driving the right-side leg wheels 6*a*, 6*b*, and 6*c* is connected to the motor driver unit 12. If a parallel 2-bit code each bit of which has a logical value of "1" (referred to as HI) or "0" (referred to as LOW) is supplied from the microcomputer to the motor driver unit 11 or 12 via the pair of input terminals IN1 and IN2, the motor driver unit drives the corresponding motor in each driving mode of "forward", "reverse", or "stop" depending on the 2-bit logical values of the received code. FIG. 3 shows correspondence between the driving modes and the logical values applied to each of the input terminals IN1 and IN2. Herein, in the control of the motors by the motor driver units 11 and 12, the driving mode of "stop" is periodically employed so as to control the real-time rate of the driving mode thereby controlling the duty ratio of the supply of electric power to the motors and thus controlling the rotation speed of the motors.

The flow of a program executed by the microcomputer 10 included in the above-described hardware configuration is described below.

Figure 4:
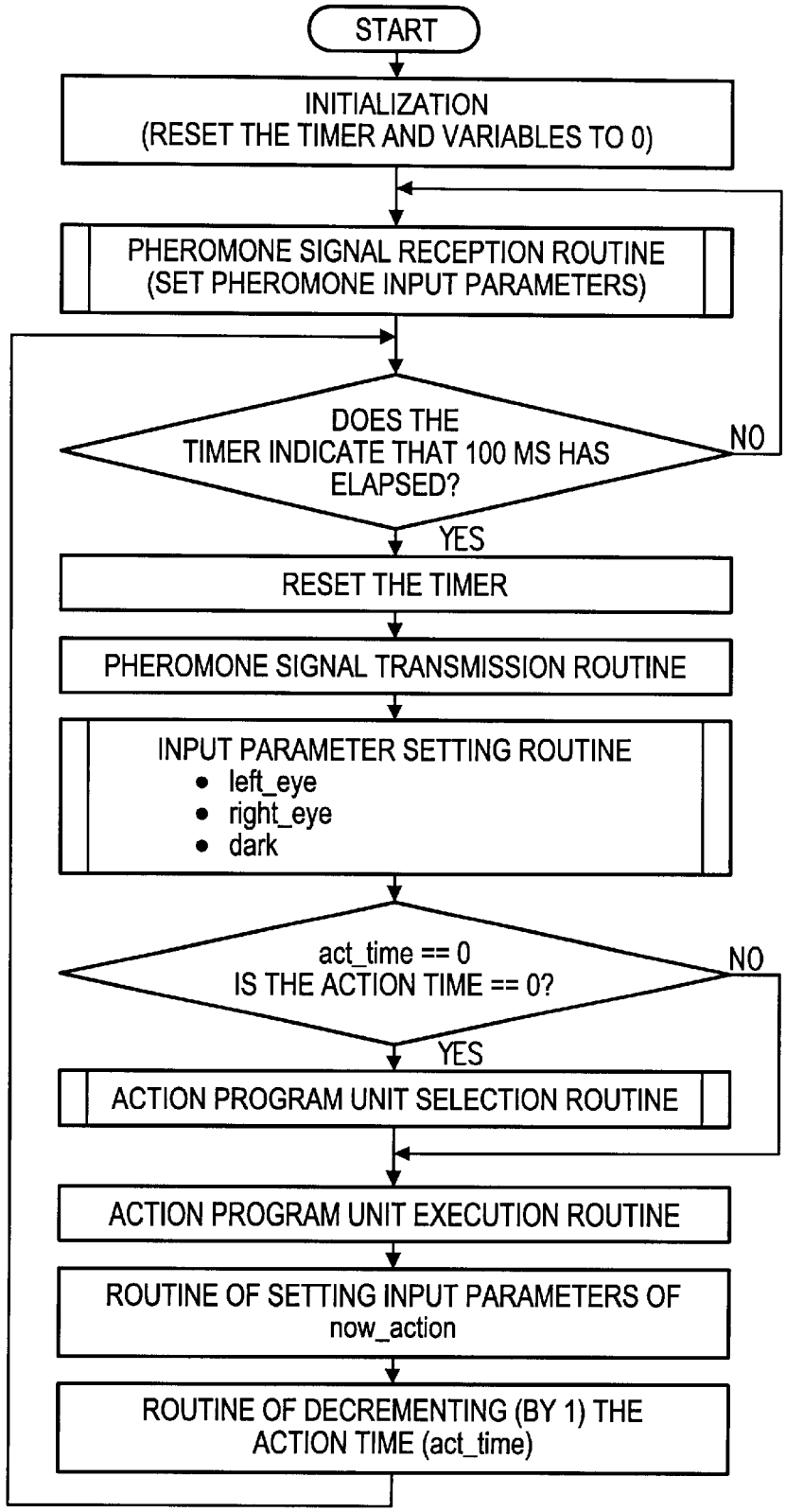
Figure 5:
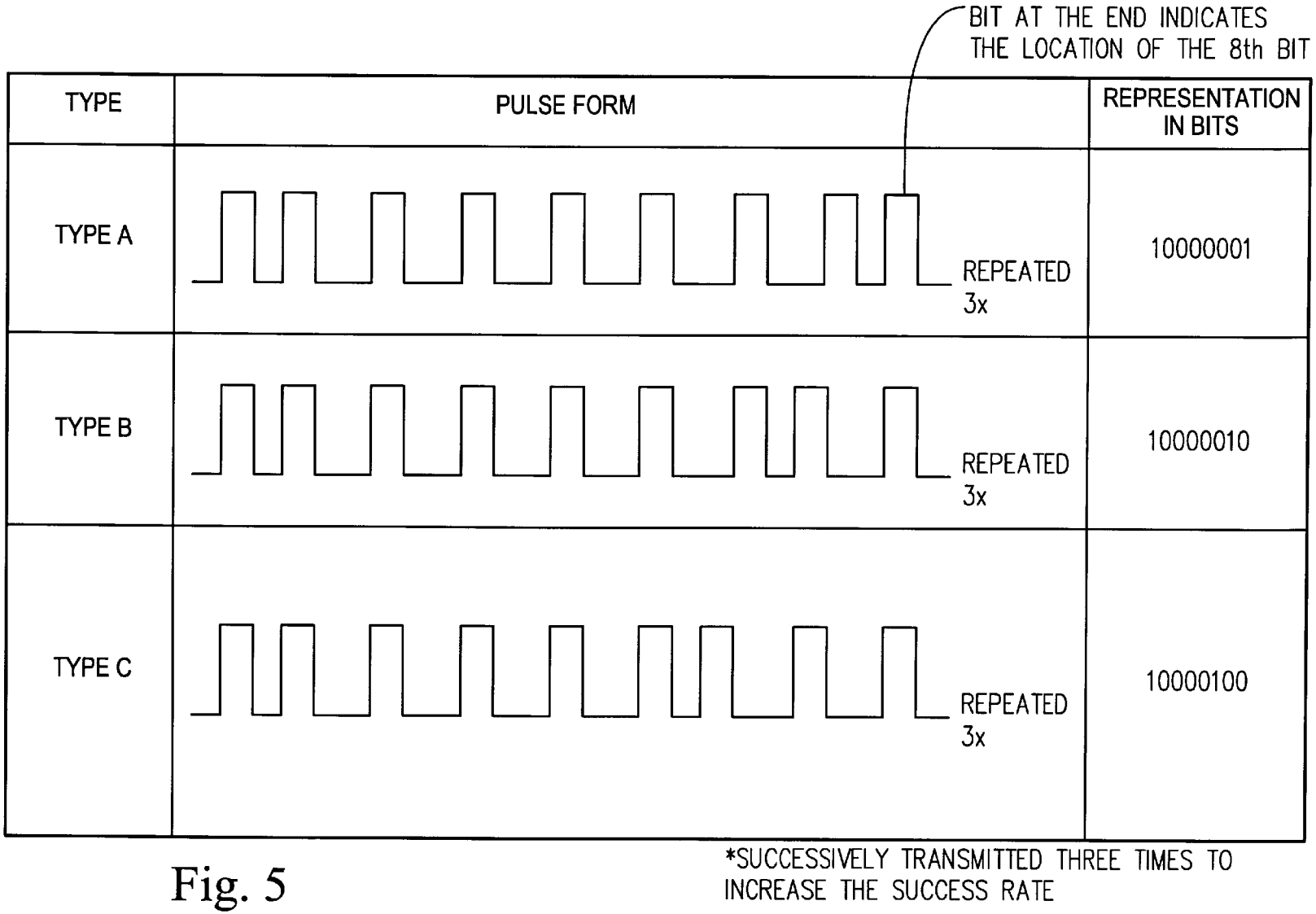

Referring to a main flow chart shown in FIG. 4, when the program is started (a in FIG. 4), the microcomputer 10 initializes internal registers associated with a timer and other counter variables by resetting them into initial values (b in FIG. 4). The flow then jumps to a pheromone signal reception subroutine (c in FIG. 4), which will be described in detail later, and establishes the pheromone signal receiving means F and the inter-robot behavioral relationship identifying means G. In this subroutine, on the basis of the reception pheromone signal, the input parameter of "pheromone" is set to "weak type", the strong type", or "same type" as the inter-robot behavioral relationship relatively defined in accordance with the self identification information of an insect robot and other's identification information of another insect robot. After completion of setting the input parameter of "pheromone", the flow returns to the main routine. Then, the microcomputer 10 checks an internal timer realized by software to decide whether a time equal to an operation reference period of 100 ms has elapsed (d in FIG. 4). If the elapsed time is shorter than the reference operation time and thus if the decision is No (d in FIG. 4), the pheromone signal reception subroutine is further continued. If the elapsed time has reached the reference operation time and thus if the decision becomes Yes (d in FIG. 4), the flow proceeds to a next step. Thus, the following steps are performed intermittently every operation reference time of 100 ms. When the elapsed time has reached the operation reference time, the microcomputer 10 resets the timer (e in FIG. 4) and then executes a pheromone signal transmission routine and establishes the pheromone signal transmitting means E (f in FIG. 4). In this pheromone signal transmission routine, the microcomputer 10 generates a transmission pheromone signal representing the self identification information uniquely preassigned to the insect robot itself, using an 8-bit identification code wherein each bit (each character) of the identification code is represented by 3 pulses each having a width of 100 $\mu$s. The generated transmission pheromone signal is output three times, that is, a code string consisting of 8 bits×3=24 bits as shown in FIG. 5 is output from the pair of output ports OUT-#1 and OUT-#2 to both the left-side light emitting diode 2*a* and the right-side light emitting diode 2*b*. In response, the light emitting diodes 2*a* and 2*b* are turned on and off. In the specific example shown in FIG. 5, the self identification information of the insect robot indicates the type thereof, that is, indicates whether the insect robot is of type A, B, or C. of course, other identification information such as a name uniquely identifying the insect robot may also be employed. Referring again to FIG. 4, the microcomputer 10 then jumps the flow to an input parameter setting subroutine (g in FIG. 4), which will be described in detail later. In this subroutine, the environmental state detection means A is established, and the left-side light emitting diode 2*a* and the right-side light emitting diode 2*b* each illuminate an obstacle present in the action space, and a light ray reflected from the obstacle is sensed, as the environmental state signal associated with the obstacle, by the phototransistor 3. In accordance with detection of reflected light originating from the left-side light emitting diode 2*a*, the input parameter of "left eye" is set so as to indicate whether there is an obstacle in the left field of view with respect to the forward direction of the insect robot. On the other hand, in accordance with detection of reflected light originating from the right-side light emitting diode 2*b*, the input parameter of "right eye" is set so as to indicate whether there is an obstacle in the right field of view. Furthermore, the external light in the action space is sensed as the environmental state signal associated with lightness (darkness) by a cadmium sulfide cell 4, and the input parameter of "dark" representing the lightness (darkness) of the action space is set in accordance with the sensed environmental state signal. After setting the input parameter of "dark", the flow returns to the main routine to decide whether the output parameter of "action time", indicating the duration of an action unit which is predetermined to characterize the action unit defied by an action program unit being executed (h in FIG. 4), has decreased to 0. If the duration has become 0 and thus if the decision (h in FIG. 4) is Yes, the flow jumps to an action program unit selection subroutine (i in FIG. 4), which will be described in detail later, to establish the action unit selection means C. In the action program unit selection subroutine, in accordance with a predetermined selection algorithm, an action program unit for performing an action unit is selected from a plurality of action units serving as the action unit means B that can be implemented by executing action program units, thereby establishing the action unit selection means C. After establishing the action unit selection means C, the flow returns to the main routine and jumps to an action program unit execution subroutine for the selected action program unit to establish the action unit execution means D (j in FIG. 4). An input parameter "now action" is set (k in FIG. 4) so as to indicate an action unit defined by the action program unit being executed in the action program unit execution subroutine (j in FIG. 4). Thereafter, the output parameter "action time" indicating the duration is decremented by "1" (l in FIG. 3). Then, the flow returns to the decision step denoted by d in FIG. 4 and waits therein until arrival of a next point of the operation reference points of time at intervals of 100 ms. Once an action program unit is selected (i in FIG. 4) via the above processing flow (h to l in FIG. 4), the decision in step h shown in FIG. 4 is always No until a time equal to the duration assigned to the action program has elapsed. Thus, in the duration assigned to the action program, the execution of the action program unit selected in step i shown in FIG. 3 is continued without selecting any other action program unit (i in FIG. 4). If a period of time equal to the duration assigned to the action program unit being executed has elapsed, the output parameter of "action time" falls to 0 (h in FIG. 4), and thus an action program unit is newly selected (i in FIG. 4) at a next point of the operation reference points of time at intervals of 100 ms (d in FIG. 4). The input parameter "now action" is rewritten so as to indicate the newly selected action program unit (l in FIG. 4).

In the above-described main routine, the microcomputer 10 executes the pheromone signal transmission subroutine (f in FIG. 4) and a pheromone signal reception subroutine (c in FIG. 4) in a cooperative operation so as to establish the pheromone signal transmitting means E and the pheromone signal receiving means F thereby driving the left-side light emitting diode 2*a*, the right-side light emitting diode 2*b*, and the phototransistor 3. Subsequently, the microcomputer 10 sets input parameters of "pheromone" representing "weak type", the strong type", or "same type" as the inter-robot behavioral relationship relatively defined between the insect robot itself and another insect robot in accordance with the self identification information represented by the transmission pheromone signal and another insect robot's identification information represented by the reception pheromone signal, thereby establishing the inter-robot behavioral relationship identifying means G. Furthermore, in an input parameter setting subroutine (g in FIG. 4) that will be described in detail later, the microcomputer 10 drivers the left-side light emitting diode 2*a*, the right-side light emitting diode 2*b*, the phototransistor 3, and the cadmium sulfide cell 4 so as to establish the environmental state detection means A associated with an obstacle and lightness (darkness). Subsequently, the microcomputer 10 sets the input parameter of "left eye" indicating whether there is an obstacle in the left field of view, the input parameter of "right eye" indicating whether there is an obstacle in the right field of view, and the input parameter of "dark" indicating the lightness (darkness) of the action space. Then, in the subroutine of setting the input parameter of "now action" (l in FIG. 4), the microcomputer 10 sets the input parameter of "now action" indicating an action program unit being currently executed. After setting the five input parameters of "pheromone", "left eye", "right eye", "dark", and "now action" in the above-described manner, the microcomputer 10 executes an action program unit selection subroutine (i in FIG. 4) to select, using the five selected input parameters as decision parameters, one action program unit from a plurality of action program units in accordance with a selection algorithm defined according to logical priority assigned to the action program units, thereby establishing the action unit selection means C for selecting one action unit from a plurality of action units. Referring to flow charts shown in FIGS. 6A and 6B and an input/output parameter correspondence table shown in FIG. 7, the action program unit selection subroutine (i in FIG. 4) is described below.

Figure 6A:
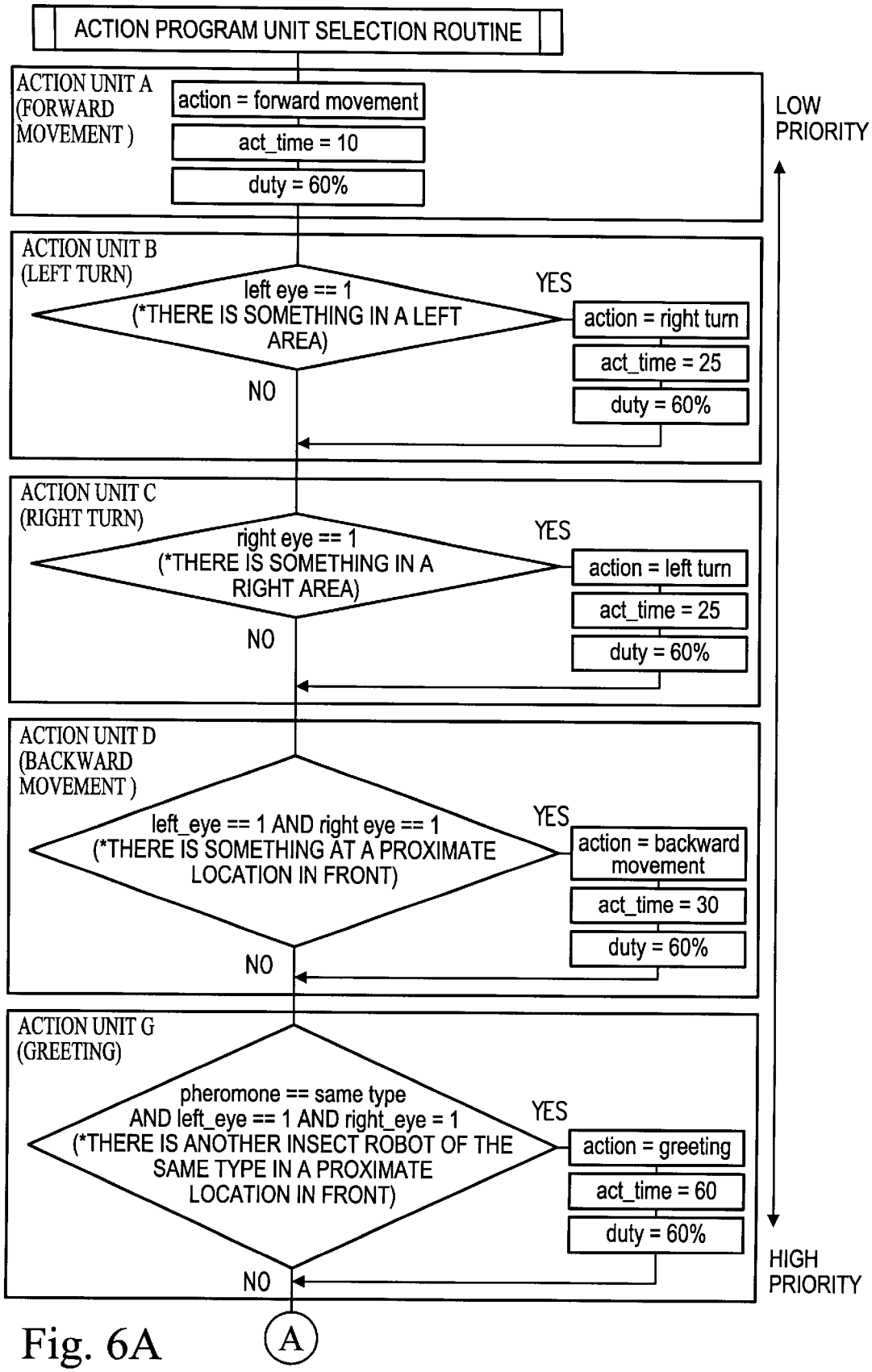
FIGS. 6A and 6B are flow charts of an action program unit selection process.
Figure 6B:
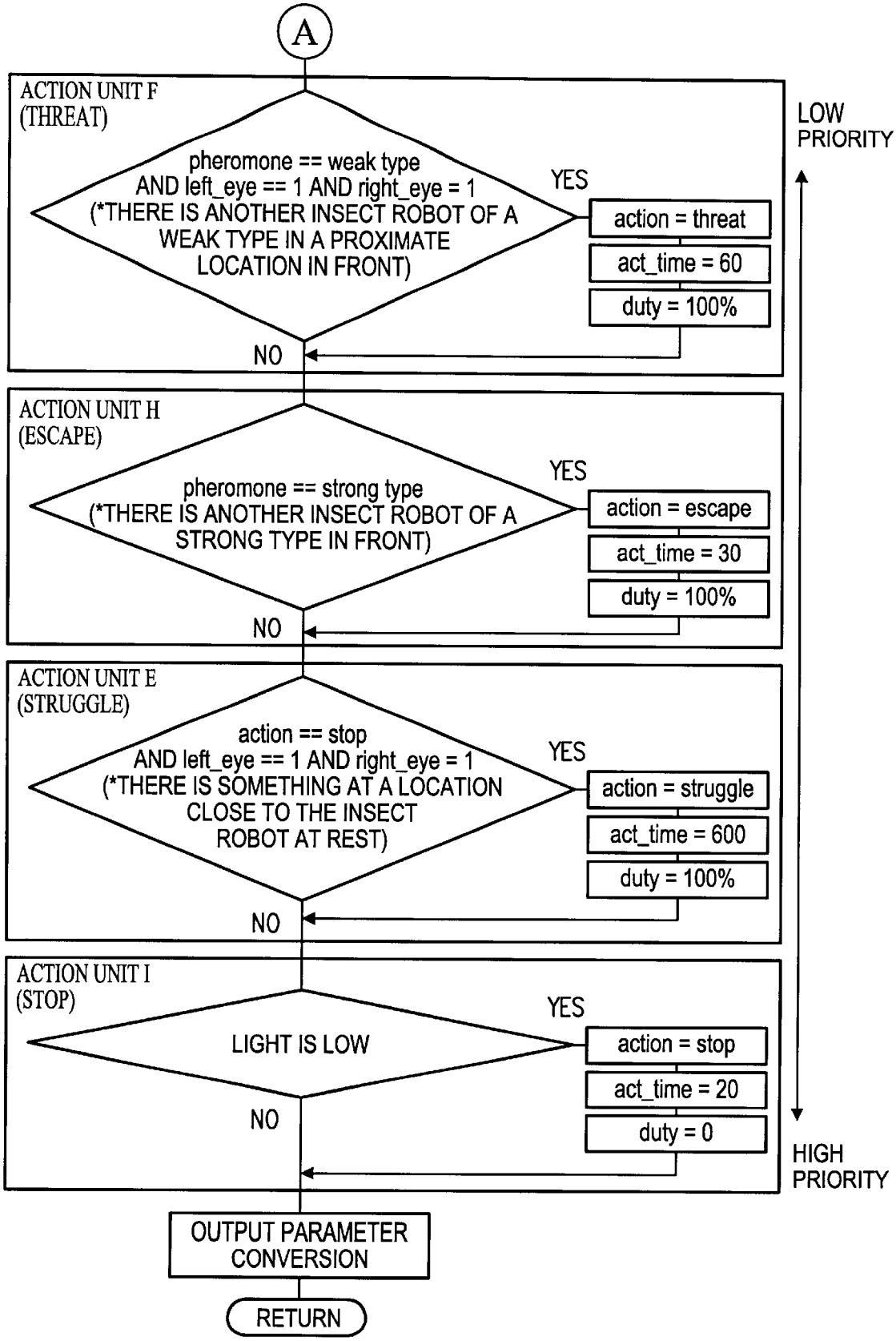
Figure 8A:
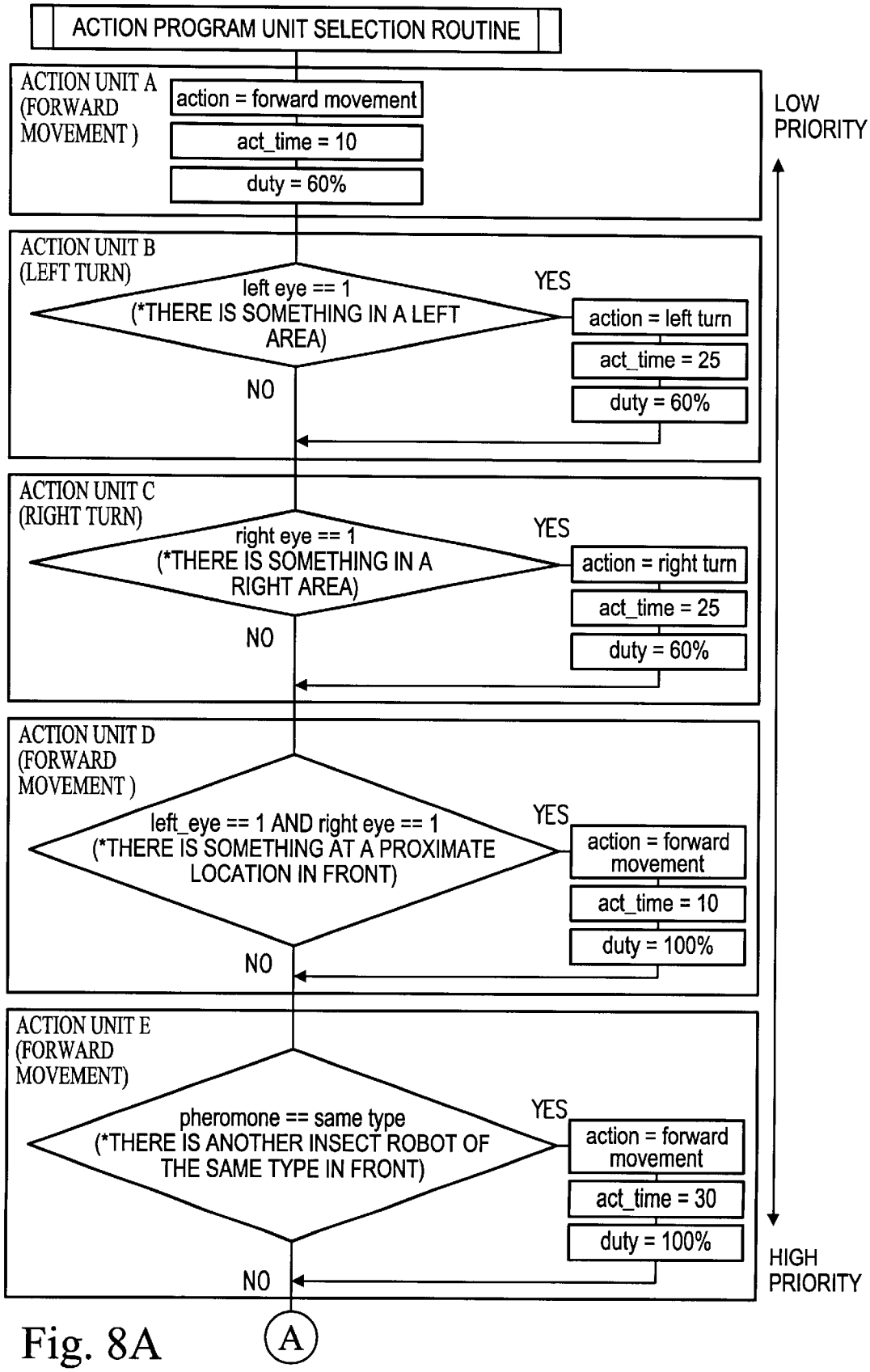
FIGS. 8A and 8B are flow charts of an action program selection process.
Figure 8B:
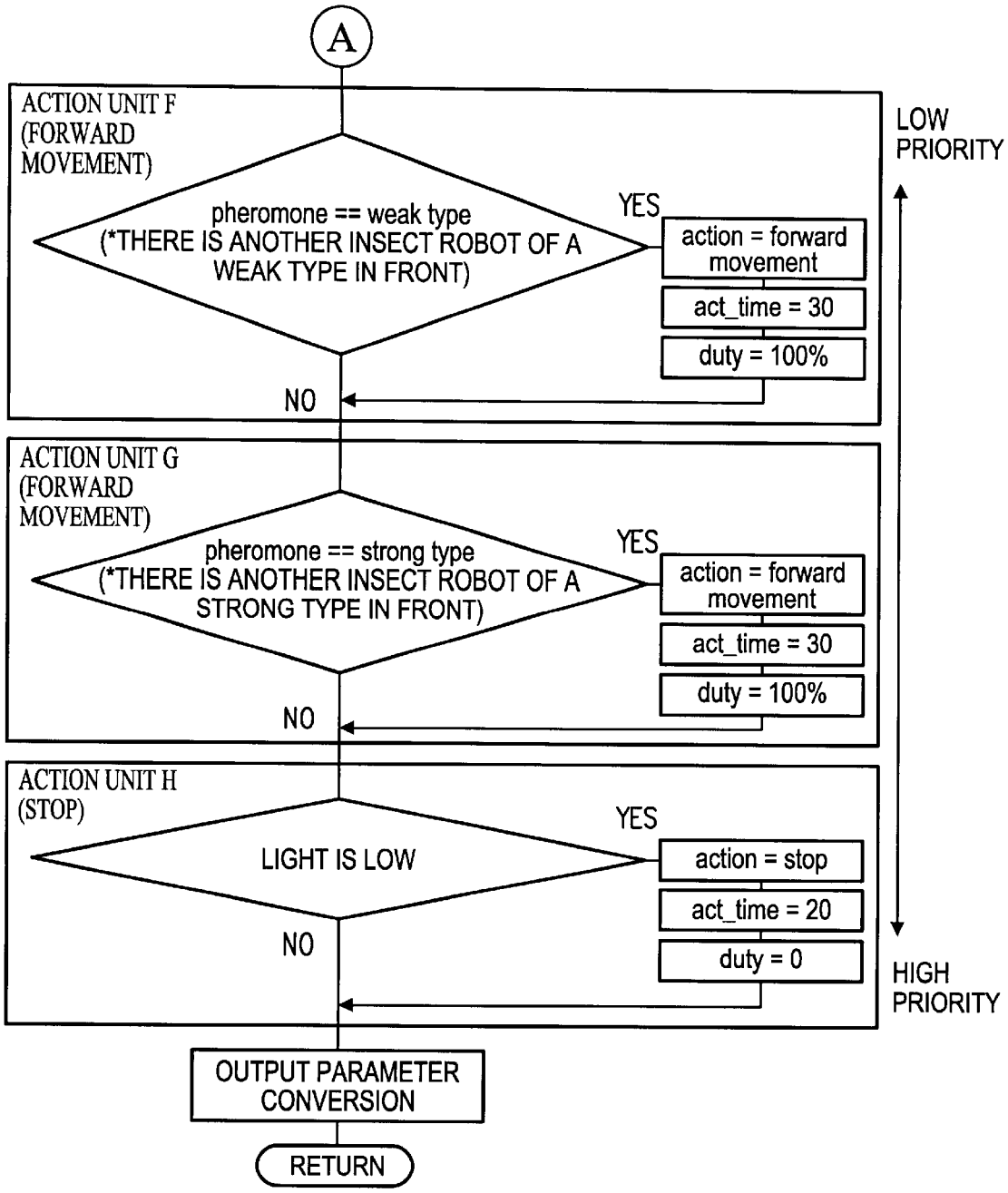

The input/output parameter correspondence table shown in FIG. 7 represents the correspondence between input and output parameters for each of the action program units A to I. More specifically, the values of the above-described five input parameters, which are used as decision parameters on the basis of which one action unit realized by a corresponding action program unit is selected by the action unit selection means C in the action program unit selection subroutine according to the flow charts shown in FIGS. 6A and 6B, are described on the left side of the table. In corresponding rows on the right side of the table, described are values of three output parameters, that is, the output parameter of "action" indicating the type of action, the output parameter of "action time" indicating the duration of the action, and the output parameter of "duty" indicating the execution rate "duty ratio" of the action. The respective output parameters characterize an action which should be realized by the action unit execution means D established via the action program unit execution subroutine (j in FIG. 4) in the main routine shown in FIG. 4.

Referring again to FIG. 6A, if the action program unit selection subroutine is started (a in FIG. 6A), the microcomputer 10 first sets, unconditionally, output parameters associated with the action unit A in accordance with the description in the row of action program unit A (forward movement) in FIG. 7 such that "forward movement" is assigned as the output parameter of "action" indicating the type of the action (b in FIG. 6A), "10" is set as the output parameter of "action time" indicating the duration of the action (so as to indicating that the action time is 10 times the operation reference period of 100 $\mu$s=1000 $\mu$s) (c in FIG. 6A), and "60%" is set as the output parameter of "duty" indicating the execution speed of the action (d in FIG. 6A). Thereafter, the microcomputer 10 checks the input parameters on the basis of the description in the row of the action program B (right turn) in FIG. 7 to decide whether the input parameter of "left eye" is "1", that is, whether there is an obstacle within the left field of view (e in FIG. 6A). If the input parameter of "left eye" is "1" and thus the decision (e in FIG. 6A) is Yes, then each output parameter is set in accordance with the description in the right hand part of the same row. However, if the input parameter of "left eye" is "0" and thus there is no obstacle in the left field of view, the decision (e in FIG. 6A) becomes No. In this case, the flow proceeds to a next decision step without setting or updating the output parameters.

If the decision for each of the five input parameters used as the decision parameters is Yes in a certain decision step (for example in e in FIG. 6A) and if the decision is No in all decision steps after that, then the output parameters that have been set in the last decision step in which the positive decision was made are left as output parameters for the selected action unit. In other words, if the decision associated with the five input parameters used as the decision parameters is No in a certain decision step (for example e in FIG. 6A), then the output parameters that have been set in the preceding steps (b, c, and d in FIG. 6A, in this specific example) are left as output parameters to be employed for the selected action unit. This means that a decision parameter that is processed at a later decision step has a greater contribution in determination of the logical priority.

Thereafter, the microcomputer 10 checks the input parameters on the basis of the description in the row of the action program unit C (left turn) in FIG. 7 to decide whether the input parameter of "right eye" is "1", that is, whether there is an obstacle in the right field of view (g in FIG. 6A). If the decision indicates that the input parameter of "right eye" is "1", each output parameter is set in a similar manner as described above in accordance with the description in the right-side part of the same row (h in FIG. 6A). However, if the decision (g in FIG. 6A) is No, the flow proceeds to a next decision step without updating the output parameters. In the next decision step, the microcomputer 10 checks the input parameters on the basis of the description in the row of the action program unit D (backward movement) in FIG. 7 to decide whether both input parameters of "left eye" and "right eye" are "1" that is, whether there is an obstacle in a proximate location in the field of view (i in FIG. 6). If the decision is Yes, then each output parameter is set in a similar manner as described earlier in accordance with the description in the right-side part of the same row (j in FIG. 6A). However, if the decision (i in FIG. 6A) is No, the flow proceeds to a next decision step without updating the output parameters. In the next decision step, to establish the inter-robot action unit selection means I, the microcomputer 10 checks the input parameters on the basis of the description in the row of the action program unit G (greeting) in FIG. 7 to decide whether the input parameter of "pheromone" is "same type" and input parameters of "left eye" and "right eye" are both "1", that is, whether there is another insect robot of the same type in a proximate location in the field of view (k in FIG. 6A). If the decision is Yes, the inter-robot action unit means H is established by setting each output parameter in a similar manner as described above in accordance with the description in the right-side part of the same row (l in FIG. 6A). However, if the decision (k in FIG. 6A) is No, the flow proceeds to a next decision step without updating the output parameters. In the next decision step, to establish the inter-robot action unit selection means I, the microcomputer 10 checks the input parameters on the basis of the description in the row of the action program unit F (threat) in FIG. 7 to decide whether the input parameter of "pheromone" is "weak type" and the input parameters of "left eye" and "right eye" are both "1", that is, whether there is another insect robot of the "weak type" in a proximate location in the field of view (m in FIG. 6B). If the decision is Yes, the inter-robot action unit means H is established by setting each output parameter in a similar manner as described above in accordance with the description in the right-side part of the same row (n in FIG. 6B). However, if the decision (m in FIG. 6B) is No, the flow proceeds to a next decision step without updating the output parameters. In the next decision step, to establish the inter-robot action unit selection means I, the microcomputer 10 checks the input parameters on the basis of the description in the row of the action program unit H (escape) in FIG. 7 to decide whether the input parameter of "pheromone" is "strong type", that is, whether there is another insect robot of the "strong type" in a proximate location in the field of view (o in FIG. 6B). If the decision is Yes, the inter-robot action unit means H is established by setting each output parameter in a similar manner as described above in accordance with the description in the right-side part of the same row (p in FIG. 6B). However, if the decision (o in FIG. 6B) is No, the flow proceeds to a next decision step without updating the output parameters. In the next decision step, the microcomputer 10 checks the input parameters on the basis of the description in the row of the action program unit E (struggle)) in FIG. 7 to decide whether the input parameter of "now action" is "1" and the output parameters of "left eye" and "right eye" are both "1", that is, whether the insect robot is in the stop state and there is an obstacle in a proximate location in the field of view (q in FIG. 6B). If the decision is Yes, each output parameter is set in a similar manner as described above in accordance with the description in the right-side part of the same row (r in FIG. 6B). However, if the decision (q in FIG. 6B) is No, the flow proceeds to a next decision step without updating the output parameters. In the next decision step, the microcomputer 10 checks the input parameters on the basis of the description in the row of the action program unit I (stop) in FIG. 7 to decide whether the input parameter of "dark" is "1", that is, whether the action space is dark (s in FIG. 6B). If the decision is Yes, each output parameter is set in a similar manner as described above in accordance with the description in the right-side part of the same row (t in FIG. 6B). However, if the decision (s in FIG. 6B) is No, the flow proceeds to a next step to perform an output parameter conversion process without updating the output parameters. In this output parameter conversion step, the output parameters to be employed for the selected action program are converted (u in FIG. 6B) so as to obtain parameters that control favorably the motor driver units 11 and 12 to drive the motors 13 and 14 serving as actuators in the following action program unit execution subroutine (j in FIG. 4). Thereafter, the flow returns to the main routine (v in FIG. 6B).

In the action program unit selection subroutine (FIGS. 6A and 6B), to generally establish the action unit selection means C, one action program unit is selected from the plurality of action programs, using the given five input parameters as the decision parameters, in accordance with the selection algorithm defined by the specified logical priority assigned to the plurality of action program units. In the present example of the selection process (FIGS. 6A and 6B), the decision parameters for the nine types of action program units A to I shown in FIG. 7 are checked in the order of units A→B→C→D→G→F→H→E→I as shown in the flow charts shown in FIGS. 6A and 6B, and thus the logical priority is given in the opposite order, that is, in the order of units I→E→H→F→G→D→C→B→A, thereby establishing the action program unit selection algorithm. The established selection algorithm determines the temporal order in which a plurality of action program units are sequentially executed, and thus determines in turn the temporal order in which action units are performed by corresponding action program units using the given three output parameters "action", "action time", and "duty". Thus, the character of the insect robot is represented by the overall temporal sequence of action units. For example, the overall temporal sequence of action units, defined by the temporal order in which action program units are sequentially executed, represents a character such as a so-called coward. If many types of action programs are prepared, it is possible to realize an insect robot so as to have a character selected from a large number of characters by determining the temporal order in which the action programs are to be sequentially executed. For example, in the selection subroutine (FIGS. 8A and 8B), if eight action program units A to H are prepared as shown in FIG. 9 and if the decision parameters for these action program units are checked in the order of A→B→C→D→E→F→G→H as shown in flow charts of FIGS. 8A and 8B, then the logical priority is given in the opposite order, that is, in the order of units H→G→F→E→D→C→B→A and thus another selection algorithm is obtained. Herein, the overall temporal sequence of action units defined by the temporal order in which action program units are sequentially executed represents, for example, a so-called "reckless" character. Note that when each character is determined by the selection algorithm, the details of the determined character further depend on a type of action and the duration thereof defined by output parameters that characterize respective action units realized by action programs.

Although in the present embodiment, the program itself of the action program unit selection subroutine (FIGS. 6A, 6B, 8A, and 8B) is embedded in the form of fixed software in each insect robot depending on the given character thereof.

It is not necessarily needed to embed the program in a fixed form when the insect robot is produced. Alternatively, the program of the action program unit selection subroutine for each character may be stored in a ROM, and the ROM may be mounted on each insect robot after completion of production or the ROM mounted may be exchanged, thereby writing or rewriting the program. The program may also be installed on each insect robot after production by transferring the program from an external device such as a personal computer in a remote location via a communication line.

Referring again to FIG. 6B, in the output parameter conversion step (u in FIG. 6B) performed at the end of the action program unit selection subroutine, in order to obtain parameters that control favorably the motor driver units 11 and 12 to drive the actuators in the action program unit execution subroutine (j in FIG. 4) so as to establish the action unit execution means D including the inter-robot action unit execution means J in the main routine after returned from the action program unit selection subroutine (v in FIG. 6B), conversion is performed on the parameter of "action", which is one of the three output parameters "action", the action time", and "duty", of the action unit defined by the selected action program unit. More specifically, as can be seen from FIGS. 10A to 10C showing the correspondence between the action and motor control operations, the types (contents) of the output parameter of "action" are classified, according to the action unit of the insect robot, into "forward movement", "right turn", "left turn", "backward movement", "struggle", "threat", "greeting", "escape", and "stop". The conversion of the output parameters is performed so as to obtain the parameters associated with the actuators by connecting the respective action units to the respective driving modes "forward rotation", "reverse rotation" , or "stop" in which the left-side motor 13 (FIG. 2) serving as the actuator for rotating the left-side leg driving wheels 7*a*, 7*b*, and 7*c* and the right-side motor 14 (FIG. 2) serving as the actuator for rotating the right-side leg driving wheels 8*a*, 8*b*, and 8*c* are driven. In accordance with the parameters associated with the actuators and also in accordance with the output parameters of "action time" and "duty", logical levels are supplied to a pair of input terminals IN1 and IN2 of the left-side motor driver unit 11 (FIG. 2) from a pair of output ports OUT-#5 and OUT-#6 of the microcomputer 10, and to a pair of input terminals IN1 and IN2 of the right-side motor driver unit 12 (FIG. 2) from another pair of output ports OUT-#7 and OUT-#8, thereby driving the motors 13 and 14 at a rotation speed indicated by the output parameter of "duty" for a period of time indicated by the output parameter of "action time" in the driving mode "forward rotation", "reverse rotation", or "stop" in response to the logical level defined as shown in FIG. 3 thereby moving the left and right leg means 8 and 9 such that the insect robot performs a specified action unit. Temporal changes in the logical levels of the control signal and resulting movement of the left and right leg means 8 and 9 and action of the insect robot are shown in FIGS. 10A, 10B, and 10C.

Figure 11:
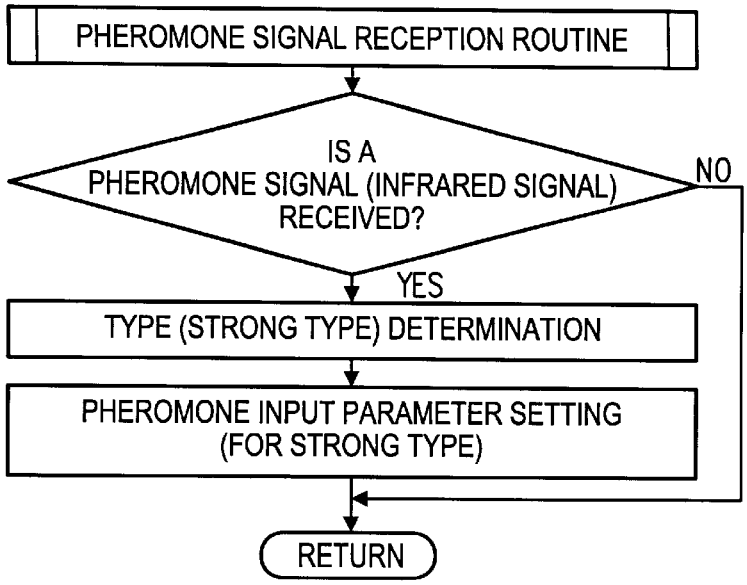

Referring again to FIG. 4, when the flow jumps to the pheromone signal reception subroutine (c in FIG. 4), the microcomputer 10 starts the pheromone signal reception subroutine (a in FIG. 11) and decides whether a pheromone signal has been received from another insect robot (b in FIG. 11). In this step, the microcomputer 10 decides whether any pheromone signal has been received by checking a signal applied to the input port IN-#2, that is, an optical signal which has been sensed and converted into an electric signal by the phototransistor 3 (FIG. 2) and applied to the input port IN-#2 via the amplifier 3*a*. If the decision is No (b in FIG. 11), the microcomputer 10 returns the flow to the main routine (e in FIG. 11) and repeatedly decides whether any pheromone signal is received (b in FIG. 11), until arrival of a next point of the operation reference points of time at intervals of 100 ms. If a pheromone signal is received and thus the decision (b in FIG. 11) becomes Yes, the microcomputer 10 executes the type identification subroutine thereby establishes the inter-robot behavioral relationship identifying means G, thereby identifying the inter-robot behavioral relationship between the insect robot itself and another insect robot from predetermined inter-robot behavioral relationships relatively defined among different types, typically including "strong type", "weak type", and "same type", in accordance with another insect robot's identification information indicating the type such as "type A", "type B", or type C" as shown in FIG. 5, represented by the reception pheromone signal received from said another insect robot, and also in accordance with the own uniquely preassigned identification information, typically indicating one of the types shown in FIG. 5, of the insect robot itself. The input parameter "pheromone" is then set so as to indicate the determined inter-robot behavioral relationship (d in FIG. 11). Thereafter, the flow returns to the main routine (e in FIG. 11). Although, in this specific example, the types of the inter-robot behavioral relationship include "strong type", "weak type", and "similar type" relatively defined among insect robots, the types are not limited to those. For example, the relative types of the inter-robot behavioral relationship may include "male" and "female", and the types of the inter-robot behavioral relationship that uniquely identify the respective insect robots may include "male parent", "female parent", "child #1", "child #2", and a couple of insect robots. In such cases, of course, action units such as "escape" and "threat" that are performed depending on the inter-robot behavioral relationship such as "strong type" or "weak type" should be replaced with other action units so as to properly simulate the behavior of the actual living things.

Figure 13:
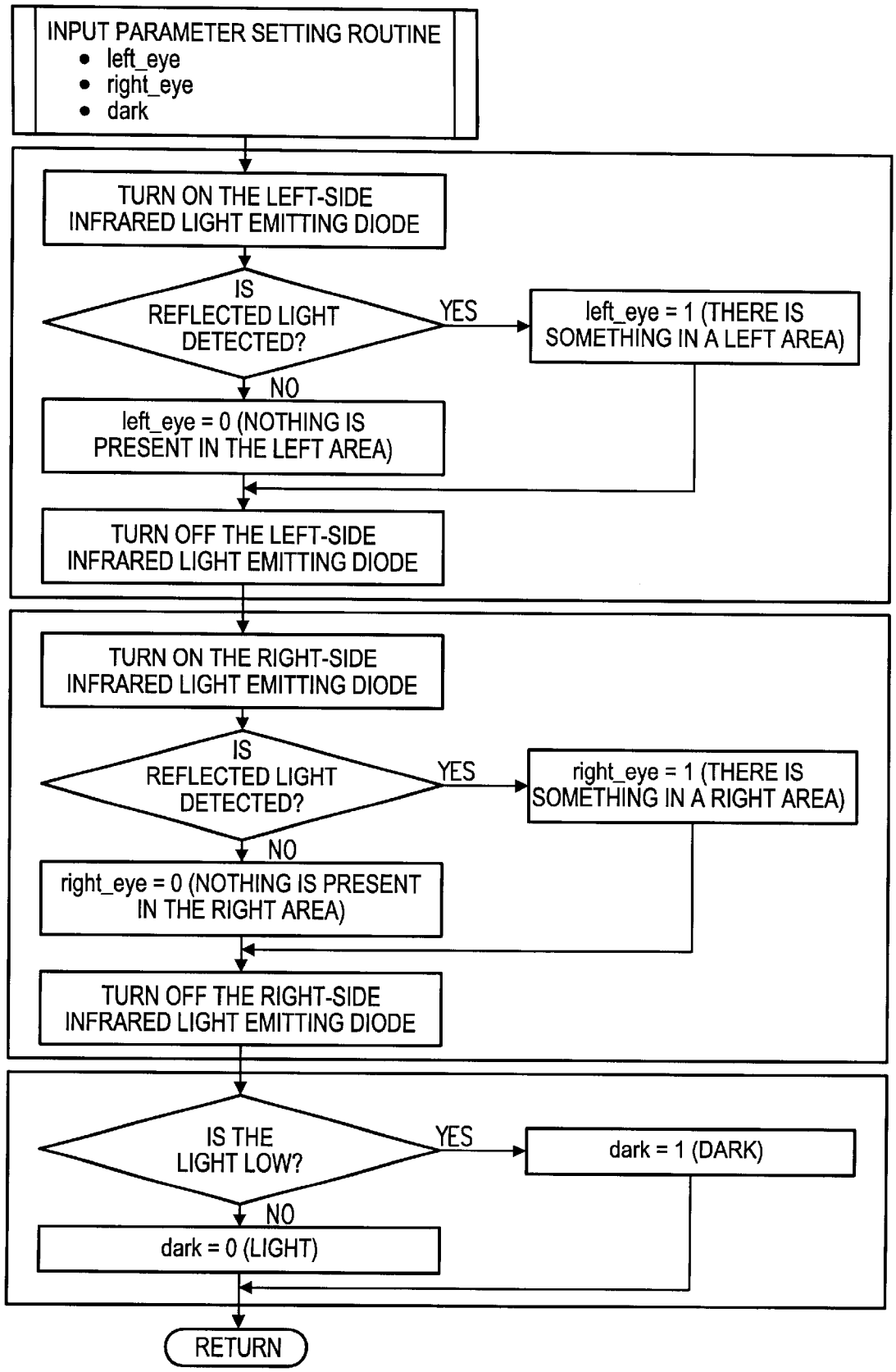

Referring again to FIG. 4, if the flow jumps to the input parameter setting subroutine (g in FIG. 4), the microcomputer 10 starts the input parameter setting subroutine (a in FIG. 13). In the input parameter setting subroutine, the microcomputer 10 turns on the left-side light emitting diode 2*a* (b in FIG. 13) and then decides whether reflected light is detected (c in FIG. 13). More specifically, the microcomputer 10 supplies a driving signal to the left-side light emitting diode 2*a* (FIG. 2) from the output port OUT-#1 and decides whether there is an obstacle state signal by checking a signal applied to the input port IN-#2, that is, a signal generated as the obstacle state signal by the phototransistor 3 in response to detection of reflected light and applied as the obstacle state signal associated with the obstacle to the input port IN-#2 via the amplifier 3*a*. If reflected light is detected and thus the decision (c in FIG. 11) is Yes, the input parameter of "left eye" is set to "1" (d in FIG. 11). However, if no reflected light is detected and thus the decision (c in FIG. 11) is No, the input parameter of "left eye" is set to "0" (e in FIG. 11). Thereafter, the left-side light emitting diode is turned off (f in FIG. 11).

Similarly, the microcomputer 10 turns on the right-side light emitting diode 2*b* (g in FIG. 13) and decides whether reflected light is detected (h in FIG. 13). If reflected light is detected and thus the decision (h in FIG. 13) is Yes, the input parameter of "right eye" is set to "1" (i in FIG. 13). However, if no reflected light is detected and thus the decision (h in FIG. 11) is No, the input parameter of "right eye" is set to "0" (j in FIG. 13). Thereafter, the right-side light emitting diode is turned off (k in FIG. 13). The microcomputer 10 then decides whether an environmental state signal is issued by checking a signal applied to the input port IN-#1, that is, a signal detected by the cadmium sulfide cell 4 and output therefrom as the environmental state signal indicating the lightness (darkness). If no external light is detected and thus the decision (l in FIG. 13) is Yes, the input parameter of "dark" is set to "1" (m in FIG. 13). On the other hand, if external light is detected and thus the decision (l in FIG. 13) is No, the input parameter of "dark" is set to "0" (n in FIG. 13). Thereafter, the flow returns to the main routine (o in FIG. 13).

Now referring to FIGS. 14 to 30, the embodiments according to claims 9 to 16 of the present invention are described below. These embodiments are different from the above-described embodiments according to claims 1 to 8 of the present invention in that a concept of an instruction unit including one sensor identifying unit and one or more action units connected thereto is introduced, wherein the embodiments include the process of setting and storing such an instruction unit and the process of selecting and executing the one or more action units in the instruction unit.

Figure 14:
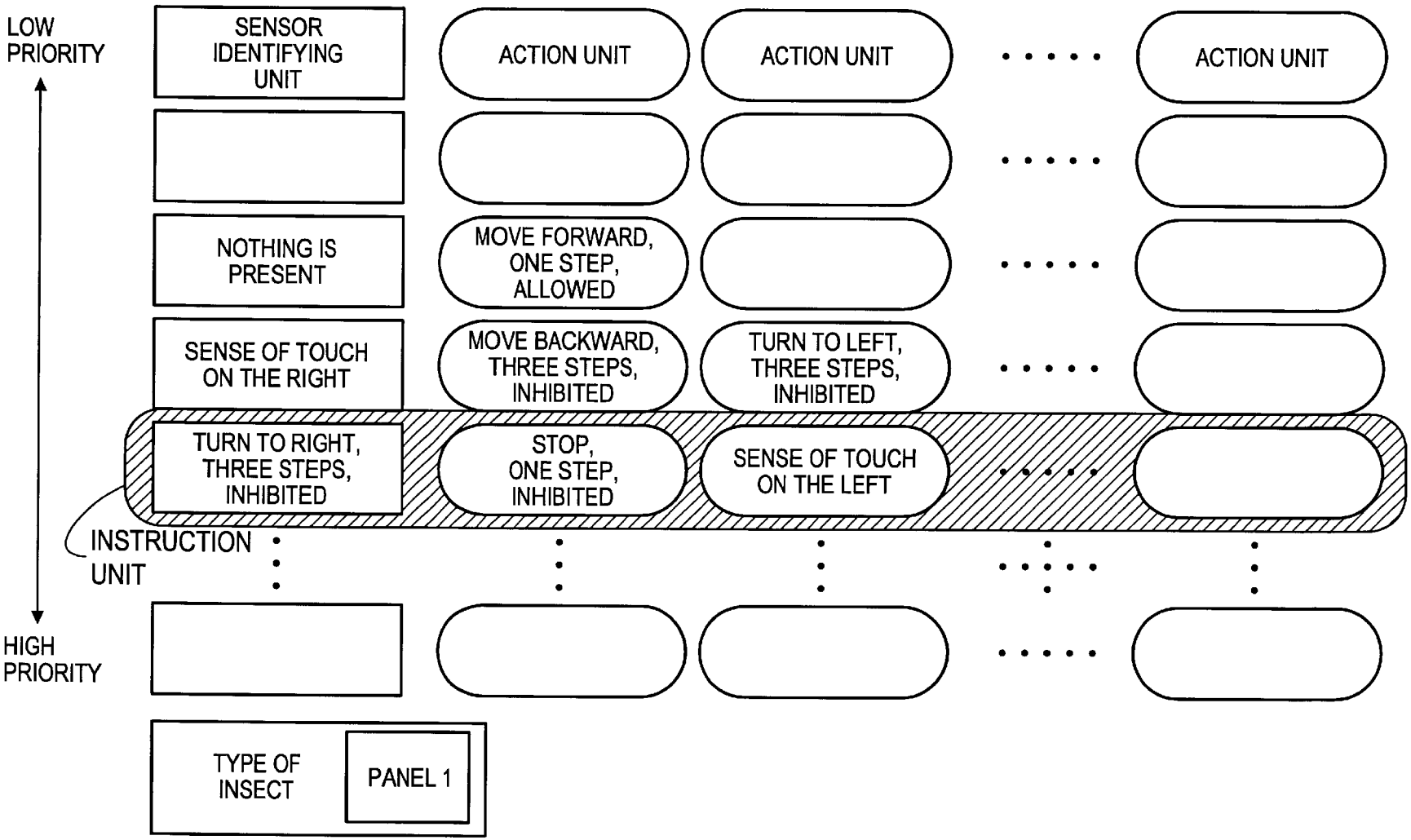

FIG. 14 is a diagram illustrating an operation control screen of a common microcomputer including a keyboard, serving as the instruction unit setting means L. In this specific example, a panel-1 is selected from a plurality of panels and displayed on the operation control screen for use in defining actions of the insect robot. The panel-1 includes a plurality of instruction units that may be set by a user via the keyboard. This makes it possible to visually check the arrangements of the instruction units which have been set or are to be set by the instruction unit setting means L. In the specific example shown in FIG. 14, an instruction unit in the bottom row, indicated by hatching, is set so as to include a sensor identifying unit of "sense of touch on the left" or "collision with an obstacle present on the left" that will be described later, and further include a plurality of action units "stop, one second, inhibited" and "turn to right, 3 steps, inhibited" which are lined to the right as so to be assigned to the sensor identifying unit.

Furthermore, in this specific example, an instruction unit in the third row is set so as to include a sensor identifying unit of "nothing is present" and an action unit of "move forward, one step, allowed" assigned to the sensor identifying unit, and an instruction unit in the fourth row is set so as to include a sensor identifying unit of "sense of touch on the right" or "collision with an obstacle present on the right" that will be described later linked to two action units "move backward, three steps, inhibited" and "turn to left, 3 steps, inhibited" assigned to the sensor identifying unit.

Figure 15A:
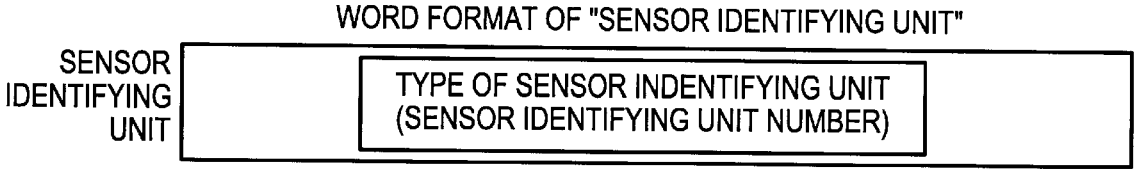
FIG. 15A is a diagram showing a word configuration of a sensor identifying unit.
Figure 15B:
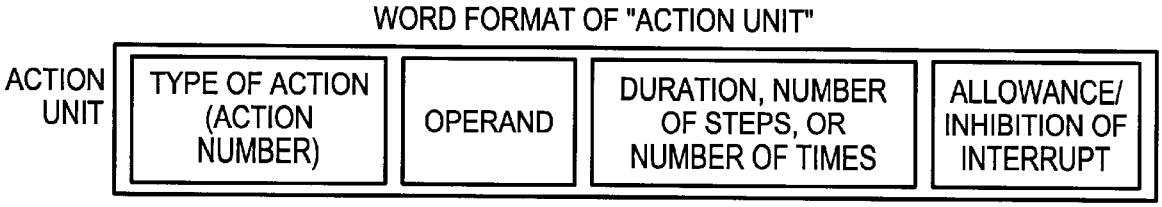
FIG. 15B is a diagram showing a word configuration of an action unit.
Figure 17:
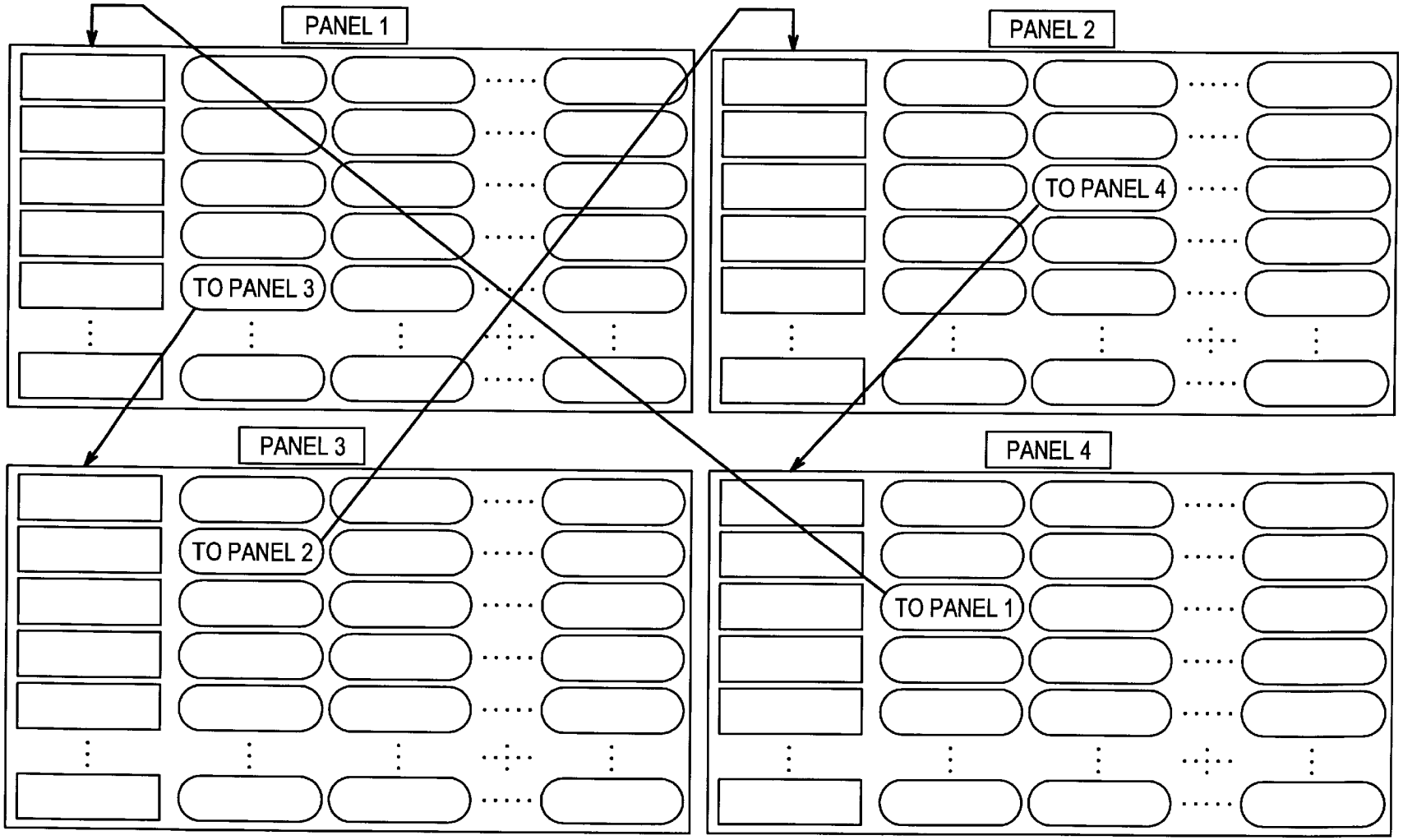

Furthermore, below these rows, the instruction unit indicated by hating is disposed in the bottom row as described earlier. A plurality of instruction units are defined on one panel by the user via the keyboard such that each instruction unit includes a sensor identifying unit and related one or more action units, whereby if a sensor identifying unit of an instruction unit is determined depending on the reaction state of hardware sensors corresponding to the sensor identifying unit, the action units assigned to the determined sensor identifying unit are sequentially executed by a specified execution amount, thereby programming the behavior of the insect robot so that the insect robot behaves depending on the external environment in the manner programmed by the user. This makes it possible for the user to determine the character of the insect robot in various fashions. In FIG. 14, as will be described later, each instruction unit is placed in one of rows arranged from the top to the bottom depending on the execution priority of the instruction unit. The word format of each sensor identifying unit shown in FIG. 14 is determined, as shown in FIG. 15A, so as to represent the "type of the sensor identifying unit (sensor identifying unit number)". The types of all sensor identifying units (sensor identifying unit numbers) and input parameters of corresponding hardware sensors are listed in FIG. 18. Herein, the "conditions of input parameters" are basically similar to those shown in FIG. 7 or 9. In particular, the parameters associated with "left-eye", "right-eye", "pheromone1" to "pheromone3"), and "dark" are exactly the same. However, in contrast to the parameters shown in FIG. 7 or 9 which are fixedly assigned to the action program units on the left-hand side in the corresponding rows, the parameters shown in FIG. 18 are fixedly assigned not to the action program units but to the corresponding sensor identifying units. Each action unit shown in FIG. 14 is described in a word format consisting of a combination of "action type (action number)", "operand", "execution time, number of steps, or number of times" indicating an amount of execution, and "allowance/inhibition of interruption" against an action unit currently being executed, which are described in turn from left to right, as shown on FIG. 15B. All action units in the above word format are listed in FIG. 19. In the examples of action units shown in FIG. 19, each "operand" is used as an auxiliary parameter for specifying the details of the "action type (action number)" or specifying the execution speed of the action. Except for this, the "action units" are basically similar to those defined by the "output parameters" in FIG. 7 or 9. In particular, action units of "move forward", "move backward", "turn to right", "turn to left", "struggle", "threaten", and "greet" are substantially equivalent to the corresponding action units shown in FIG. 7 or 9.

FIG. 16 is a diagram illustrating schematically a storage format of an instruction unit table serving as the instruction unit storage means M usually formed in a RAM (Random Access Memory) or the like such that a set of instruction units are readably stored therein. At addresses from "0" to "3", values, "5", "14", "20", and "23" indicating the starting addresses (indirect addresses) of the respective panels from panel-1 to panel-5 are described. At addresses from "5" to "13", the instruction units of the 3 rows for 3 units on panel-1 shown in FIG. 14 are described by way of example. The action units shown in FIG. 19 include "to panel-1" to "to panel-4". For example, in the panel-1, if "to panel-3" is placed as one of action units in an instruction unit in a determined sensor identifying unit, then execution of the instruction units grouped in the panel-1 is switched, as represented by an arrow in FIG. 17, to execution of one of instruction units grouped in the panel-3 when the action unit "to panel-3" is executed. That is, this action unit makes it possible for any panel to switch over the execution of instruction units therein to the execution of those in any one of the other panels. The switching of panels makes it possible to change the character of the insect robot defined by one panel set via the operation control screen shown in FIG. 14 into a character defined by another panel. In a main flow chart shown in FIG. 20, corresponding to the main flow chart shown in FIG. 4, if the play execution process (a in FIG. 20) is started, the microcomputer 10 initializes parameters (b in FIG. 20) in preparation for the action unit selection process shown in FIGS. 24A to 24D. Thereafter, the flow proceeds to a pheromone signal reception process (c in FIG. 20). This process is basically similar to the pheromone signal reception process denoted by c in FIG. 4 except that, as can be seen from comparison between a flow chart shown in FIG. 21 illustrating a subroutine for this pheromone signal reception process and the flow chart shown in FIG. 11, the pheromone identifying process (d in FIG. 21) further includes a receiving process of notification pheromone and space pheromone as additional media.

Figure 12:
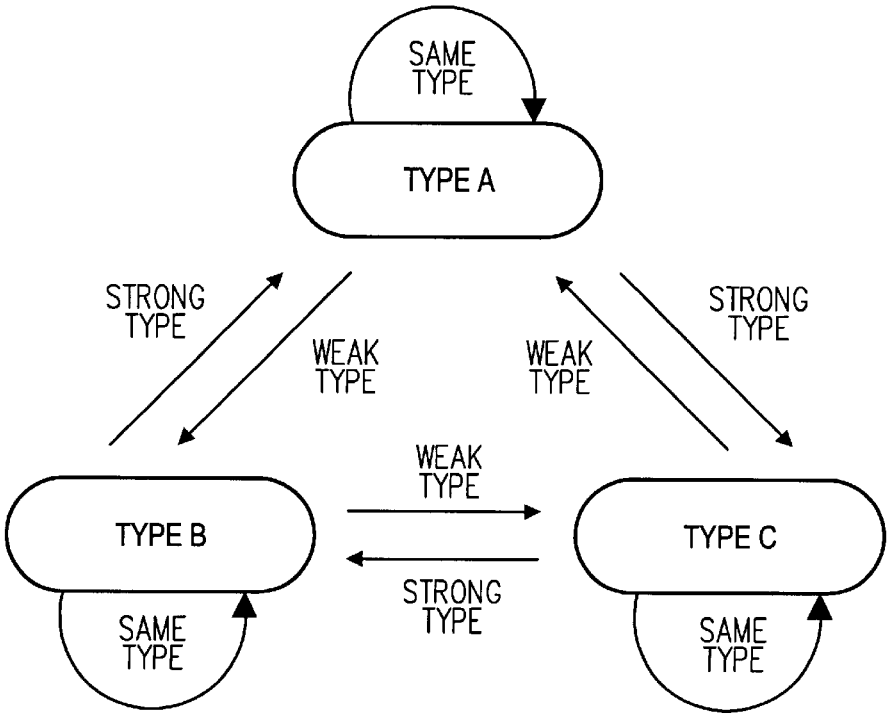

In this pheromone identifying process (c in FIG. 20), in addition to a pheromone signal identifying the type, such as type A, B, or C, uniquely preassigned to another insect robot present in action space, a notification pheromone signal used to transmit particular information related to an action unit such as information for "calling an associate" or for "threatening an associate" and also a pheromone signal emitted from an fixed object present in the action space other than the insect robots, such as a flower pheromone signal, are received and identified. This allows the pheromone signal reception means F to be realized in an expanded fashion, although a further detailed description thereof is not given herein. In the pheromone identification subroutine (d in FIG. 21), only the identification of the type, such as type A, B, or C, of another insect robot is identified, but the identification of the inter-robot behavioral relationship is not performed unlike the process shown in FIG. 12.

Figure 20:
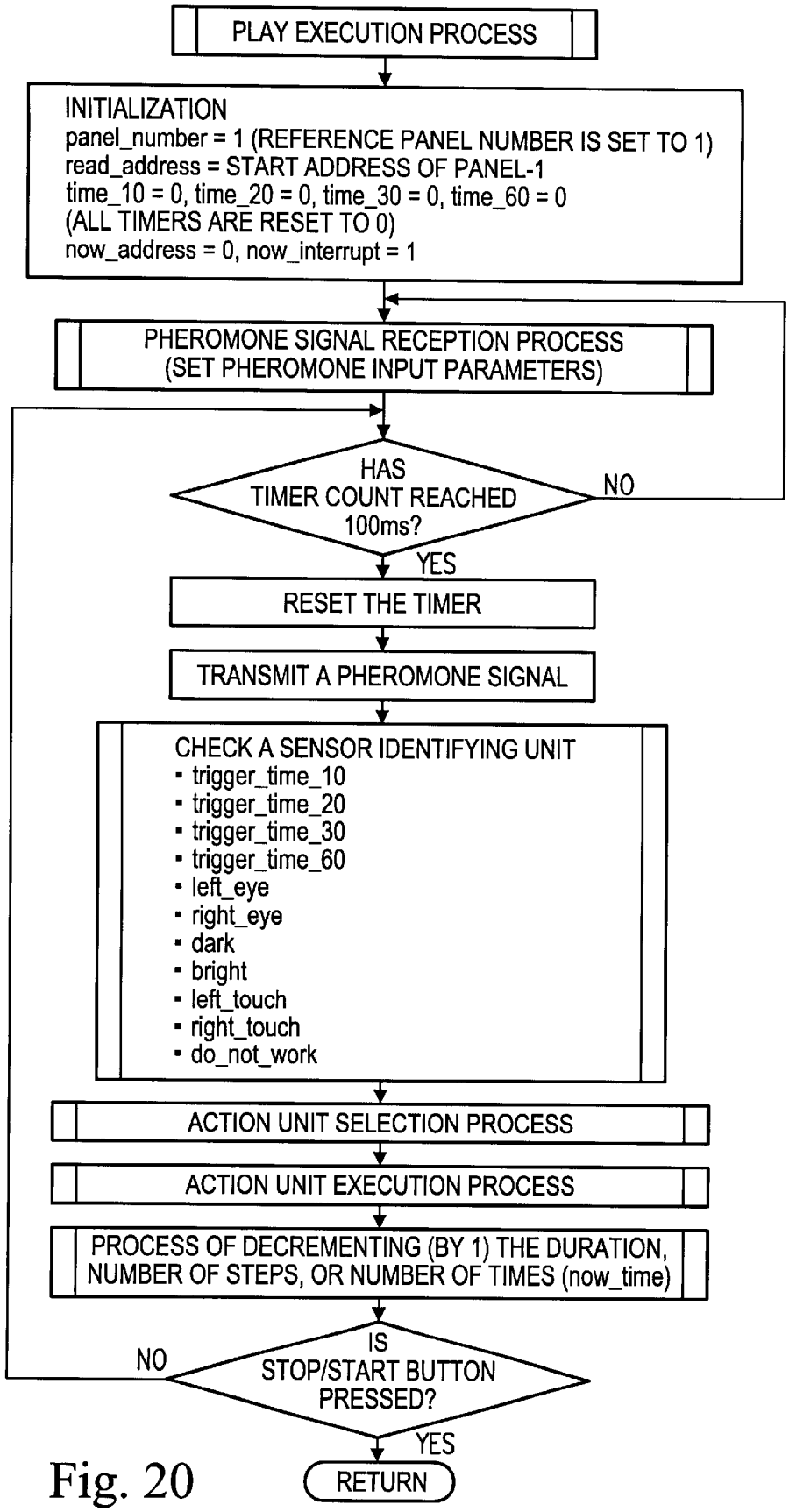
Figure 21:
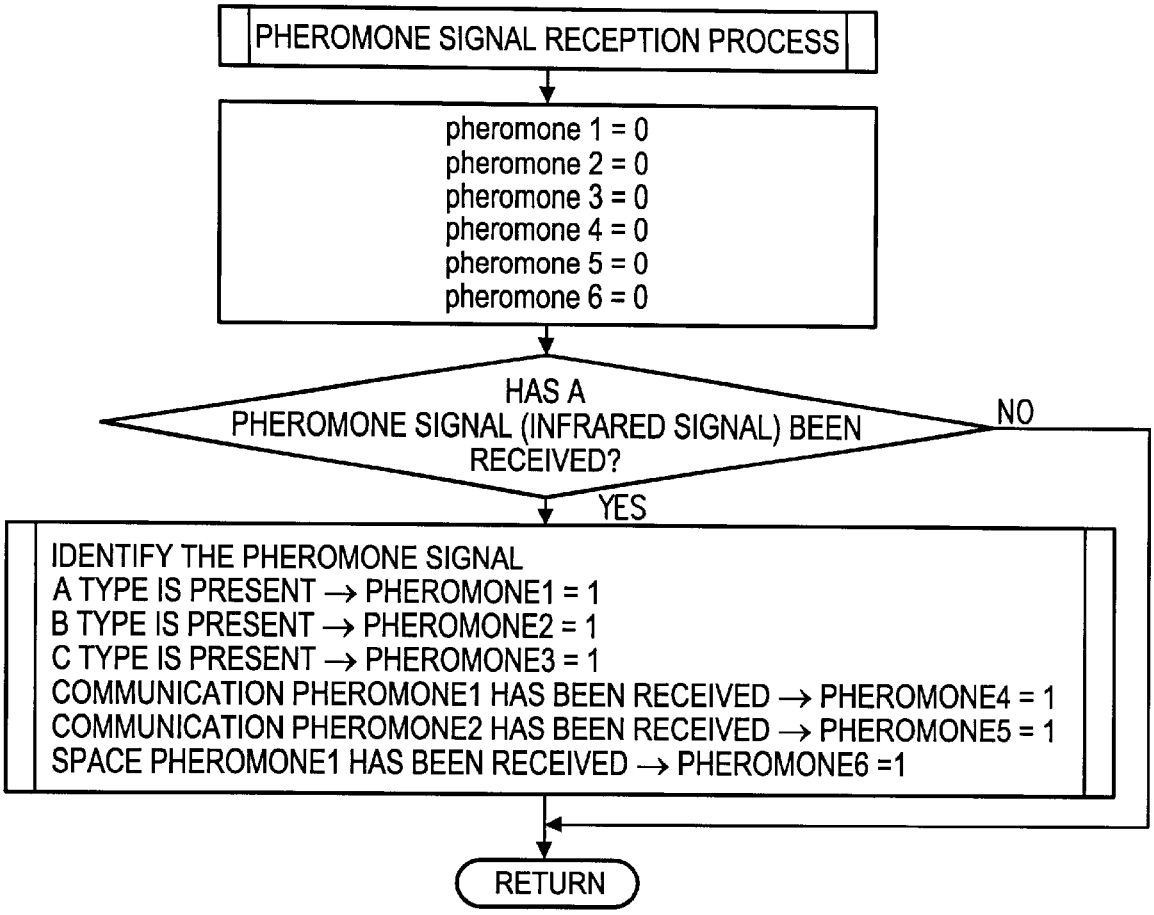
Figure 22:
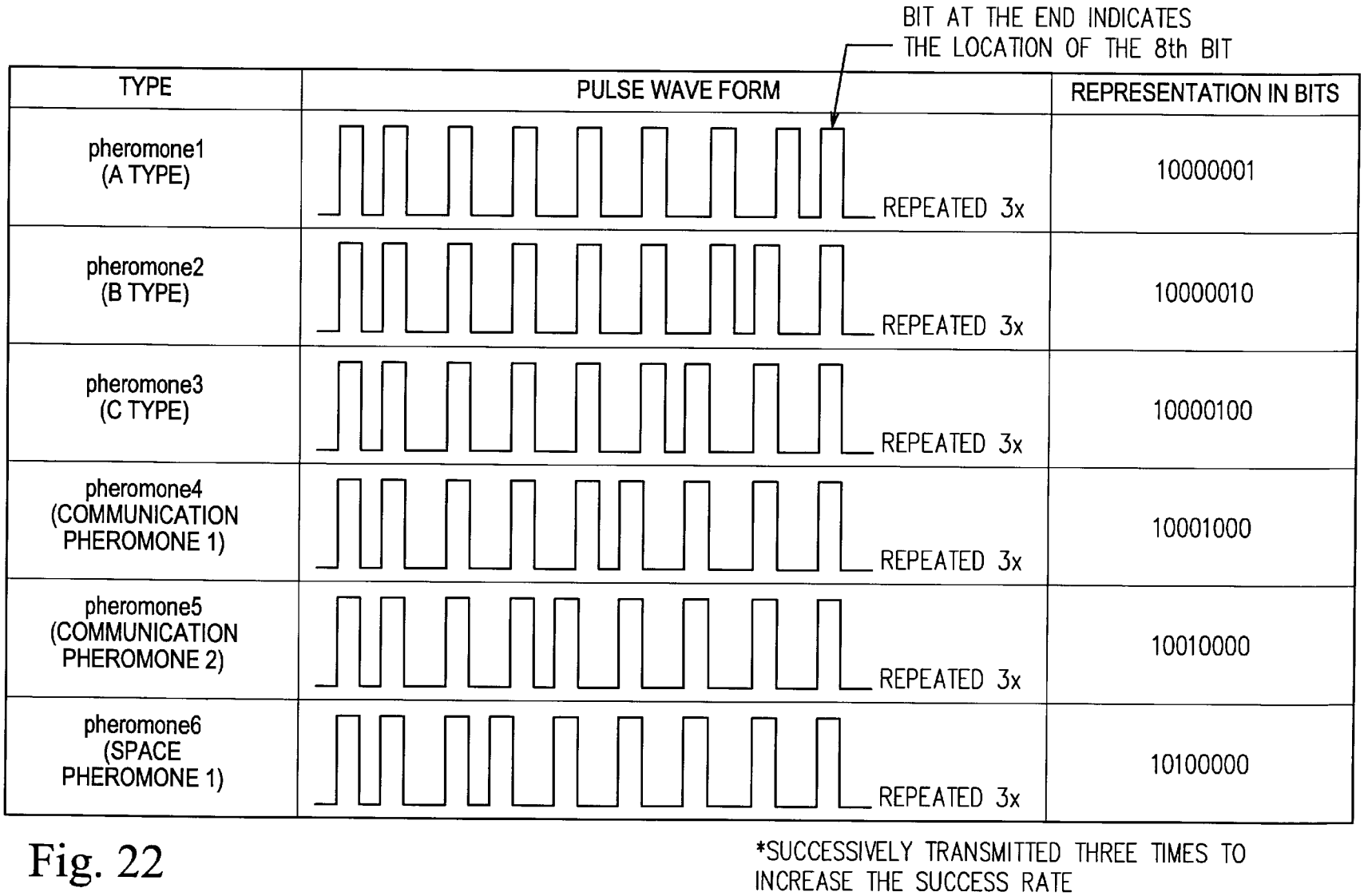

In the main flow shown in FIG. 20, the microcomputer 10 executes the subroutine shown in FIG. 21 thereby respectively setting, as in the subroutine shown in FIG. 11, the input parameters, "pheromone1", "pheromones2", and "pheromone3", of the corresponding sensor for the sensor identifying units, "type A is present", "type B is present", and "type C is present", as shown in FIG. 18. Similarly, the parameters, "pheromone4", and "pheromone5", are respectively set for the sensor identifying units, "notification pheromone1 is received" and "notification pheromone2 is received". Furthermore, the parameter of "pheromone6" is set for the sensor identifying unit of "space pheromone1 is received". Thereafter, a 100-ms time counting process (d in FIG. 20) is performed in a similar manner as in step d in FIG. 4. Furthermore, a timer resetting process (e in FIG. 20) is performed in a similar manner as in step e in FIG. 4. Still furthermore, a pheromone signal transmission process (f in FIG. 20) corresponding to step f in FIG. 4 is performed. Various notification pheromone signals, representing information identifying the insect robot, transmitted in the pheromone signal transmission process in step f in FIG. 4 are shown in FIG. 5. The notification pheromone signals transmitted in the pheromone signal transmission process in step f shown in FIG. 20 are summarized in FIG. 22, in which the pulse waveforms of "pheromone4" corresponding to the notification pheromone1, "pheromone5" corresponding to the notification pheromone2, and "pheromone6" corresponding to the space pheromone1 are shown in addition to the pulse waveforms of the "pheromone1" to "pheromone3". The transmission of the notification pheromone1 and the transmission of the notification pheromone2 are also shown, as action units included in instruction units, in FIG. 19, which can be set properly by the user via the keyboard.

Figure 28:
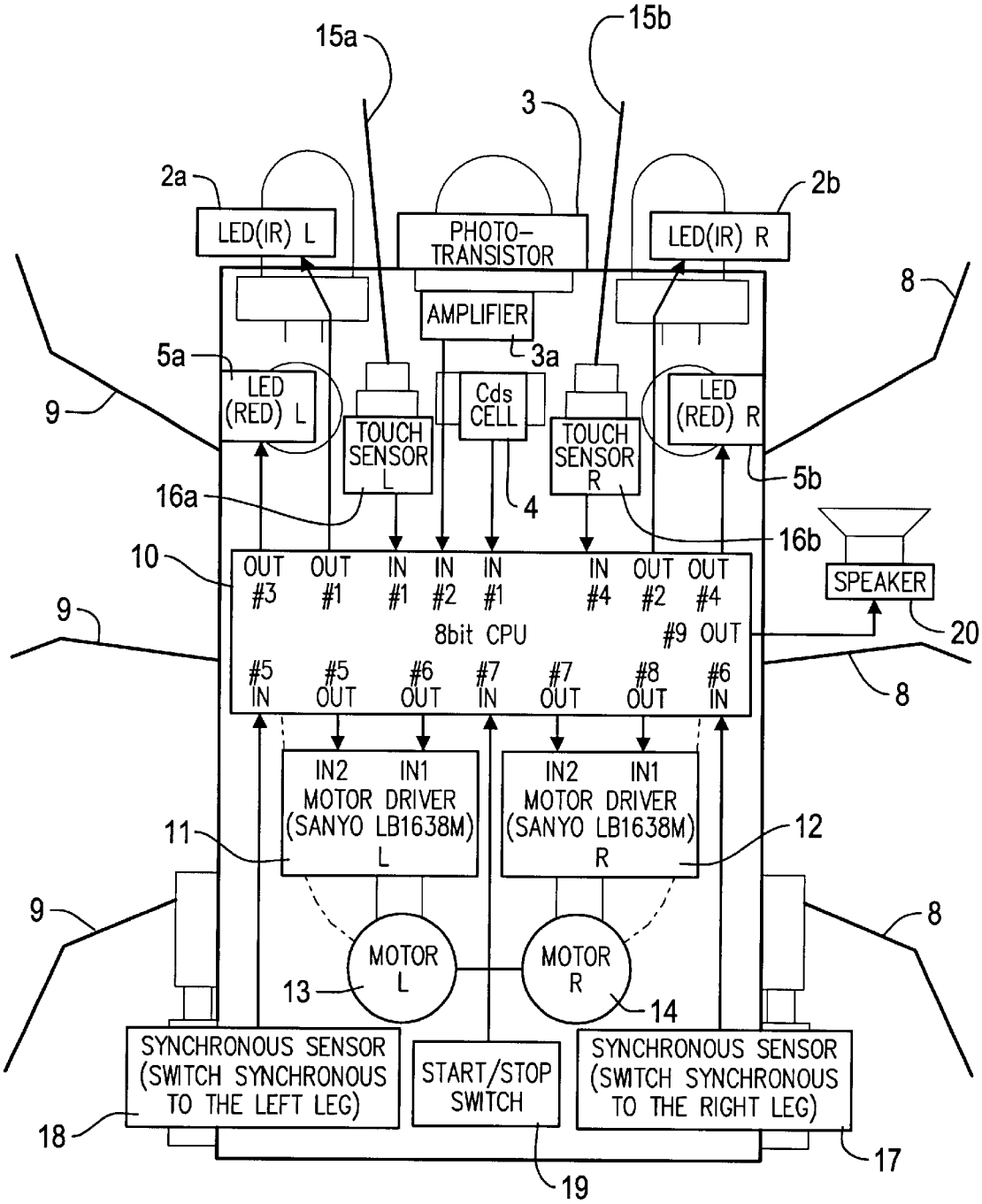

In the main routine shown in FIG. 20, the microcomputer 10 further executes a sensor identifying unit determination process (g in FIG. 20) in which a sensor identifying unit is determined by means of processing states of hardware sensors on the basis of a predetermined algorithm. In other words, a sensor identification unit determining means K is realized by assigning "condition of input parameter from sensor" described on the right side in FIG. 18 to "type of sensor identifying unit" described on the left side. After entering the sensor identifying unit determination process (g in FIG. 20), the microcomputer 10 forces the flow to jump to a subroutine shown in FIGS. 23A to 23C to sequentially read the states of the hardware sensors. Of the hardware sensors, sensors of "left-eye", "right-eye", "dark", and "bright" are checked in a similar manner as in the action program selection process described above with reference to FIGS. 6A, 6B, 8A, and 8B. Sensors "left-touch" and "right-touch" are touch sensors for detecting whether the insect robot is in a state in which it is "in contact with an obstacle". As shown in a block diagram of FIG. 28 corresponding to the block diagram of FIG. 2 showing the construction of the electrical hardware of the insect robot, these touch sensors are formed by known mechanical displacement switches 16*a* and 16*b* linked to base parts of a pair of thin metal wires 15*a* and 15*b* that extend forwardly from the head 1*a* of the insect robot and that are formed so as to serve as contact members. Electrical contact outputs of the respective pair of touch sensors 16*a* and 16*b* serve as obstacle state signals and are respectively connected to the input ports #3 and #4 of the microcomputer 10. Sensors "do-not-work" are synchronous sensors for detecting the rotation of the leg drive wheels thereby determining whether the insect robot is in a constraint state in which it is impossible to move. As shown in a block diagram of FIG. 28, the sensors "do-not-work" 17 and 18 are realized by optically or magnetically coupling known synchronous rotation sensors to the leg driving wheels 6*a*, 6*b*, 6*c*, 7*a*, 7*b*, and 7*c*. The constraint state signals output from the pair of the synchronous rotation sensors 17 and 18 are respectively supplied to the input ports #5 and #6 of the microcomputer 10. A sensor "front-eye" is an optical proximity switch (realized by a combination of an LED and a phototransistor) similar to those of "left-eye" and "right-eye" and is used to detect an obstacle state of "something is present in front" of the insect robot. As shown in FIG. 28, the forward-facing phototransistor 3 disposed on the central part of the head 1*a* is shared by the sensors "left-eye" and "right-eye". These state detection means form the external state detection means AA, in conjunction with the state detection means of "left-eye", "right-eye", "dark", and "bright" described above. "Trigger-time-10", "trigger-time-20", "trigger-time-30", and "trigger-time-60" are timers for respectively counting the elapse of times of 10 sec, 20 sec, 30 sec, and 60 sec, from the time at which the respective timers were reset. Detections of timeout of these timers are also shown as sensor identifying units at the bottom of the table shown in FIG. 18. The computer 10 performs step b and the following steps shown in FIG. 23A while checking the states of the hardware sensors, in a basically similar manner as described in central parts of the action program unit selection process shown in FIGS. 6A to 6B and FIGS. 8A to 8B. However, in the process shown in FIGS. 23A to 23C, unlike the process shown in FIGS. 6A to 6B and FIGS. 8A to 8B, the process is not fixedly related to the action program units shows on the right-hand sides of the figures.

Figure 23A:
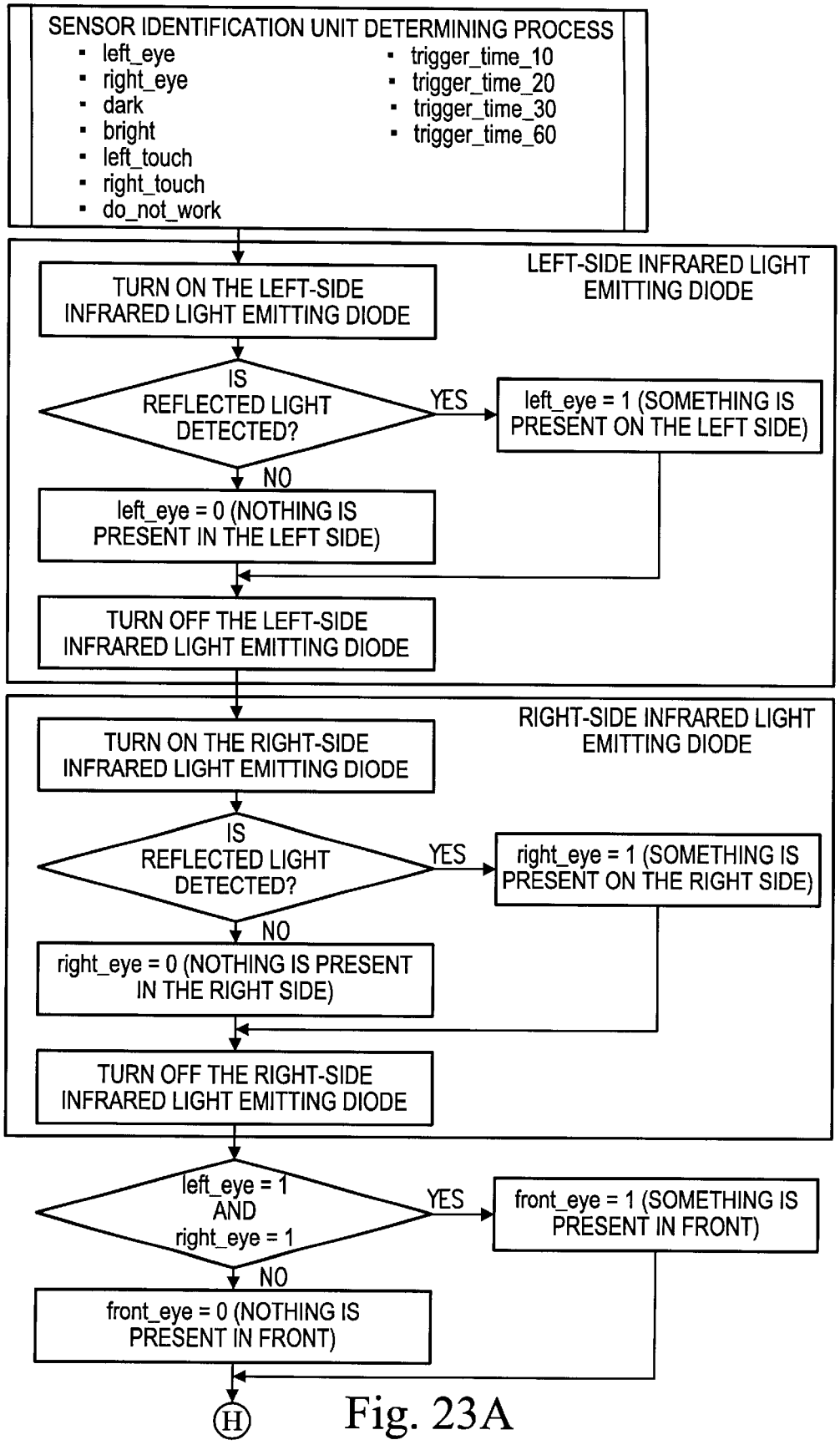
FIGS. 23A, 23B, and 23C are flow charts of a sensor identification unit discriminating process.
Figure 23B:
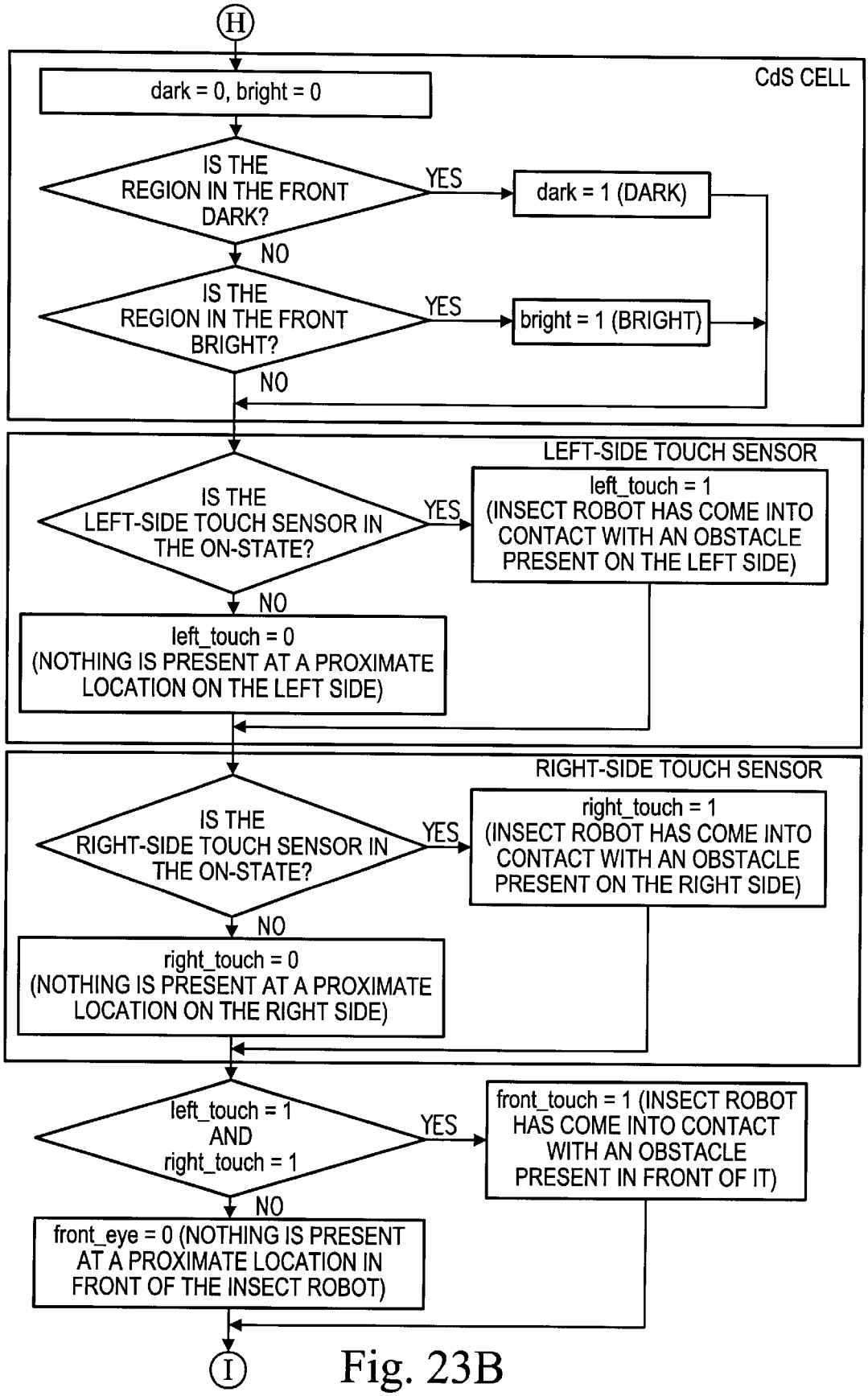
Figure 23C:
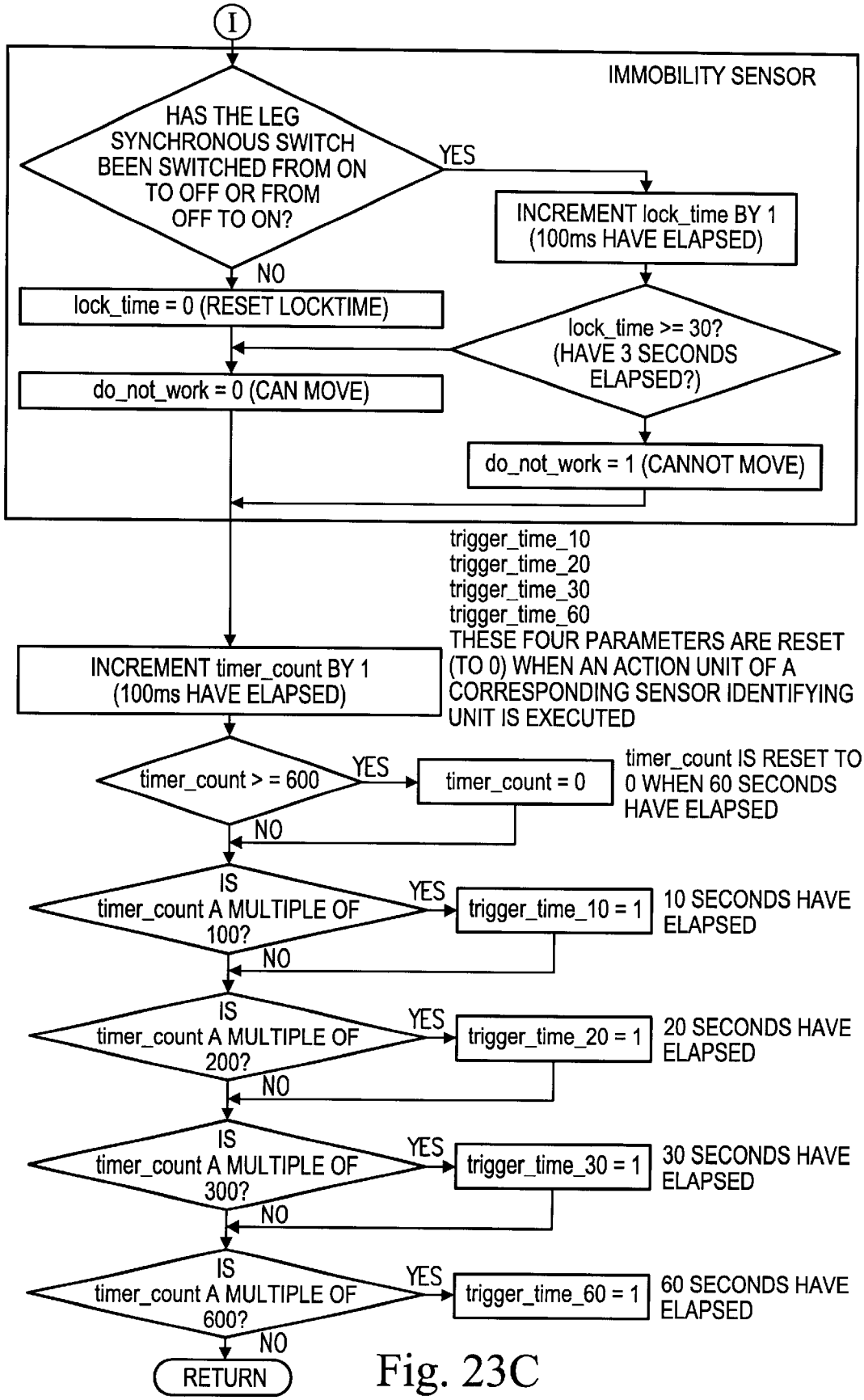

In the flow charts shown in FIGS. 23A to 23C, the process from steps b to f in FIG. 23A makes a determination associated with the sensor identifying unit of "something is present on the left"; the process from steps g to k in FIG. 23A makes a determination associated with the sensor identifying unit of "something is present on the right"; the process from steps l to n in FIG. 23A makes a determination associated with the sensor identifying unit of "something is present in front"; the process from steps o to s in FIG. 23A makes a determination associated with the sensor identifying unit of "bright in front" and the sensor identifying unit of "dark in front"; the process from steps t to v in FIG. 23B makes a determination associated with the sensor identifying unit of "collision with an obstacle on the left"; the process from steps w to y in FIG. 23B makes a determination associated with the sensor identifying unit of "collision with an obstacle on the right"; the process from steps z to zb in FIG. 23B makes a determination associated with the sensor identifying unit of "collision with an obstacle in front"; the process from steps zc to zh in FIG. 23B makes a determination associated with the sensor identifying unit of "cannot move"; the process from steps zi to zk in FIG. 23C resets a 60-sec timer; the process from steps zl to zm in FIG. 23C makes a determination associated with the sensor identifying unit of "10 seconds have elapsed"; the process from steps zn to zo in FIG. 23C makes a determination associated with the sensor identifying unit of "20 seconds have elapsed"; the process from steps zp to zq in FIG. 23C makes a determination associated with the sensor identifying unit of "30 seconds have elapsed"; and the process from steps zr to zs in FIG. 23C makes a determination associated with the sensor identifying unit of "60 seconds have elapsed". The trigger signal generating means Q is realized by the processes associated with the sensor identifying units of "10 seconds have elapsed,", "20 seconds have elapsed", "30 seconds have elapsed", and "60 second have elapsed" (zi to zs in FIG. 23C).

After completion of the sensor identifying unit determination subroutine (FIGS. 23A, 23B, and 23C), the flow returns to the main routine (zt in FIG. 23C). Then, in order to execute an action unit selection process (h in FIG. 20), the microcomputer 10 jumps to an action unit selection subroutine (h in FIG. 20 and a in FIG. 24A) in which the action unit selection process is executed in accordance with the flow shown in FIGS. 24A, 24B, 24C, and 24D, thereby mainly realizing an action unit sequentially selecting means N and a preferential action unit selection means O. For ease of understanding, it is assumed in this specific example that the operation is performed in accordance with the instruction units which have been set via the panel-1 as described earlier with reference to FIGS. 14 and 16.

At the start of the action unit selection process (a in FIG. 24A), in a state in which variables/parameters have values initialized (step b in FIG. 20) in the main routine shown in FIG. 20, the microcomputer 10 first checks whether now-interrupt is equal to 1 (b in FIG. 24A) to decide whether an interruption of an action unit currently being executed is allowed. In this specific case, because now_interrupt has a value of 1 set in the initialization step (b in FIG. 20), the answer to this decision step is Yes. Thus, the microcomputer 10 reads the parameter read-address such that read-address= data-table(pannel-number-1) (c in FIG. 24A). That is, the content of the instruction unit table at the address of "pannel-number -1" is read as read-address. In this specific case, because the currently selected panel is panel-1 (b in FIG. 20), pannel-number "1"−"1"="0", and thus data-table (0) is read. Thus, "5" stored at the address of "0" of the table is read and temporarily stored as read-address into a read-address register. Thereafter, the microcomputer 10 reads the parameter read-data such that read-data=data-table(read-address) (d in FIG. 24A). Herein, because the current value of the read-address is equal to "5", 'sensor identifying unit "nothing is present"' stored at the address of "5" of the instruction unit table is read therefrom and temporarily stored as read-data into the read-data register. Immediately thereafter, the microcomputer 10 adds 1 to the content of read-address such that the content of read-address points to the address of "6" of the instruction unit table. Thereafter, the microcomputer 10 decides whether the content of read-data is a sensor identifying unit, an action unit, or an end command (e in FIG. 24A). In this specific case, because the content of read-data is 'sensor identifying unit "nothing is present"', and thus a decision is given as "sensor identifying unit ". Thereafter, read-sensor is read such that read-sensor=read-data (f in FIG. 24A), thereby storing 'sensor identifying unit "nothing is present"' as read-sensor into the read-sensor register. However, in the case where it is decided in the above decision step (e in FIG. 24A) that the content of read-data is an "action unit", the microcomputer 10 returns to step d in FIG. 24A to repeat the above-described process. That is, sensor identification units are checked while scanning the instruction unit table (FIG. 16) from an address to another. Thereafter, the microcomputer 10 checks whether sensor(read-sensor)=1 (g in FIG. 24A) thereby deciding whether a decision associated with the sensor identifying unit of "nothing is present" is currently being performed in the sensor identifying unit determination process (in FIG. 23). In other words, it is determined whether the hardware sensors are responding to meet the determination algorithm. If the decision is No, that is, if the sensors are not responding, the flow returns to step d in FIG. 24A to repeat the process therefrom to step g in FIG. 24A to be kept waiting till the detection of a responding sensor thereby checking a sensor identifying unit. Because of the nature of the sensor identification unit determination algorithm, the sensor identifying unit of "nothing is present" is always decided as valid at first, and thus the corresponding parameter is set so as to be sensor(read-sensor)=1. That is, the sensor identifying unit of "nothing is present" tentatively means a read-sensor. The resultant value for the sensor identifying unit of "nothing is present" is thus set to "1", and the decision (g in FIG. 24A) becomes Yes. Thereafter, the microcomputer 10 advances the flow to the process shown in FIG. 24B via a path of E-E to read the parameter read-data such that read-data=data-table(read-address) (h in FIG. 24B). That is, an action unit of "move forward, one step, inhibited" stored in the instruction unit table at the address of "6" (FIG. 16) is read as a new value for read-data. Thereafter, the content of read-address is incremented by 1 so as to point to the address of "7" of the instruction unit table.

Figure 24A:
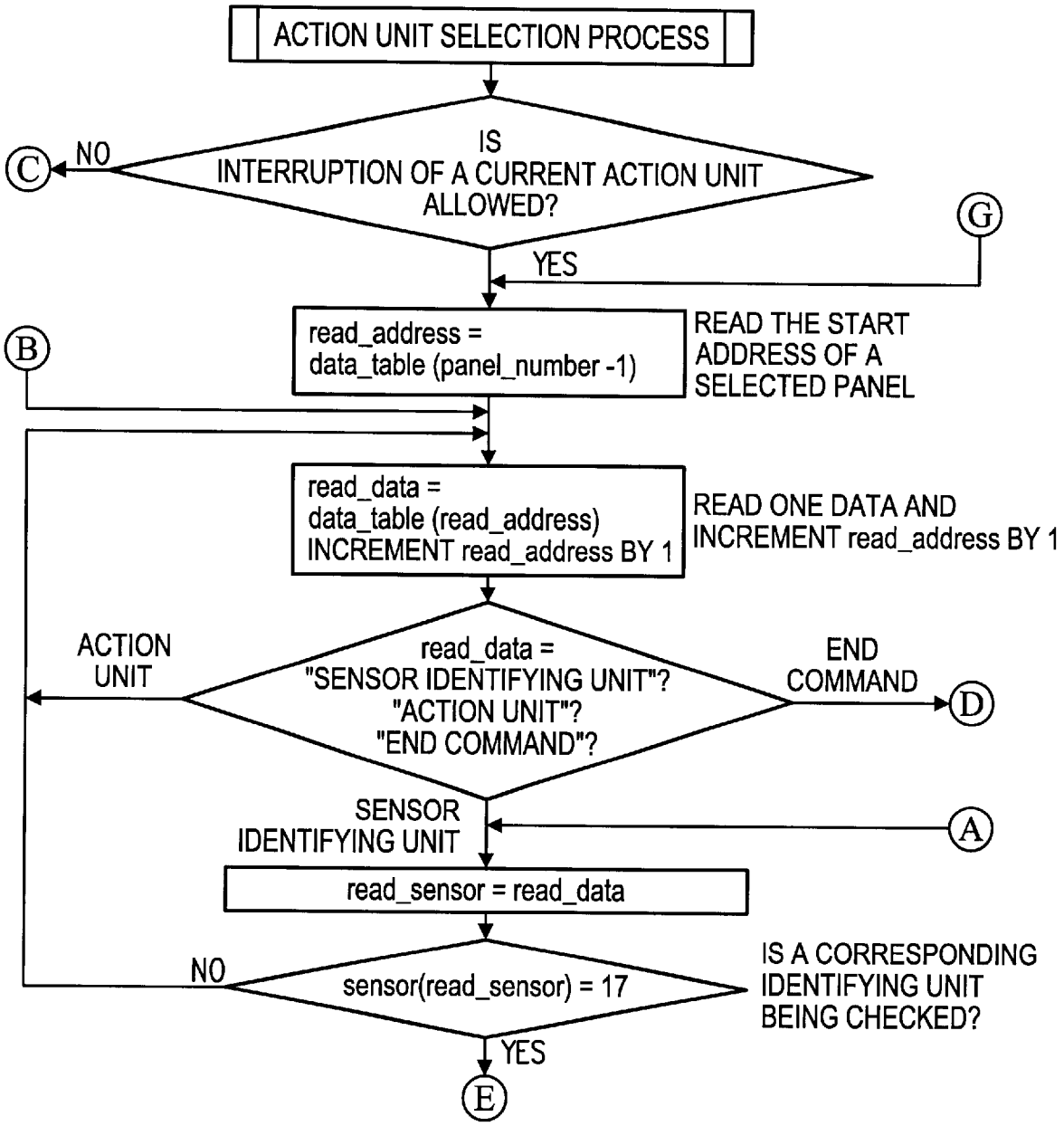
FIGS. 24A, 24B, 24C, and 24D are flow charts of an action unit selection process.
Figure 24B:
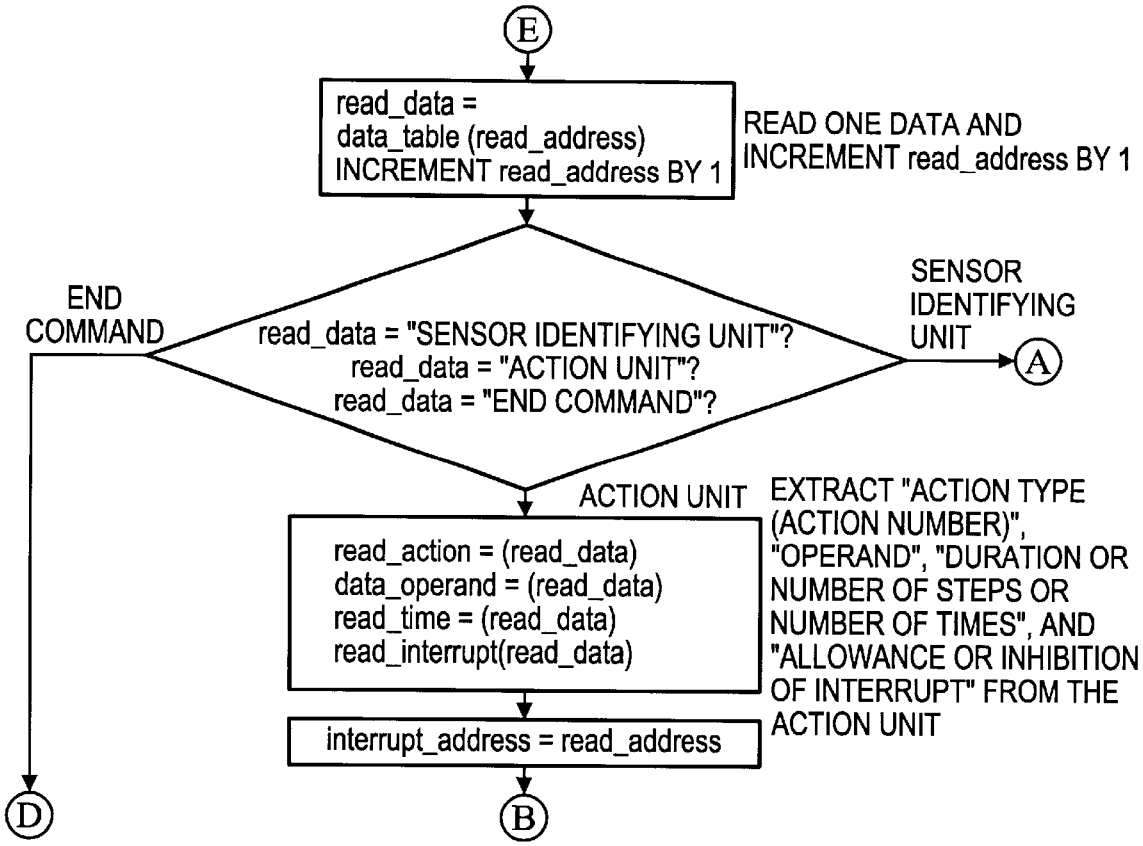

Thereafter, the microcomputer 10 decides whether the given action unit of "move forward, one step, inhibited" is an action unit, a sensor identifying unit, or an end command (i in FIG. 24A). In this specific case, because the content of read-data is the action unit of "move forward, one step, inhibited", the decision is given as "action unit". Thereafter, parameters are further read such that read-action=(read-data), read-operand=(read-data), read-time=(read-data), and read-interrupt(read-data) (j in FIG. 24B). That is, the action number of "1" indicating the action of "move forward", the operand of "0", the execution amount of "1" indicating the execution time, the number of steps, or the number of times, and the value of "1" indicating that the interruption against this action unit is allowed (the value is "0" when the interruption is inhibited) are extracted from the words (FIG. 15B) of the action unit of "move forward, one step, inhibited", and stored into the read-action register, the read-operand register, the read-time register, and the read-interrupt register, respectively, thereby tentatively determining the values thereof. The microcomputer 10 then sets interrupt-address such that interrupt-address=read-address (k in FIG. 24B). As a result, the address of "7" of the instruction unit table (FIG. 16), pointed to by the content of read-address that was incremented in the read-address incrementing step (h in FIG. 24B), is stored as interrupt-address in the interrupt-address register thereby tentatively determining the value of interrupt-address. Then the flow returns to step d in FIG. 24A via a path of B-B. In step d, the microcomputer 10 reads the content of the instruction table (FIG. 16) at the address of "7" pointed to by the content of read-address thereby obtaining, as updated read-data, 'sensor identifying unit "collision with obstacle on the right"'. Thereafter, the microcomputer 10 increments the content of read-address to "8" (d in FIG. 24A). The decision (e in FIG. 24A) associated with the sensor identifying unit is given as Yes, and thus the microcomputer 10 employs this sensor identifying unit as read-sensor. The microcomputer 10 then decides whether sensors corresponding to this sensor identifying unit are responding (g in FIG. 24A). Herein, if it is assumed that there is no response from the sensors, the decision (g in FIG. 24A) becomes No, and thus the flow returns to step d in FIG. 24A. Herein, because the content of read-address is "8", the microcomputer 10 reads, as read-data, 'action unit "move backward, three steps, inhibited"' from the instruction unit table (FIG. 16) at the address of "8". The microcomputer 10 then increments the content of read-address to "9" (d in FIG. 24A). Herein, because the sensors corresponding to the immediately previous sensor identifying unit of "collision with an obstacle on the right" have been decided to be in the no-response state, the microcomputer 10 decides the corresponding action unit (e in FIG. 24A) and returns to step d in FIG. 24A to further check the sensor identifying units. Now, the content of read-address is "9", and thus 'action unit "turn to left, three steps, inhibited"' (FIG. 16) is read from the address of "9", and the content of read-address serving as the pointer is incremented to "10". The corresponding action unit is decided in a similar manner (e in FIG. 24A) and the flow returns to step d in FIG. 24A.

At this stage of the process, 'sensor identifying unit "collision with an obstacle on the left"' (FIG. 16) is read as read-data from the address of "10", and the content of read-address serving as the pointer is incremented to "11" (d in FIG. 24A). The corresponding sensor identifying unit is checked (e in FIG. 24A), and the parameter read-sensor is updated so as to indicate the determined sensor identifying unit (f in FIG. 24A). A decision is then made as to whether sensors corresponding to this sensor identifying unit are responding (g in FIG. 24A). Herein, if it is assumed that there is no response from the sensors, the decision (g in FIG. 24A) becomes No, and thus the flow returns to step d in FIG. 24A to further check another sensor identifying unit to decide whether it is responding. Via the above process, the value of read-address eventually reaches "13".

At this stage of the process, the microcomputer 10 reads the end command as read-data from the instruction unit table at the address of "13" and increments the content of read-address serving as the pointer to "14" (d in FIG. 24A). Thereafter, if the content of read-data is decided as the end command (e in FIG. 24A), the process jumps to the flow shown in FIG. 24C via a path of D-D. In the flow shown in FIG. 24C, the microcomputer first decides whether interrupt-address is greater than now-address (l in FIG. 24C). In this specific case, now-address has an initial value of "0" (b in FIG. 20), and interrupt-address has a value of "7", which indicates a next address to the address of the instruction unit table at which a responding sensor identifying unit is stored, and the value "7" was thus stored therein in the step of setting interrupt-address such that interrupt-address=read-address (k in FIG. 24B) after read-address was incremented by 1 from "6" (h in FIG. 24B) when the sensor identifying unit of "nothing is present" was decided as a first responding sensor identifying unit (g in FIG. 24A). Because "0"<"7", the decision (l in FIG. 24C) is Yes. Thus, the microcomputer 10 sets variables such that now-action=read-action, now-operand=read-operand, now-time=read-time, and now-interrupt=read-interrupt (m in FIG. 24C). That is, read-action, read-operand, read-time, and read-interrupt, which were extracted, in step j in FIG. 24B, from the action unit of "move forward, one step, allowed" are respectively stored into now-action, now-operand, now-time, and now-interrupt, thereby updating them. Furthermore, the microcomputer 10 sets now-address such that now-address=interrupt-address (m in FIG. 24C) thereby storing the current value, "7", of interrupt-address into now-address, and the microcomputer 10 also sets now-sensor such that now-sensor=read-sensor (m in FIG. 24C) thereby storing, into now-sensor, the content of read-sensor indicating the sensor identifying unit "nothing is present", which was detected, in step f in FIG. 24A, as a first responding sensor identifying unit. In this step (m in FIG. 24C), the action unit to be executed is determined and becomes ready for execution.

Figure 24C:
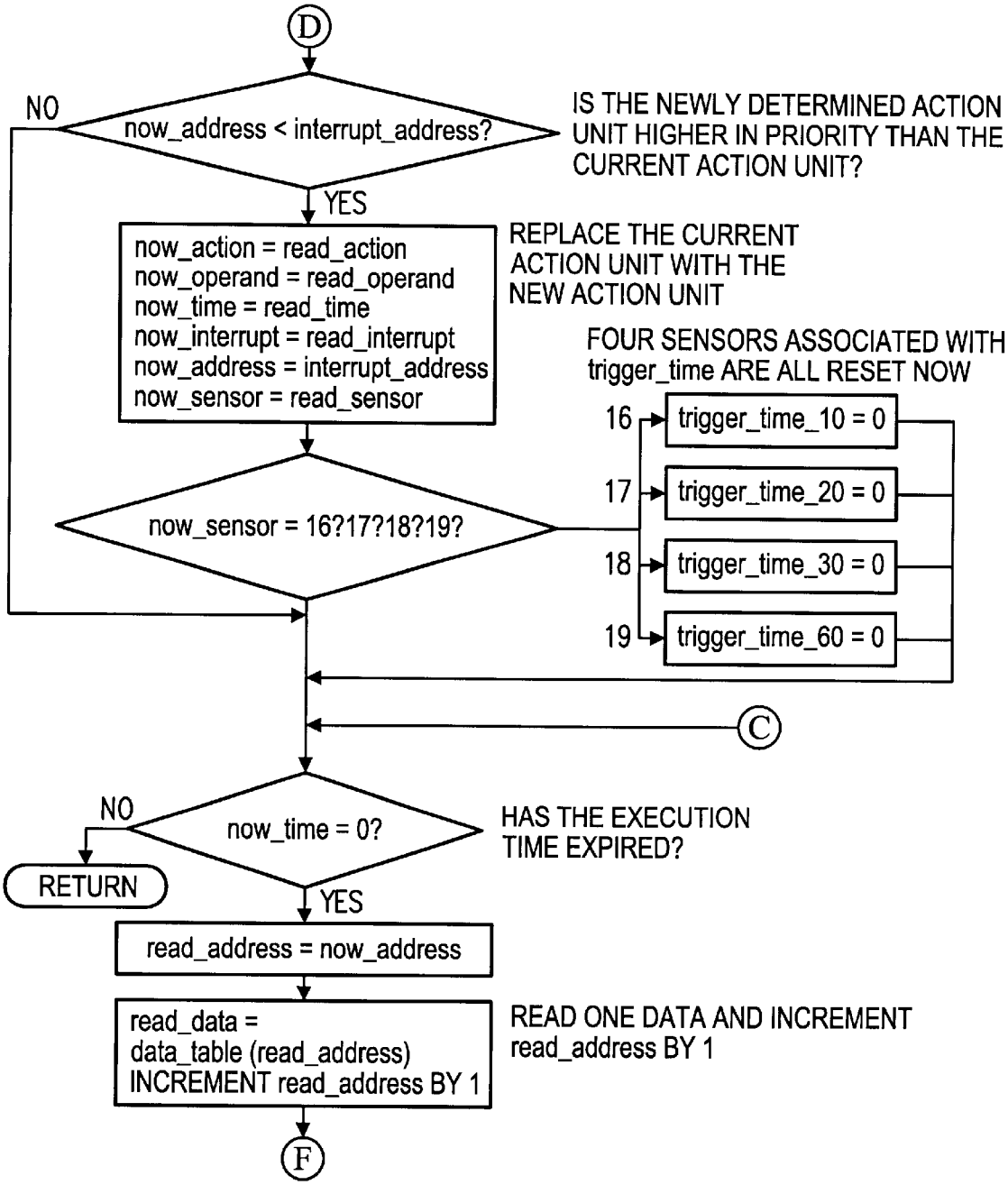
Figure 24D:
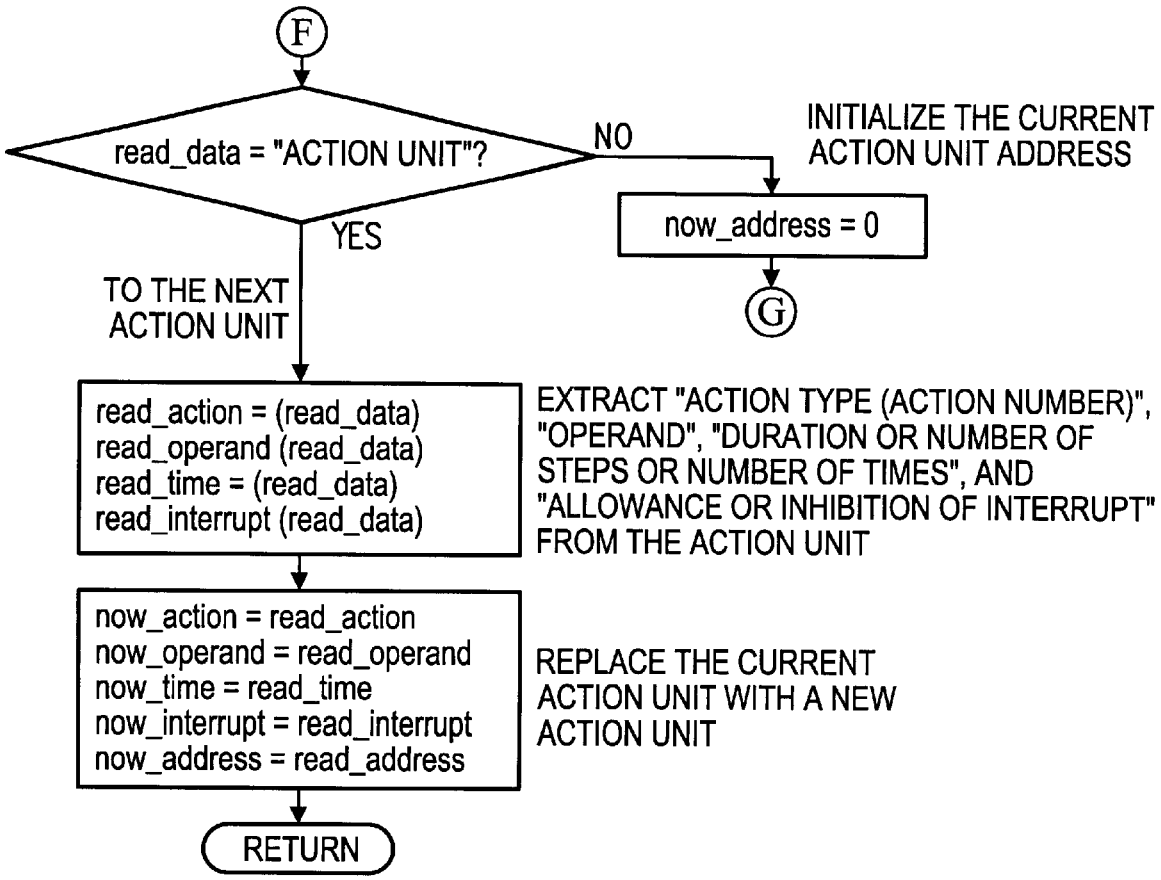

In the case where the sensor identifying unit indicated by the determined value of now-sensor is one of "10 seconds have elapsed", "20 seconds have elapsed", "30 seconds have elapsed", and "60 seconds have elapsed" indicated by sensor identifying unit numbers 16, 17, 18, and 19, respectively (FIG. 18) (n in FIG. 24C), the microcomputer 10 resets the trigger timers for counting 10 seconds, 20 seconds, 30 seconds, and 60 seconds, respectively (01 to 04 in FIG. 24C). In the other cases, the microcomputer 10 immediately checks whether now-time=0 (p in FIG. 24C) to decide whether the above-described action unit is currently being executed and the value of now-time is being decreasing from the assigned execution time toward 0. If the action unit is being executed and thus if the decision (p in FIG. 24C) is No, the flow returns to main routine (FIG. 20) via a return step (q in FIG. 24C). In this specific case, because "1" is assigned as the execution time to the action unit "move forward, one step, allowed", the determination result in this step (p in FIG. 24C) is No, and thus the flow returns to the main routine (FIG. 20) for the first time and execution of the action unit is started. In the main routine, now-time is reduced repeatedly (j in FIG. 20) in time intervals of 100 ms (d in FIG. 20), thereby ensuring that the action unit is continuously executed until now-time becomes 0 (p in FIG. 24C).

When the execution of the action unit of "move forward, one step, allowed" for the assigned execution time is completed, the decision of "now-time=0?" (p in FIG. 24C) becomes Yes. Thus, the microcomputer 10 reads the parameter read-address such that read-address=now-address (r in FIG. 24C), that is the value, "7", of now-address, stored in step m in FIG. 24C, is read as read-address. Thus, the value of read-address, which has been increased to "14" by this point of time, is changed to "7" in preparation for checking an action unit that may be disposed at some larger addresses of the instruction unit table after the action unit of "move forward, one step, allowed" at the address of "6".

Thereafter, the microcomputer 10 reads 'sensor identifying unit "collision with obstacle on the right"' from the instruction unit table at the address of "7" and then increments read-address to "8" (s in FIG. 24C). Thereafter, the microcomputer 10 makes a decision of "read-data=action unit?" (t in FIG. 24D). In this specific case, the decision is No, and thus now-address is reset to 0 (x and in FIG. 24D) and the process returns to step c of the flow shown in FIG. 24A via a path of G-G to check whether changes have occurred meanwhile in reaction states of the sensors associated with the sensor identifying units.

For example, if it assumed herein that a response of a sensor associated with the action unit of "collision with an obstacle on the left" at the address of "10" is detected when the action unit of "move forward, one step, allowed" at the address of "6" of the instruction unit table is being executed, the microcomputer performs the following process. That is, if the microcomputer 10 starts the action unit selection process under the conditions in which now-action=move forward, now-operand=0, now-time=one step, now-interrupt=allowed, now-address="7", now-sensor=sensor identifying unit "nothing is present", and interrupt-address "7", when until the action unit of "move forward, one step, allowed" has been executed via the process described above, the values of read-address and interrupt-address both become equal to "7" (k in FIG. 24B). The flow then returns to the step d in FIG. 24A via the path of B-B to check whether the next sensor identifying unit is responding (e in FIG. 24A). In this specific case, the sensor identifying unit at the address of "7" is not responding, and thus the microcomputer 10 advances the flow to check the sensor identifying unit of "collision with an obstacle on the left" at the address of "10". At this stage, the sensors associated with this sensor identifying unit are decided to be responding (g in FIG. 24A), and the process proceeds to the next address of "11" (h in FIG. 24B) to check the action unit (i and following steps in FIG. 24B). Herein, the action unit of "stop, one second, inhibited" at the address "11" is read as read-data, and read-address is incremented to "12" (h in FIG. 24B). Thus, parameters are extracted such that read-action=stop, read-operant=normal speed, read-time=one second, read-interrupt=0 (inhibited) (j in FIG. 24B), Herein, because read-address is "12", interrupt-address is rewritten to "12" (k in FIG. 24B). Thereafter, the microcomputer 10 returns to step d in FIG. 24A via the path of B-B. In step d in FIG. 24A, the end command at the address of "13" is read. If the microcomputer 10 detects the end command (e in FIG. 24A), the microcomputer 10 jumps to step 1 in FIG. 24C via the path of D-D. In step 1 in FIG. 24C, the microcomputer 10 makes a decision of "now-address<interrupt-address=1?". Herein, now-address, indicating the address next to the address of "6" for the action unit of "move forward, one step, allowed" which is currently being executed, is "7", and interrupt-address indicating the address next to the address of "11" for the new action unit of "stop, one second, inhibited" associated with the sensor identifying unit is "12". Thus, because interrupt-address is greater than now-address, the decision (l in FIG. 24C) becomes Yes. Therefore, the action unit at the address of "11" is decided to be higher in priority, and this action unit is read. As a result, parameters are extracted such that now-action=stop, now-operand =0, now-time=1 second, and now-interrupt=inhibited, and the contents of now-address and now-sensor are respectively changed to "12" and sensor identifying unit "collision with an obstacle on the left" (m in FIG. 24C).

Because an interruption against this action unit is not allowed, the decision of "now-time=0?" (p in FIG. 24C) is Yes, and another action unit is not selected until the execution of the current action unit is completed. When the execution of the current action unit is completed, the decision in step p in FIG. 24C becomes Yes. Thus the microcomputer 10 stores the value, "12", of now-address into read-address (r in step 24C) and reads the action unit of "turn to left, three steps, inhibited" at the address of "12". The microcomputer 10 then increments read-address to "13" (s in FIG. 24C). Thereafter, the microcomputer 10 makes a decision of "read-data=action unit"? (t in FIG. 24D) to check the following action unit. In this specific case, on the basis of the data of the action unit read from the address of "12" (u in FIG. 24D), parameters are updated and stored such that new-action=turn to right, now-operant=0, now-time=3 steps, now-interrupt=inhibited, and now-address="13" (v in FIG. 24D). Thereafter, the process returns to the main routine (w in FIG. 24D).

After returning to the main routine, the microcomputer 10 performs the action unit execution process (j in FIG. 20). To this end, the microcomputer 10 jumps to a unit action execution subroutine (a in FIG. 25A) to art the action unit execution process. Herein, the unit action execution process (FIGS. 25A to 25D) corresponds to the right-hand sides of the flow charts shown in FIGS. 6A and 6B and FIGS. 8A and 8B, for the execution of the output parameters of the respective action program units shown in FIGS. 7 and 8, whereby the action units shown in FIG. 19 are executed depending on the types thereof. Note that the above execution is defined by action units arbitrarily formed in terms of respective instruction units. It is thus the chief note of system that there is no fixed correspondence but arbitrarily presettable correspondence between the action unit and the sensor identifying unit associated with hardware sensors. Herein, now-action="number" denotes the type of the action unit (action unit number) currently selected and executed in the action unit selection process shown in FIGS. 24A to 24D, wherein this number corresponds to the type of the action (action number) shown in FIG. 19. Referring to the flow charts shown in FIGS. 25A to 25D, the action of "stop" having an action number of "0" shown in FIG. 19 is executed in steps b to c in FIG. 25A. In steps d to g in FIGS. 25A, the duty ratio of the actuator driving pulse for each of actions having action numbers of "0" to "9" is set depending on whether the operand is "1" or "0" such that when the operand is "1" the duty ratio is set to 100% so that the action is performed at a high speed, while, when the operand is "0", the duty ratio is set to 60% so that the action is performed at the normal speed. In steps h to i in FIG. 25A, the action of "move forward", having an action number of "1", is executed. In steps j to k in FIG. 25A, the action of "move backward", having an action number of "2", is executed. In steps l to m in FIG. 25A, the action of "turn to right", having an action number of "3", is executed. In steps n to o in FIG. 25A, the action of "turn to left", having an action number of "4", is executed. In steps p to q in FIG. 25B, the action of "curve to right", having an action number of "5", is executed. In steps r to s in FIG. 25B, the action of "curve to left", having an action number of "6", is executed. In steps t to u in FIG. 25B, the action of "move backward while curving to right", having an action number of "7", is executed. In steps v to w in FIG. 25B, the action of "move backward while curving to left", having an action number of "8", is executed. In steps x to y in FIG. 25B, the action of "turn to right or left", having an action number of "9", is executed. In steps Z to Zb in FIG. 25B, the action of "struggle", having an action number of "10", is executed. In steps Zc to Zd in FIG. 25C, the action of "threaten", having an action number of "11", is executed. In steps Ze to Zf in FIG. 25C, the action of "greet", having an action number of "12", is executed. In steps Zg to Zi in FIG. 25C, the action of "squeak", having an action number of "13", is executed, wherein the more detailed manner of squeaking is specified by the value of the operand such that "squeak-1" is specified by the operand of "0" (Zi1 in FIG. 25C), "squeak-2" is specified by the operand of "1" (Zi2 in FIG. 25C), "squeak-3" is specified by the operand of "2" (Zi3 in FIG. 25C), and "squeak-4" is specified by the operand of "3" (Zi4 in FIG. 25C). For the purpose of squeaking, as shown in a block diagram of FIG. 28, a speaker 20 for generating a squeaking sound is connected to an output port #9 of the microcomputer 10 so that a squeaking signal having a frequency and a waveform depending on the value of the operand is supplied to the speaker thereby generating a specified squeaking sound. More specifically, when the operand is "0", a squeaking signal having a sinusoidal waveform whose frequency is gradually increased is supplied so as to generate a sound of "squeak-1" that may be perceived by human ears like "kyuuuh". In the case where the operand is "1", a squeaking signal having a rectangular waveform whose frequency is gradually increased is supplied so as to generate a sound of "squeak-2" that may be perceived by human ears like "gyuuuh". When the operand is "2", a squeaking signal having a sinusoidal waveform whose frequency is alternately changed is supplied so as to generate a sound of "squeak-3" that may be perceived by human ears like "kyuhkyuh". In the case where the operand is "3", a squeaking signal having a rectangular waveform whose frequency is alternately changed is supplied so as to generate a sound of "squeak-4" that may be perceived by human ears like "gyulyuuuh".

Figure 25A:
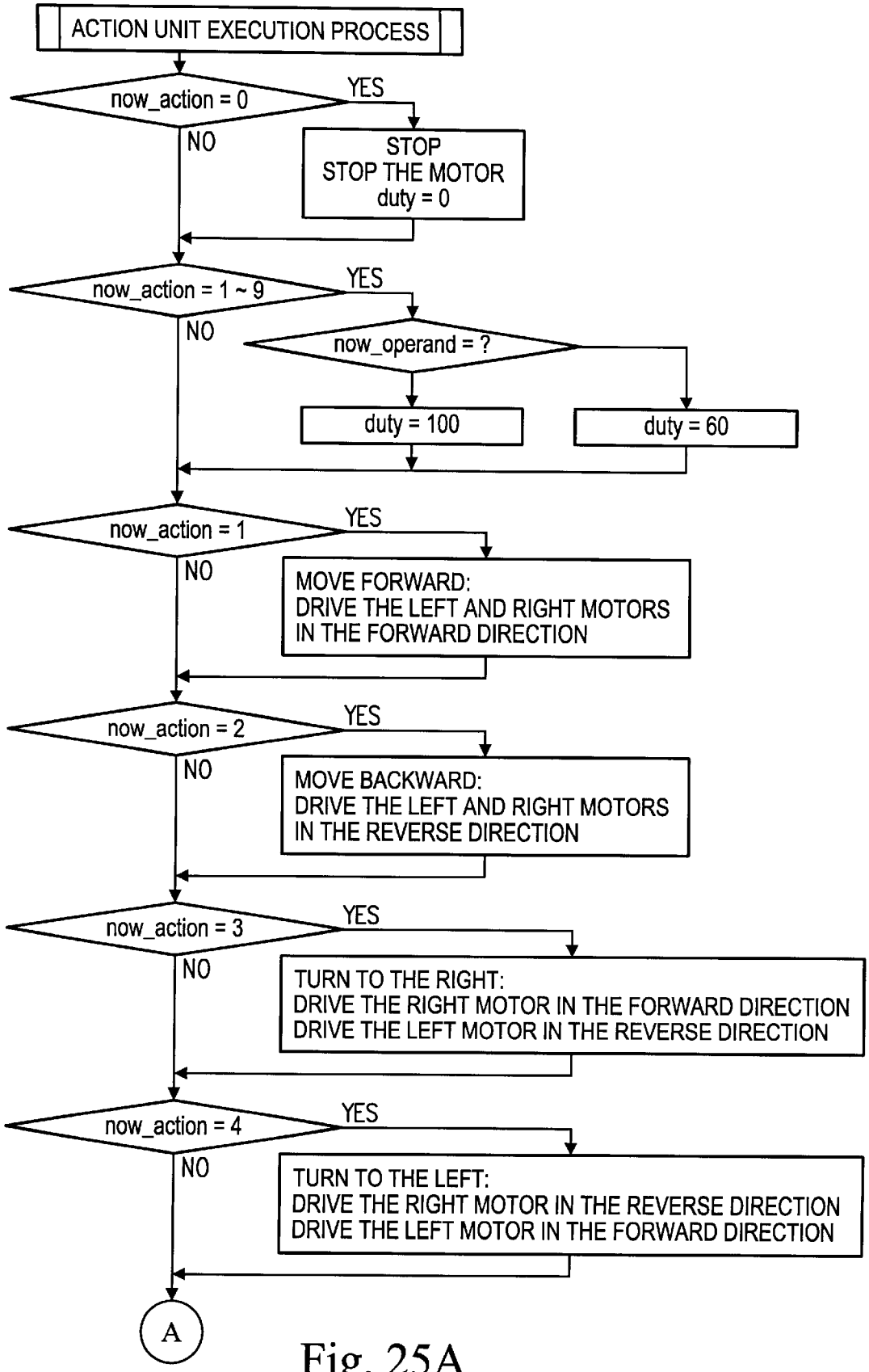
FIGS. 25A, 25B, 25C, and 25D are flow charts of an action unit selection process.
Figure 25B:
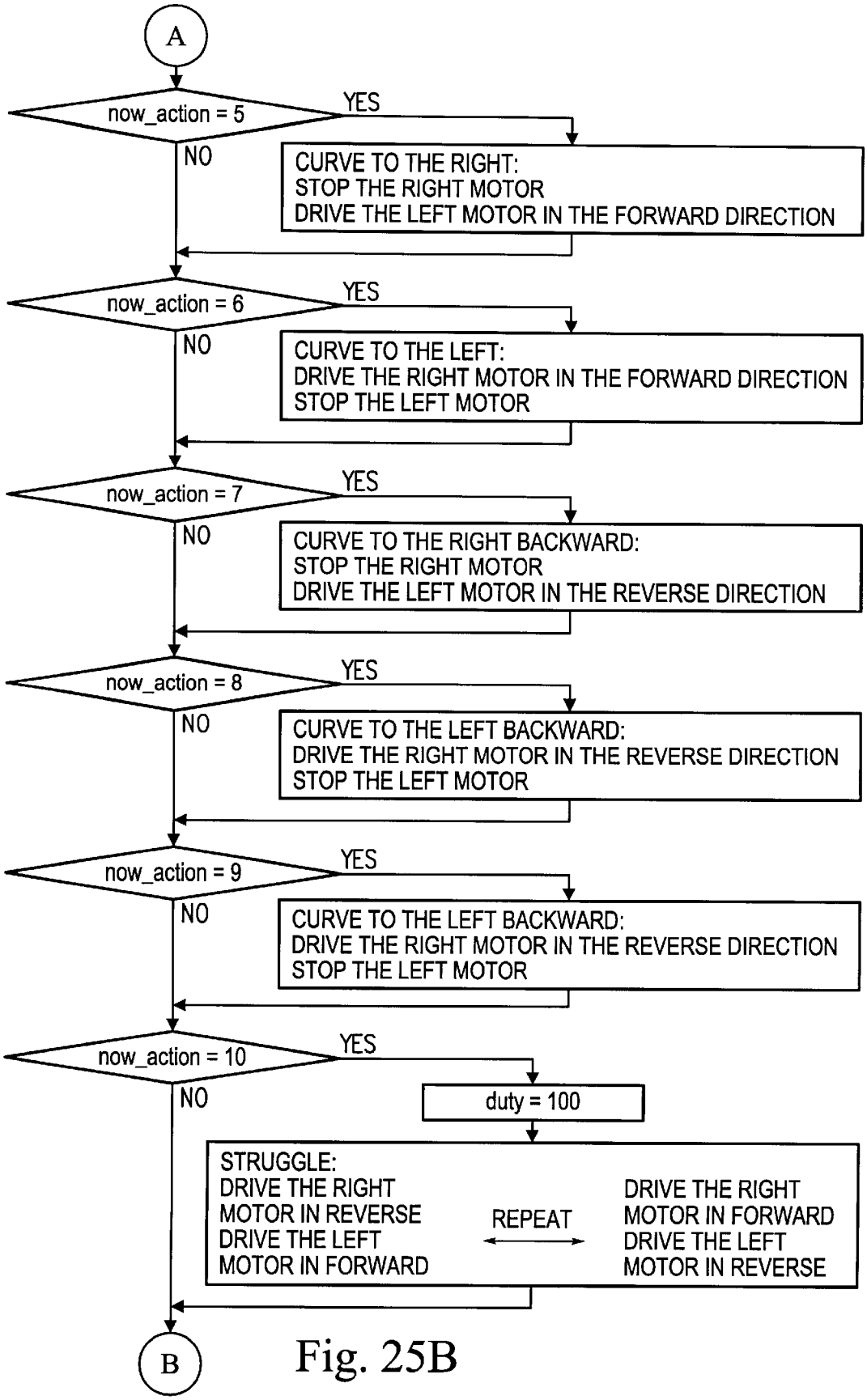
Figure 25C:
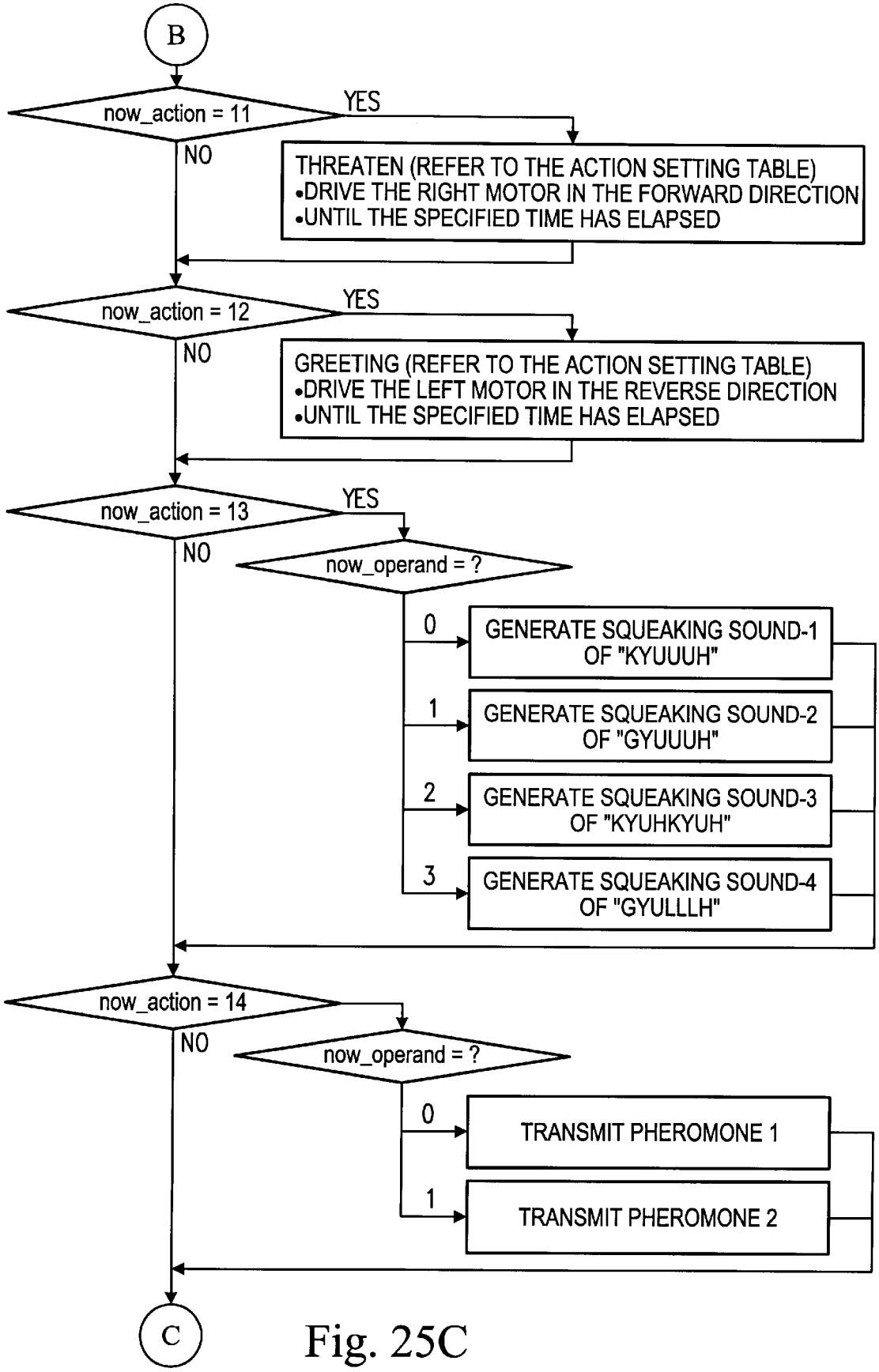
Figure 25D:
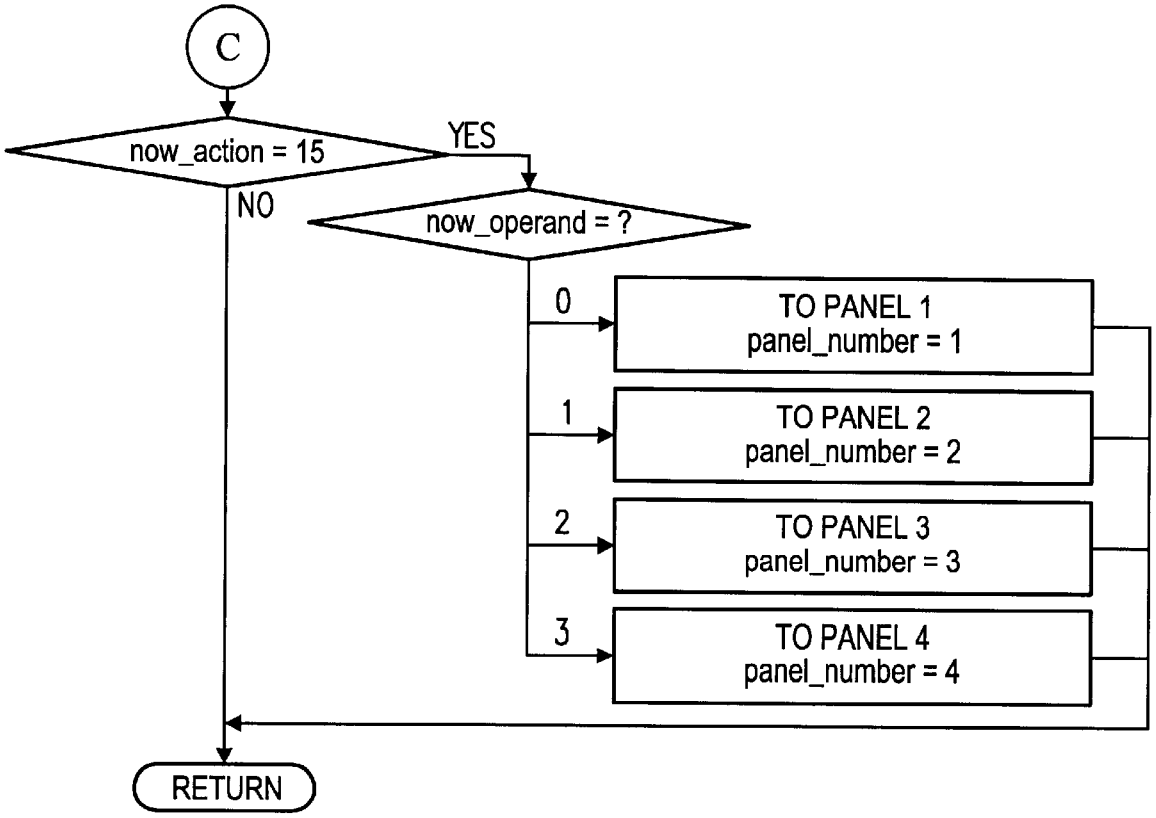

In steps Zj to Z12 in FIG. 25C, the action of "transmit notification pheromone", having an action number of "14" is executed, wherein notification pheromone-1 is transmitted when the operant is "0" (Z11 in FIG. 25C), while notification pheromone-2 is transmitted when the operant is "1" (Z12 in FIG. 25C). In steps Zm to Z04 in FIG. 25D, the action of "to a specified panel", having an action number of "15" is executed, wherein the panel number is specified by the operand such that "panel 1" is specified by the operand of "0", "panel 2" is specified by the operand of "1", "panel 3" is specified by the operand of "2", and "panel 4" is specified by the operand of "3".

The process of transmitting pheromone in steps Zj to Z12 in FIG. 25C is performed in cooperation with the pheromone signal transmitting means E realized by the pheromone signal transmission process (f in FIG. 20) performed in the main routine. Furthermore, the panel designation signal generation means R is realized by the panel switching process in steps Zn to Zo4 in FIG. 25D.

Figure 26:
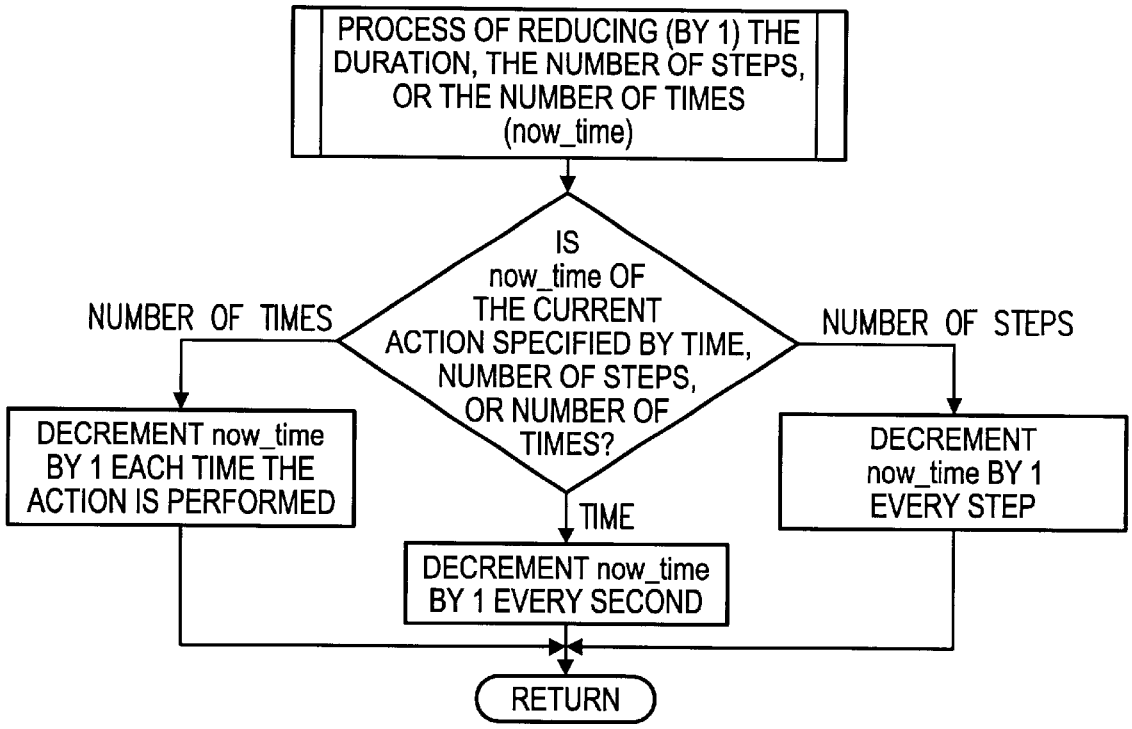
Figure 27:
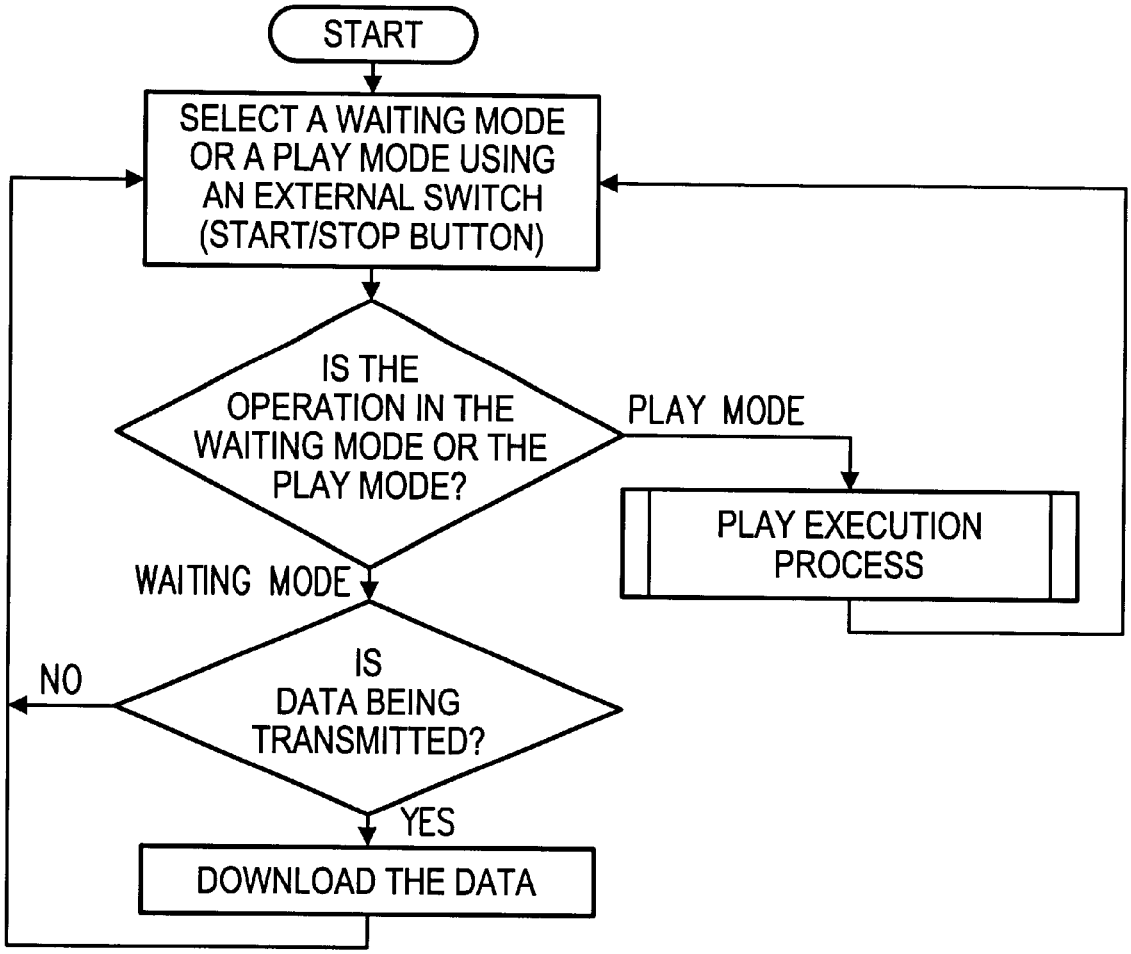

After completion of the execution of the action units, the microcomputer 10 returns to the main routine (Zp in FIG. 25D) and jumps to a subroutine shown in FIG. 26 (a in FIG. 26A) to decrement (by 1) the duration/number of steps/number of times (now-time) which controls the execution time. In the subroutine, the microcomputer 10 decides whether now-time of the action unit currently being executed is specified by the "number of times", "time", or "number of steps" (b in FIG. 26). If now-time is specified by the "number of time", now-time is decremented (by 1) each time execution is performed (c in FIG. 26). In the case where now-time is specified by the "time", now-time is decremented every second (e in FIG. 26). If now-time is specified by the "number of steps", now-time is decremented every step (e in FIG. 26). Thereafter, the flow returns to the main routine (d in FIG. 26).

Thus, the action unit execution means D is realized by the main steps (steps b to o in FIG. 25A, steps p to Zb in FIG. 25B, and steps Zc to Zi4 in FIG. 25C) of the action unit execution process described above and the process, in the main routine, of decrementing (by 1) the duration/number of steps/number of times (now-time) (i in FIG. 20).

After returning to the main routine, the microcomputer 10 decides whether a START/STOP button is pressed (k in FIG. 20). The main routine is executed repeatedly until the START/STOP button is pressed, whereby the play execution process is continuously proceeds with. When the START/STOP button is pressed to the STOP side, the decision result (in step k in FIG. 20) becomes Yes, and thus flow returns to the management routine shown in FIG. 27.

Figure 31K:
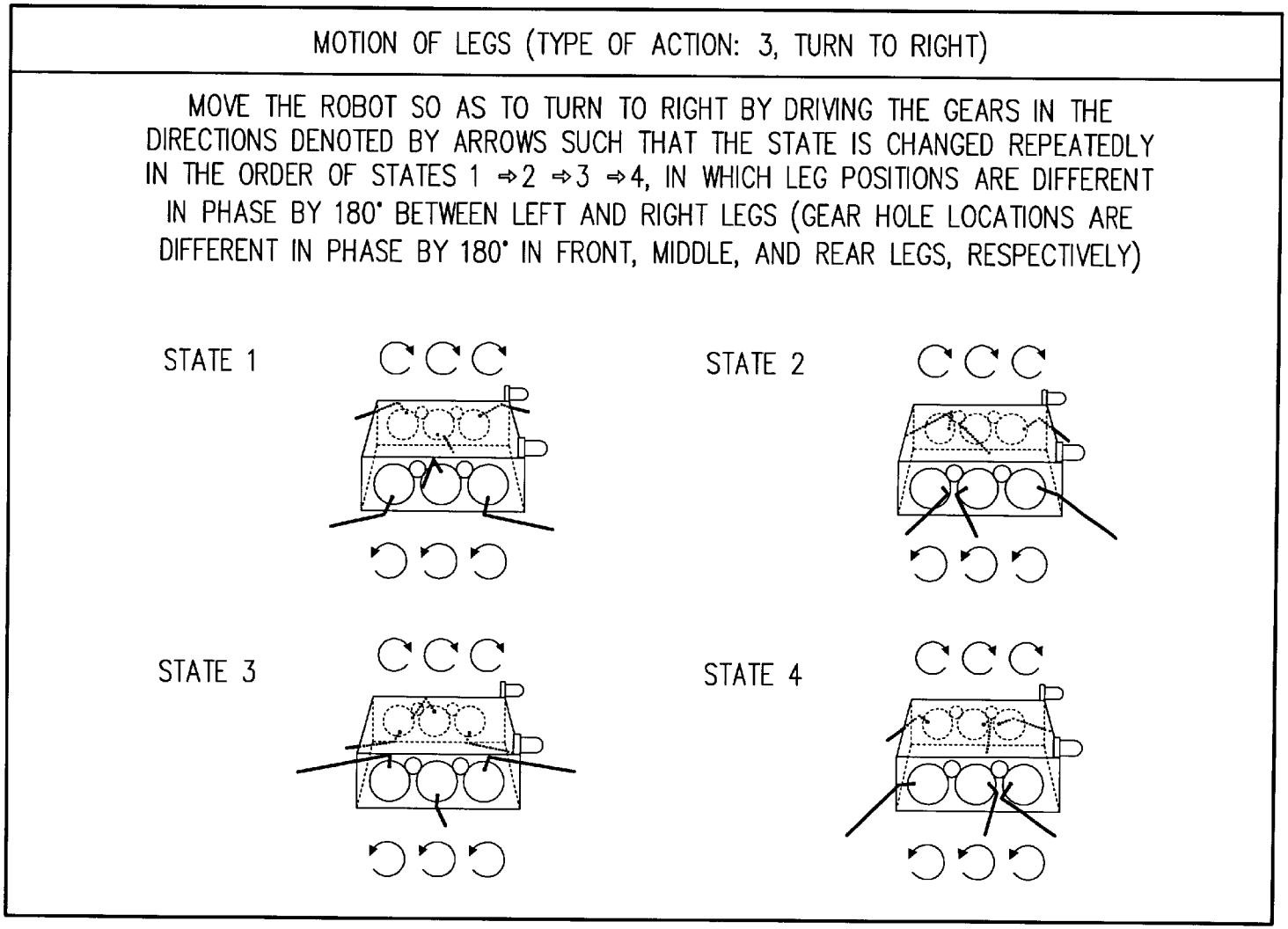
FIG. 31K is a diagram showing leg motions in the "right turn" shown in FIG. 31B.
Figure 31M:
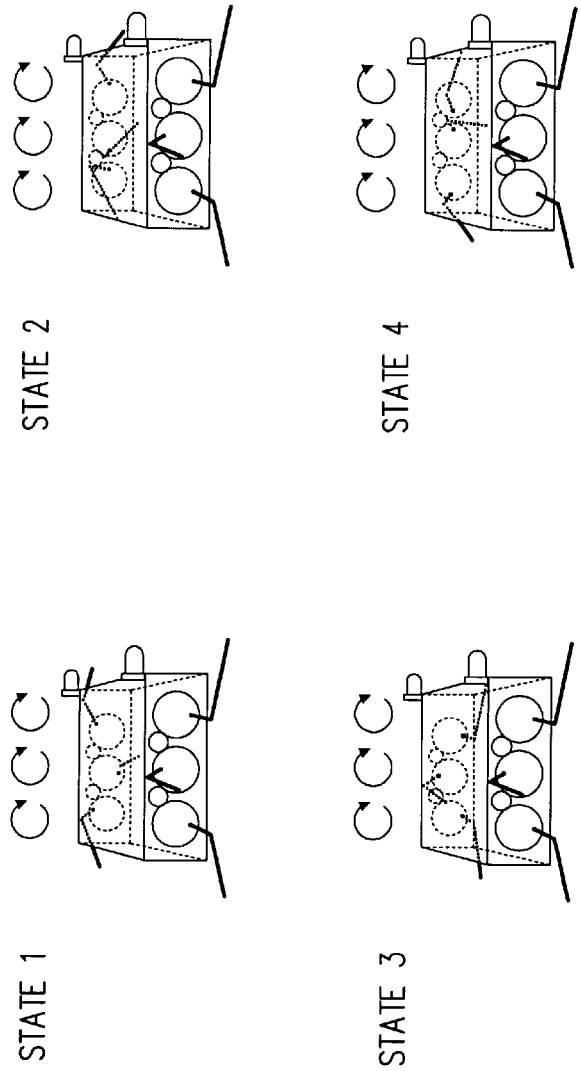
FIG. 31M is a diagram showing leg motions in the "gradual right turn" shown in FIGS. 31B and 31C.
Figure 31N:
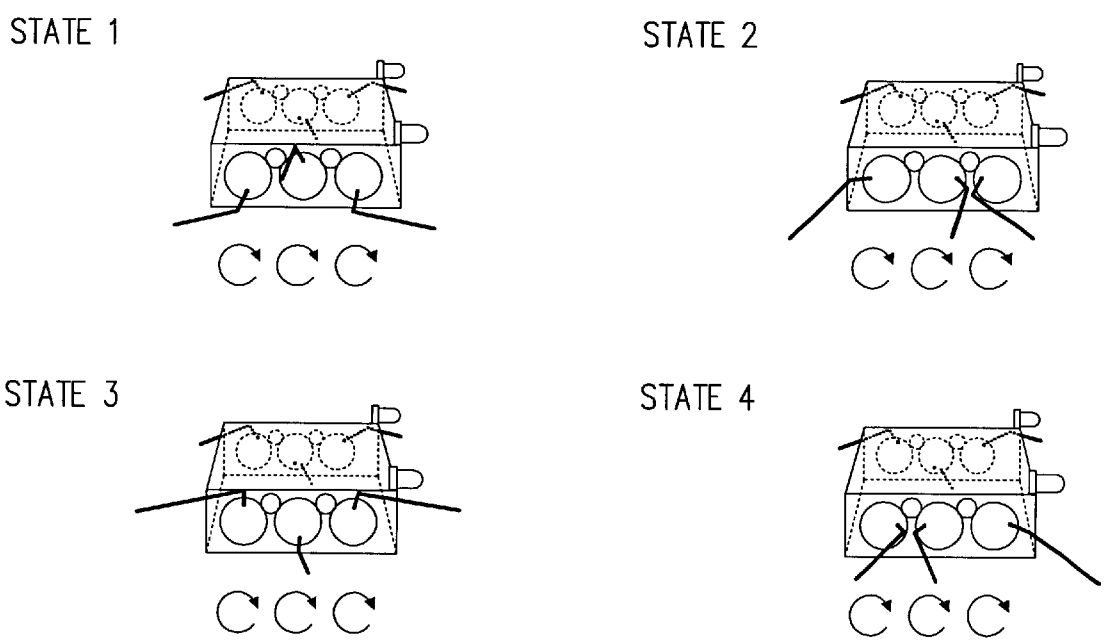
FIG. 31N is a diagram showing leg motions in the "gradual left turn" shown in FIG. 31C.
Figure 32A:
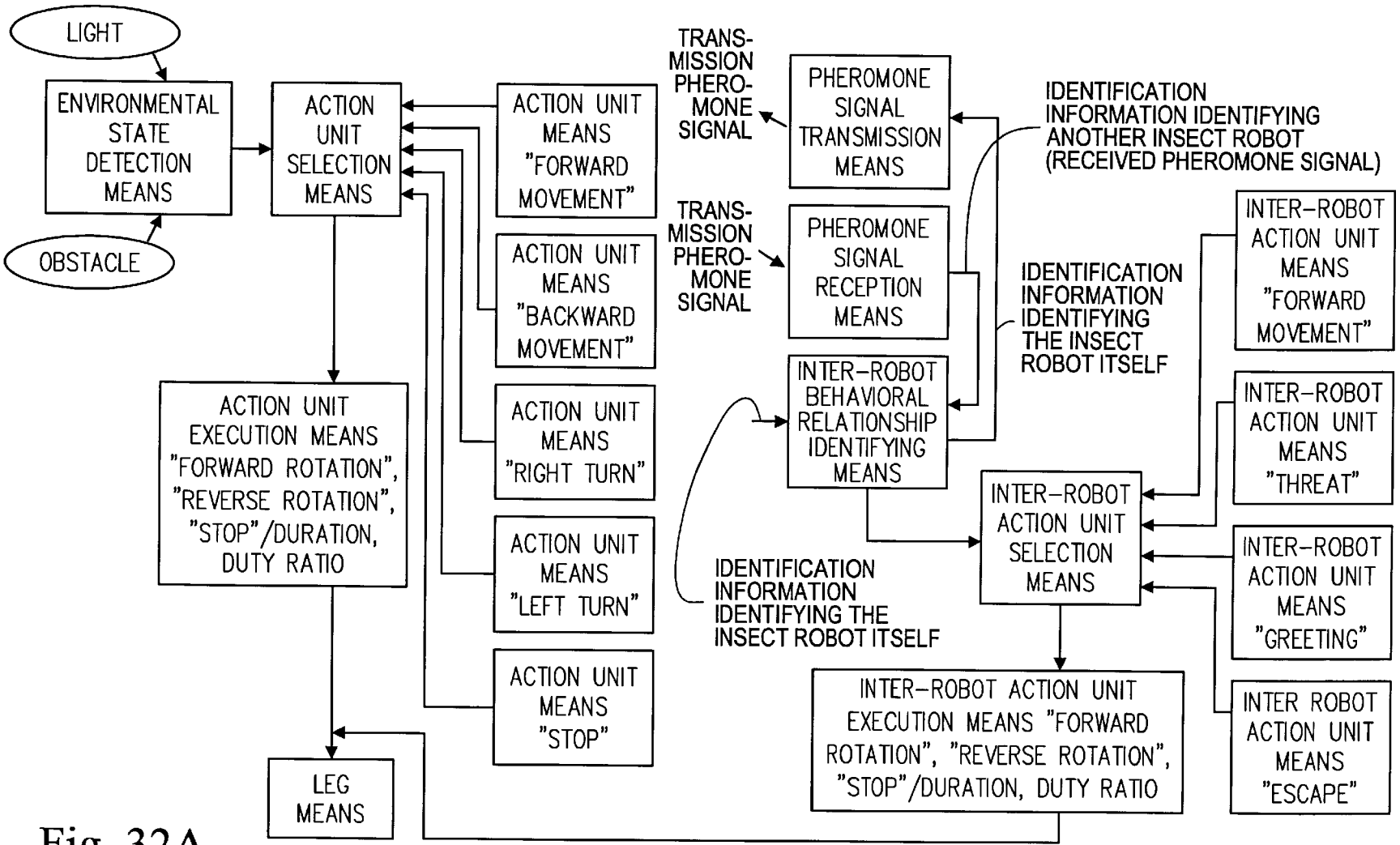
Figure 32B:
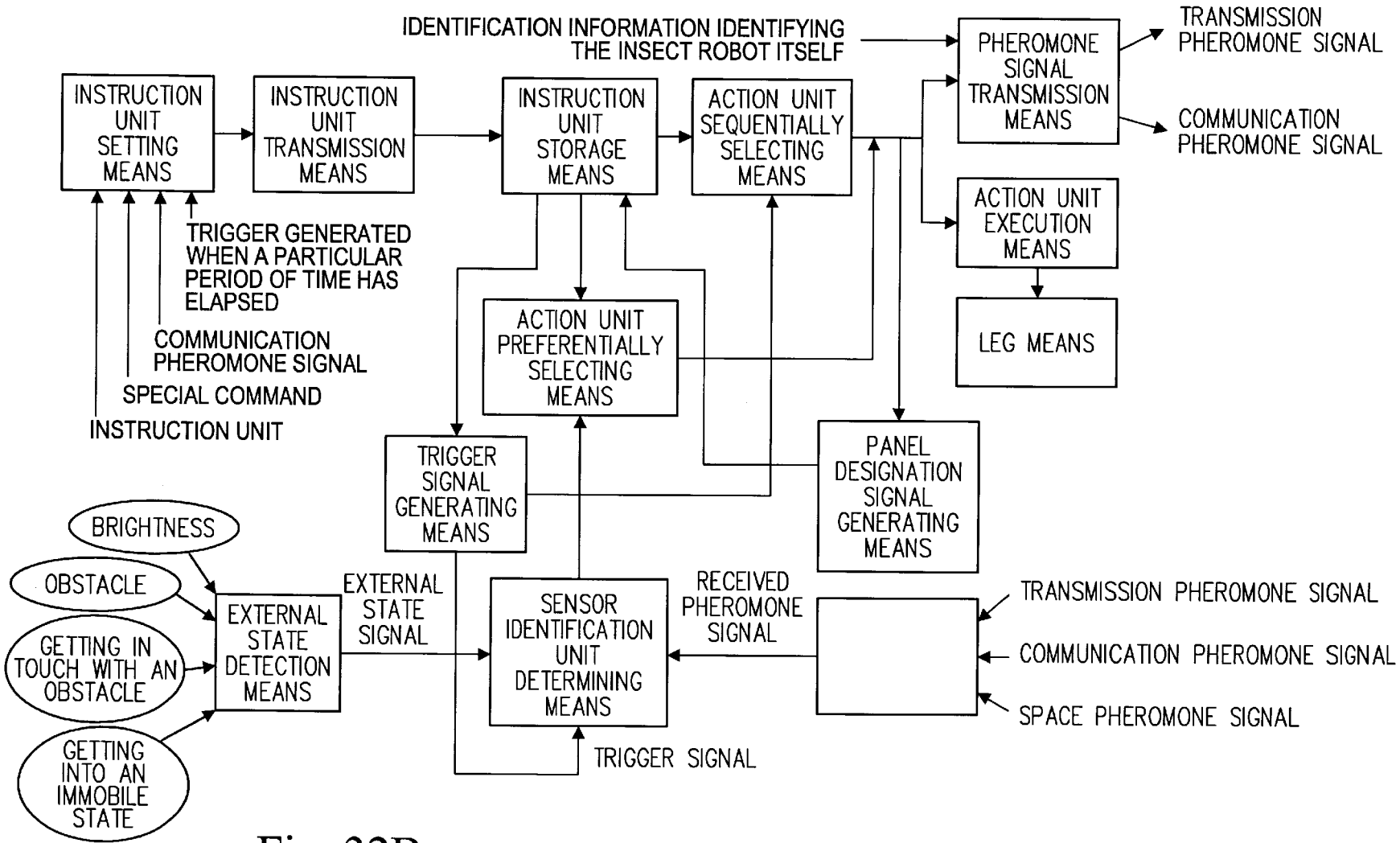

FIGS. 31A to 31S are diagrams illustrating the manners of controlling the driving mode ("forward", "reverse", "stop") of the driving motor of left and right leg driving wheels 7*a*, 7*b*, 7*c*, 8*a*, 8*b*, and 8*c* and controlling the squeak speaker in respective action units of various types executed in the action unit execution process described above, that is, in action units of various types listed in FIG. 18, wherein these diagrams correspond to the diagrams shown in FIGS. 10A to 10C illustrating the manners of controlling the motor in respective action units. Note that some of FIGS. 31A to 31S are divided into two pages because of the limited area of drawing pages. More specifically, FIGS. 31I to 31S are parts of FIGS. 31A to 31E, respectively, and the correspondence between two groups of figures is ensured by the correspondence between a description with a caption of "ACTION NAME" appearing in FIGS. 31A to 31E and that with a caption of "MOTION OF LEGS" appearing in FIGS. 31I to 31S.

The START/STOP button 19, which is monitored in the main routine as to whether it is pressed (k in FIG. 20), is disposed, as shown in FIG. 28, on the insect robot so that it can be pressed from the outside. The contact output of the START/STOP button 19 is connected to the input port #7 of the microcomputer 10. After returning to the management routine (a in FIG. 27), the microcomputer 10 decide whether an operator has pressed the START/STOP button to the STOP side to select the waiting mode or to the START side to select the play mode. If pressing of the START/STOP button is detected (b in FIG. 27), it is decided whether the START/STOP button is pressed into the waiting mode or the play mode (c in FIG. 27). If the START/STOP button is decided to be pressed into the play mode, the flow enters the main routine to execute the play execution process (f in FIG. 27 or a in FIG. 20) as described above. However, in the case where the START/STOP button is decided to be pressed into the waiting mode (c in FIG. 27), for example, instruction units grouped in a panel set by the instruction unit setting means L realized on a portable computer which is disposed separately from the insect robot are downloaded into the computer 10 disposed in the insect robot by means of a common data transfer technique (e in FIG. 27).

Figure 29:
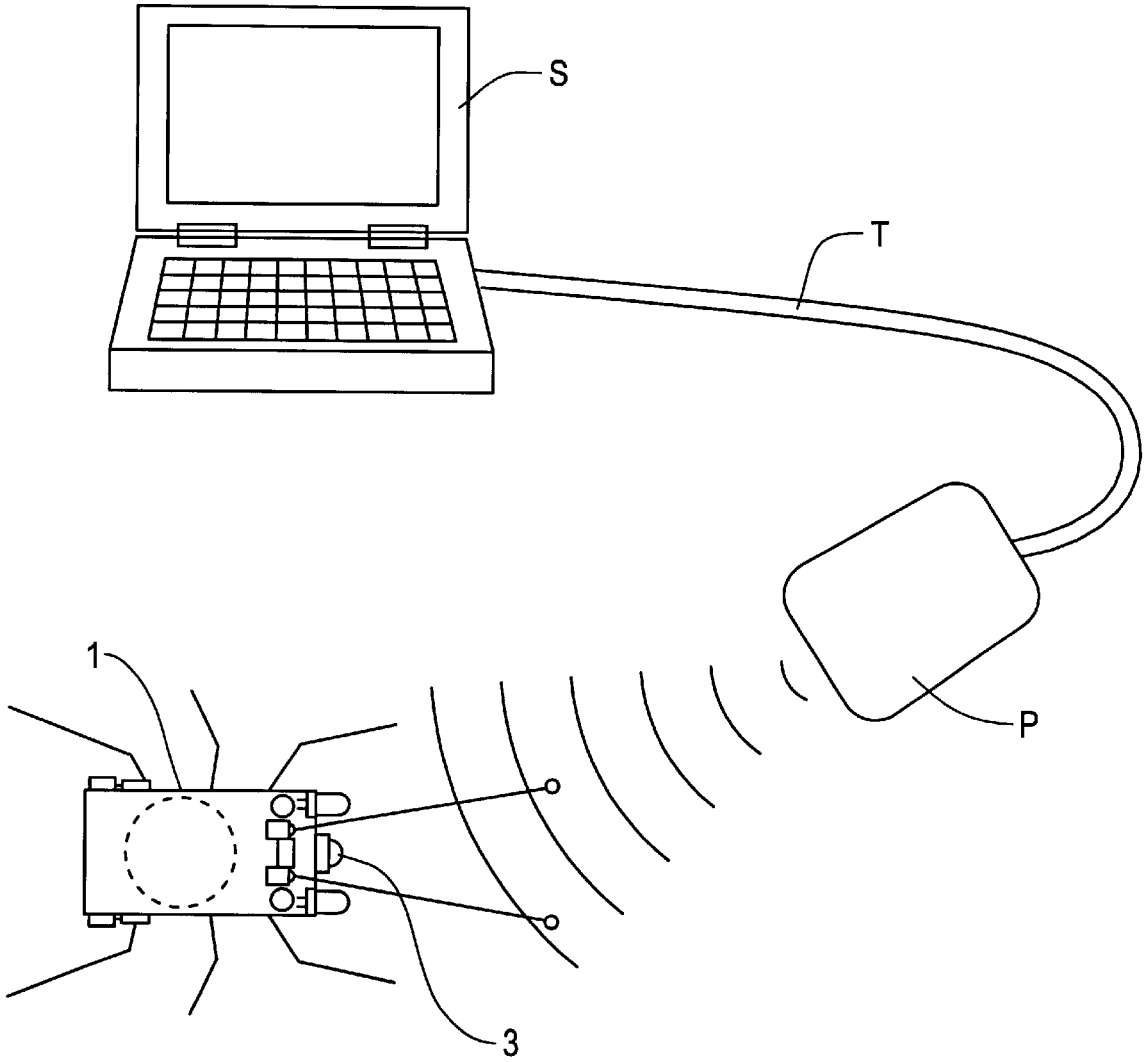
Figure 30:
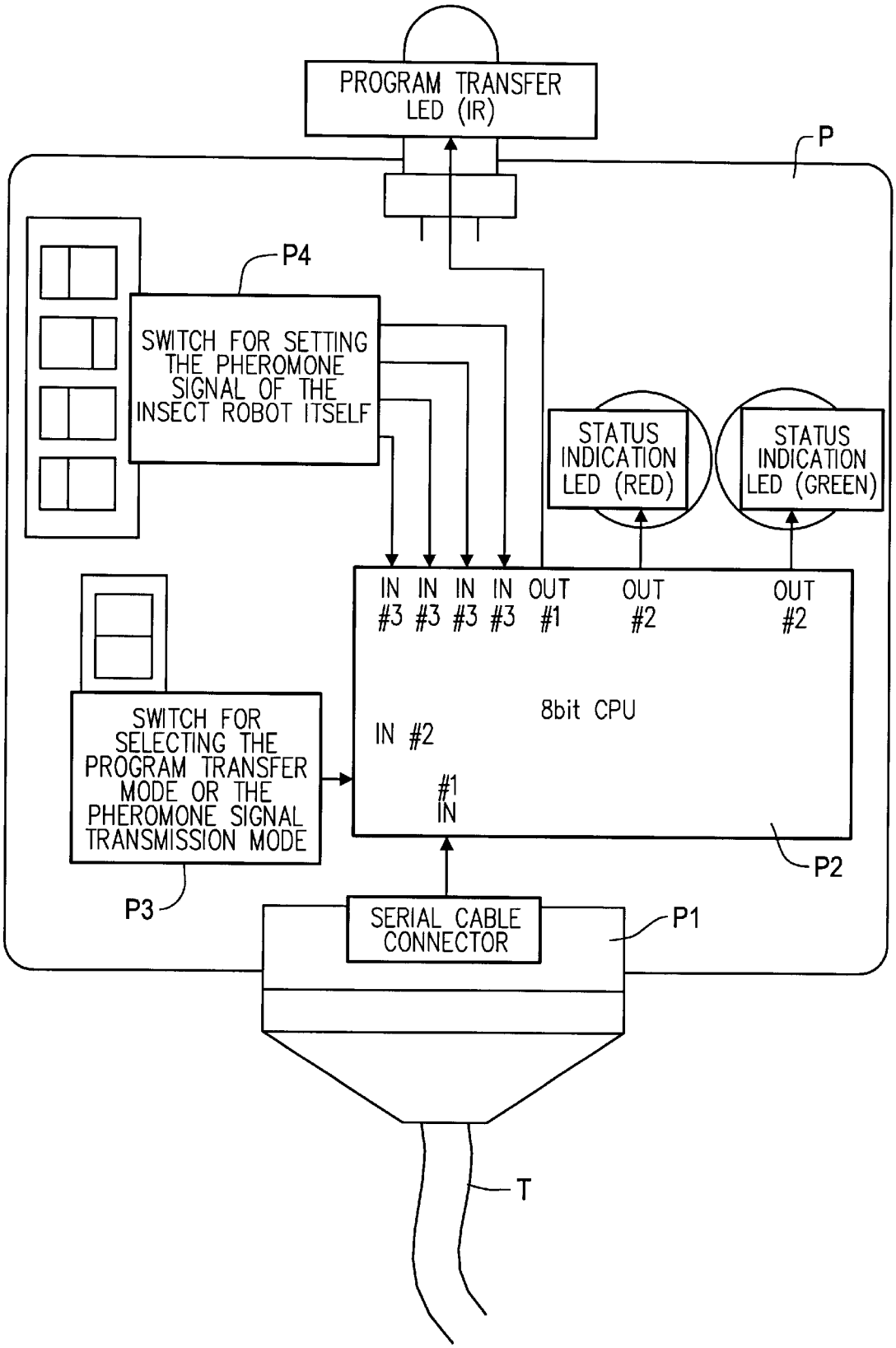

FIG. 29 illustrates an example of a manner of downloading. Via a serial communication cable T extending from a communication control unit or a modem disposed in the portable computer S, a program transfer unit P is connected to the portable computers S on which the instruction unit setting means L is realized. A light ray emitted from an LED disposed on the program transfer unit P is detected by the phototransistor 3 disposed on the front side of the casing 1 of the insect robot, whereby a program is transferred to the insect robot in a non-contact fashion. In the inside of the program transfer unit P, as shown in FIG. 30, the serial communication cable T extending from the portable computer S is connected to an input port IN-#1 of a microcomputer P2 via a connector P1 so that a program transfer signal carrying the instruction units grouped on a panel set by the instruction unit setting means L realized on the portable computer S is input to the microcomputer P2 of the program transfer unit P. A selection switch P3 is connected to another input port IN-#2 of the microcomputer P2. By operating the selection switch P3, it is possible to manually switch the operation mode between a mode in which the program transfer is performed and a mode in which the insect robot's pheromone signal is set. Only when the insect robot's pheromone setting mode is selected, a selection switch P4 for setting the type of the insect robot's pheromone signal is also connected to an input port IN-#3 of the microcomputer P2. Via the program transfer unit P constructed in the above-described manner, instruction units assembled on the portable computer S can be downloaded to the microcomputer 10 disposed in the insect robot in a non-contact fashion. Furthermore, an operation state indication LED, capable of emitting light to indicate the operation state such as a state in which a program is being transferred, is connected to an output port out-#2 of the microcomputer P2 of the program transfer unit P.

At the end of the present specification, a table is appended in which parameters used in the program of the microcomputer 10 of the insect robot are listed.

INDUSTRIAL APPLICABILITY

In the aspects of the present invention according to claims 1 to 8, as described above, there is provided an insect robot capable of behaving in a vivid and realistic manner by achieving various combinations of a large number of behavior patterns depending on the environmental state and/or in response to detection of another insect robot, without causing increases in complexity and size of a computer program; and in the aspects of the present invention according to claims 9 to 16, there is provided an insect robot the character of which is changed from time to time in accordance with the will of a user, thereby making the insect robot very attractive as a hobby toy; whereby the present invention has very high industrial applicability.

DESCRIPTIONS OF PARAMETERS

| | | |
|---|---|---|
| 1 | read_address | address of a memory from which data is to be read |
| 2 | read_data | data which has been read (action unit) |
| 3 | read_sensor | sensor data extracted from read_data (sensor identifying unit number (0 to 19)) |
| 4 | read_action | action data extracted from read_data (action type (action number) (0 to 15)) |
| 5 | read_time | data extracted from read_data, indicating the execution time of an action, the number of steps, or the number of times (execution time or number of steps or number of times (1 to 63)) |
| 6 | read_operand | data extracted from read_data, indicating an auxiliary value of an action (walking speed, kind of pheromone/chirping) (0 to 3 in operand) |
| 7 | read_interrupt | data extracted from read_data, indicating whether interruption is allowed (1) or inhibited (0) (interrupt |

-continued

| DESCRIPTIONS OF PARAMETERS | | |
|---|---|---|
| | | allowance or inhibition (0 to 1)) |
| 8 | now_address | address of a current action unit (plus 1) |
| 9 | now_action | data indicating an action unit currently being executed (action type (action number) (0 to 15)) |
| 10 | now_time | data indicating execution time, the number of steps, or the number of times, for an action unit currently being executed (execution time or number of steps or number of times (1 to 63)) |
| 11 | now_operand | data indicating an auxiliary value of an action (walking speed, kind of pheromone/chirping) (0 to 3 in operand) |
| 12 | now_interrupt | data indicating whether interruption of an action unit currently being executed is allowed (1) or inhibited (0) (interrupt allowance or inhibition (0 to 1)) |
| 13 | now_sensor | sensor identifying unit that has triggered an action currently being executed |
| 14 | panel_number | panel number currently employed |
| 15 | interrupt_address | memory address of an action unit which has issued a request for interrupt |
| 16 | time_10 | 10-sec time counter |
| 17 | time_20 | 20-sec time counter |
| 18 | time_30 | 30-sec time counter |
| 19 | time_60 | 60-sec time counter |
| 20 | trigger_time_10 | data indicating whether 10 seconds have elapsed (1) or not elapsed (0) |
| 21 | trigger_time_20 | data indicating whether 20 seconds have elapsed (1) or not elapsed (0) |
| 22 | trigger_time_30 | data indicating whether 30 seconds have elapsed (1) or not elapsed (0) |
| 23 | trigger_time_60 | data indicating whether 60 seconds have elapsed (1) or not elapsed (0) |
| 24 | pheromone1 | data indicating whether pheromone emitted from an insect robot of type A has been detected (1) or not detected (0) |
| 25 | pheromone2 | data indicating whether pheromone emitted from an insect robot of type B has been detected (1) or not detected (0) |
| 26 | pheromone3 | data indicating whether pheromone emitted from an insect robot of type C has been detected (1) or not detected (0) |
| 27 | pheromone4 | data indicating whether notification pheromone-1 (for calling an associate) has been detected (1) or not detected (0) |
| 28 | pheromone5 | data indicating whether notification pheromone-2 (for threatening an associate) has been detected (1) or not detected (0) |
| 29 | pheromone6 | data indicating whether space pheromone-1 (flower pheromone) has been detected (1) or not detected (0) |
| 30 | left_eye | data indicating whether the left eye has detected (1) or not detected (0) reflected infrared light |
| 31 | right_eye | data indicating whether the right eye has detected (1) or not detected (0) reflected infrared light |
| 32 | front_eye | data indicating whether both left and right eyes have detected (1) or not detected (0) reflected infrared light |
| 33 | dark | data indicating whether a region in front of the insect robot is dark (1) or not dark (0) |
| 34 | bright | data indicating whether a region in front of the insect robot is light (1) or not light (0) |
| 35 | left_touch | data indicating whether something is in contact with the left touch sensor (1) or not (0) |
| 36 | right_touch | data indicating whether something is in contact with the right touch sensor (1) or not (0) |
| 37 | front_touch | data indicating whether something is in contact with both the left and right touch sensors (1) or not (0) |

-continued

| DESCRIPTIONS OF PARAMETERS | | |
|---|---|---|
| 38 | do_not_work | data indicating whether the insect robot cannot move against its will (1) or can move (0) |
| 39 | data_table (address) | data returned from an address represented in parentheses |
| 40 | sensor (sensor number) | data indicating whether a sensor indicated by a sensor number in parentheses is responding (1) or not (0) |
| 41 | timer_count | timer sensor data indicating a timer count which increases every 100 ms and is reset to 0 when the timer count has reached 60 sec |

What is claimed is:

1. An insect robot comprising:

environmental state detection means A for detecting the environmental state of action space of the insect robot and outputting an environmental state signal;

a plurality of action unit means B for defining, at least, a type of an action of the insect robot and a duration of the action;

action unit selection means C for selecting one action unit means B from the plurality of action unit means B in accordance with the environmental state signal;

action unit execution means D for driving an actuator so as to execute the action defined by an action unit selected by the action unit selection means C for the duration of the action; and leg means 8 and 9 that are moved by actuators 13 and 14 driven by the action unit execution means D so that the insect robot performs the action for the duration of the action.

2. An insect robot according to claim 1, wherein the environmental state detection means A detects an obstacle in the action space and outputs an obstacle state signal as the environmental state signal and also detects lightness in the action space and outputs a lightness state signal as an environmental state signal.

3. An insect robot according to claim 1, wherein the plurality of action unit means B respectively define one of "forward movement", "backward movement", "right turn", "left turn", and "stop", as the type of the action of the insect robot and also define the duration and the execution speed of the defined action.

4. An insect robot according to claim 1, wherein the action unit selection means C selects one of the plurality of action unit means B in accordance with priorities preassigned to the respective action unit means B.

5. An insect robot according to claim 1, wherein the action unit execution means D drives motors serving as the actuators 13 and 14, respectively, in each of driving modes, "forward rotation", "reverse rotation", and "stop", preassigned to each type of actions "forward movement", "backward movement", "right turn", "left turn", and "stop" with a duty ratio corresponding to the execution speed of an action being executed for the duration of the action.

6. An insect robot according to claim 1, further comprising:

pheromone signal transmitting means E for transmitting, into the action space, a pheromone signal representing identification information uniquely preassigned to the insect robot;

pheromone signal receiving means F for receiving a pheromone signal transmitted from pheromone signal transmitting means E of another insect robot present in the action space, the pheromone signal representing identification information uniquely preassigned to said another insect robot;

inter-robot behavioral relationship identifying means G for identifying an inter-robot behavioral relationship predefined between the insect robot itself and said another insect robot, on the basis of the identification information associated with said another insect robot represented by the received pheromone signal and the identification information associated with the insect robot itself;

a plurality of inter-robot action unit means H for defining, at least, a type of an inter-robot action of the insect robot and a duration of the inter-robot action;

inter-robot action unit selection means I for selecting one inter-robot action unit means H from the plurality of inter-robot action unit means H in accordance with the inter-robot behavioral relationship identified by the inter-robot behavioral relationship identifying means G;

inter-robot action unit execution means J for driving an actuator so as to execute the inter-robot action defined by an inter-robot action unit selected by the inter-robot action unit selection means I for the duration of the inter-robot action; and leg means 8 and 9 that are moved by actuators 13 and 14 driven by the inter-robot action unit execution means J so that the insect robot performs the inter-robot action for the duration of the inter-robot action.

7. An insect robot according to claim 6, wherein the plurality of inter-robot action unit means H respectively define one of "forward movement", "threat", "greeting", and "escape", as the type of the inter-robot action of the insect robot itself and also define the duration and the execution speed of the defined inter-robot action.

8. An insect robot according to claim 7, wherein the action unit selection means C includes "coward"-type action unit selection means I or "reckless"-type action unit selection means I, the "coward"-type action unit selection means I serving to select one action unit means or one inter-robot action unit means from the plurality of action unit means B or the plurality of inter-robot action unit means H in accordance with priorities predefined for the "coward" type with respect to the respective action unit means B and respective inter-robot action unit means H, the "reckless"-type action unit selection means I serving to select one action unit means or one inter-robot action unit means from the plurality of action unit means B or the plurality of inter-robot action unit means H in accordance with priorities predefined for the "reckless" type with respect to the respective action unit means B and respective inter-robot action unit means H.

9. An insect robot according to claim 6, wherein the action unit selection means C includes "coward"-type action unit selection means I or "reckless"-type action unit selection means I, the "coward"-type action unit selection means I serving to select one action unit means or one inter-robot action unit means from the plurality of action unit means B or the plurality of inter-robot action unit means H in accordance with priorities predefined for the "coward" type with respect to the respective action unit means B and respective inter-robot action unit means H, the "reckless"-type action unit selection means I serving to select one action unit means or one inter-robot action unit means from the plurality of action unit means B or the plurality of inter-robot action unit means H in accordance with priorities predefined for the "reckless" type with respect to the respective action unit means B and respective inter-robot action unit means H.

10. An insect robot comprising:

external state detection means AA for detecting an external state such as an environmental state or obstacle state in action space of the insect robot and outputting an external state signal;

sensor identification unit determining means K for determining a sensor identifying unit in accordance with the external state signal;

instruction unit setting means L for setting one or more instruction units for the one or more sensor identifying units such that one or more action units, in each of which an action type and a duration thereof are defined, are connected to the one or more sensor identifying units, respectively;

instruction unit storage means M for storing one or more instruction units set by the instruction unit setting means L such that one or more instruction units are individually and sequentially readable;

action unit sequentially selecting means N for sequentially selecting one or more action units connected to one sensor identifying unit determined by the sensor identification unit determining means K, said one or more action units and said one sensor identifying unit being included in one instruction unit;

the action unit execution means D for driving an actuator so that an action of said type defined by an action unit selected by the action unit sequentially selecting means N is executed for a duration assigned to the action; and leg means 8 and 9 that are moved by actuators 13 and 14 driven by the action unit execution means D so that the insect robot performs the action of said type for the duration assigned to the action.

11. An insect robot according to claim 10, wherein the external state detection means AA outputs, as an external state signal, an obstacle state signal generated in response to detection of an obstacle in the action space, a lightness state signal generated on the basis of detected lightness of the action space, a obstacle state signal generated in response to detection of contact with an obstacle present in the action space, and a constraint state signal in response to detecting that the insect robot is in a constraint state in the action space.

12. An insect robot according to claim 10, further comprising preferential action unit selection means O for preferentially selecting an action unit such that when an action unit in an instruction unit is being executed, if an action unit in another instruction unit including another sensor identifying unit determined by the sensor identification unit determining means K has a higher preassigned priority than that of the action unit being currently executed, the action unit in said another instruction is preferentially selected instead of the action unit being currently executed.

13. An insect robot according to claim 10, wherein the instruction unit setting means L sets an instruction unit so as to further define the permission/prohibition of interruption of a current action unit in the instruction unit to execute another action unit; and the preferential action unit selection means O preferentially selects an action unit such that when an action unit in an instruction unit is being executed, when an action unit in another instruction unit including another sensor identifying unit determined by the sensor identification unit determining means K has a higher preassigned priority than that of the action unit being currently executed, if and only if the interrupt of the current action unit to execute another action unit is permitted, an action unit in another instruction unit is preferentially selected instead of the current action unit.

14. An insect robot according to claim 10, wherein the pheromone signal transmitting means E transmits, as a transmission pheromone signal, a self pheromone signal representing self identification information uniquely preassigned to said insect robot in the action space, or a notification pheromone signal representing notification information indicating the type of an action unit that can be set by the instruction unit setting means L; the pheromone signal receiving means F receives, as a reception pheromone signal, an other's pheromone signal representing other's identification information uniquely preassigned to another insect robot, from the pheromone signal transmitting means E of said another insect robot present in the action space, or a notification pheromone signal representing notification information indicating the type of a given action unit, or a space pheromone signal present in the action space; and the sensor identification unit determining means K determines a sensor identifying unit of "presence of another insect robot of a particular type" and "pheromone signal reception" in accordance with the reception pheromone signal.

15. An insect robot according to claim 10, wherein the instruction unit setting means L includes, as one type of action to be set in an instruction unit, a special command "switch to another panel" to switch the execution from one or more instruction units constituting a panel to one or more instruction units constituting another panel; the instruction unit storage means M stores panels each including one or more instruction units in accordance with the panel designation signal such that any of the panels is individually readable; and the action unit sequentially selecting means N is capable of selecting the special command "switch to another panel" included in one or more action units connected to the one sensor identifying unit; and wherein the insect robot further comprises panel designation signal generating means R, for, when the special command "switch to another panel" is selected by the action unit sequentially selecting means N, generating a panel designation signal in accordance with designation of another panel by the command.

16. An insect robot according to claim 10, wherein the instruction unit setting means L includes, as one type of action to be set in an instruction unit, a sensor identifying unit "trigger after elapse of a particular period of time" for outputting a trigger signal when a predetermined trigger period has elapsed; and the instruction unit storage means M stores instruction units including the sensor identifying unit "trigger after elapse of a particular period of time" such that the instruction units are individually and sequentially readable; and wherein the insect robot further comprises a trigger signal generating means Q which counts a lapse of a particular period of time defined by the sensor identifying unit "trigger after elapse of a particular period of time" read from the instruction unit storage means M and generates a trigger signal when the particular period of time has elapsed; and further wherein the sensor identification unit determining means K determines the sensor identifying unit "trigger after elapse of a particular period of time" in accordance with the trigger signal.

17. An insect robot according to claim 10, further comprising instruction unit transmission means P wherein the instruction unit setting means L is implemented on a mobile computer disposed detachedly from the insect robot; and the instruction unit storage means M stores one or more instruction units set by the instruction unit setting means L and transmitted via the instruction unit transmission means P such that said one or more instruction units are individually and sequentially readable.

* * * * *